US006213464B1

(12) United States Patent
Inoue et al.

(10) Patent No.: US 6,213,464 B1
(45) Date of Patent: Apr. 10, 2001

(54) IMAGE FORMING APPARATUS

(75) Inventors: Hiroyuki Inoue; Koh Hasegawa, both of Yokohama; Shinya Asano; Takashi Nojima, both of Tokyo; Akira Kida, Kawasaki; Takeshi Iwasaki, Yokohama; Noriko Kawasaki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/288,220

(22) Filed: Apr. 8, 1999

(30) Foreign Application Priority Data

Apr. 15, 1998 (JP) ..... 10-105134

(51) Int. Cl.[7] ..... B65H 9/16

(52) U.S. Cl. ..... 271/248; 271/253; 271/226; 271/162

(58) Field of Search ..... 271/248, 253, 271/255, 226, 234, 239, 162; 400/633; 399/394

(56) References Cited

U.S. PATENT DOCUMENTS

| | | | | |
|---|---|---|---|---|
| 5,005,025 | | 4/1991 | Miyakawa et al. . | |
| 5,065,158 | | 11/1991 | Nojima et al. . | |
| 5,170,184 | | 12/1992 | Hanabusa et al. . | |
| 5,238,235 | * | 8/1993 | Nitta et al. | 271/162 |
| 5,291,224 | | 3/1994 | Asano et al. . | |
| 5,379,998 | * | 1/1995 | Nakagawa | 271/248 |
| 5,480,247 | | 1/1996 | Saikawa et al. . | |
| 5,506,606 | | 4/1996 | Saikawa et al. . | |
| 5,524,874 | * | 6/1996 | Tojima | 271/162 |
| 5,531,431 | * | 7/1996 | Saito et al. | 271/162 |
| 5,610,636 | | 3/1997 | Hanabusa et al. . | |
| 5,636,929 | | 6/1997 | Asano et al. . | |
| 5,697,716 | * | 12/1997 | Akahane | 271/226 |
| 5,733,055 | | 3/1998 | Hiramatsu et al. . | |
| 5,823,522 | * | 10/1998 | Fujiwara et al. | 271/162 |
| 5,847,719 | | 12/1998 | Yamaguchi et al. . | |
| 5,877,783 | | 3/1999 | Iwasaki et al. . | |
| 5,892,523 | | 4/1999 | Tanaka et al. . | |

FOREIGN PATENT DOCUMENTS

| | | | | |
|---|---|---|---|---|
| 403128828 | * | 5/1991 | (JP) | 271/162 |
| 404049144 | * | 2/1992 | (JP) | 271/162 |
| 6-183582 | | 7/1994 | (JP) . | |

* cited by examiner

*Primary Examiner*—H. Grant Skaggs
(74) *Attorney, Agent, or Firm*—Fitzpatrick, Cella, Harper & Scinto

(57) ABSTRACT

A skew feed or damage in the sheet in automatic feeding is avoided. In an image forming apparatus provided with a printer for recording an image, the printer is provided with a feeding port for enabling manual insert sheet feeding and an automatic sheet feeder (ASF) is detachably mounted on the feeding port to enable automatic sheet feeding through the feeding port. As shown in the drawings, the printer is provided with a printer sheet guide for manual insert sheet feeding, while the ASF is provided with an ASF sheet guide for automatic sheet feeding, and the ASF sheet guide is displaced toward the inner side of the sheet by a predetermined amount with respect to the printer sheet guide. Thus, the sheet automatically fed utilizing the ASF sheet guide does not contact the printer sheet guide, whereby the skew feed of the sheet and the damage to the sheet end can be prevented.

8 Claims, 36 Drawing Sheets

[SHEET FEEDING FLOWCHART OF PRINTER]

[MAIN FLOWCHART OF ASF]

[SHEET FEEDING FLOWCHART C2 OF ASF]

[ INITIALIZING FLOWCHART C3 OF ASF ]

[TYPE OF DEVICE DISCRIMINATING FLOWCHART C1 OF PRINTER]

[SHEET FEEDING FLOWCHART OF PRINTER]

[SHEET FEEDING FLOWCHART C2 OF ASF]

FIG. 38

| | TYPE OF SHEET | DRIVING SPEED ON REGISTRATION | PULSE NUMBER $P_5$ ON REGISTRATION |
|---|---|---|---|
| $T_1$ | ORDINARY PAPER | MIDDLE SPEED | SMALL |
| $T_2$ | POSTCARD | MIDDLE SPEED | LARGE ($P_5=P_{max}-P_c$) |
| $T_3$ | ENVELOPE | LOW SPEED | MIDDLE |
| $T_4$ | GLOSSY PAPER | LOW SPEED | SMALL |
| $T_5$ | NO DESIGNATION | MIDDLE SPEED | LARGE ($P_5=P_{max}-P_c$) |

IMAGE FORMING APPARATUS

BACKGROUND OF THE INVENTION

1. Field of the Invention

The present invention generally relates to an image forming apparatus provided with a recording apparatus for recording an image on a sheet, and a sheet feeding apparatus detachably mounted on the recording apparatus for automatically feeding sheets in succession, and more particularly to a guide member for defining a conveying path of the sheet.

2. Related Background Art

There have conventionally been proposed various image forming apparatuses for forming an image on a sheet.

Among such apparatuses, there has been proposed an apparatus provided with a recording apparatus for image recording (hereinafter called "printer") and an auto sheet feeder (hereinafter referred to as "ASF") detachably mounted on a sheet feeding port of the printer, wherein, through such sheet feeding port:

sheets are manually fed one by one when the ASF is not mounted; and sheets are automatically fed in succession when the ASF is mounted (see the Japanese Patent Application Laid-Open No. 6-183582).

In the image forming apparatus of the above-described type, the printer is provided with a guide member for guiding the sheet in case of sheet feeding with manual insert, while the ASF is provided with a guide member for guiding the sheet in case of automatic sheet feeding. These guide members are provided in approximately the same position in the transverse direction of the sheet, such that the image recording position in the transverse direction of the sheet (namely the position of image formation on the sheet, in the transverse or width direction thereof) remains the same in the sheet feeding with manual insert and in the automatic sheet feeding.

In the image forming apparatus of the above-described type, however, if the guide member of the printer is positioned at the inner side of the sheet compared to the guide member of the ASF because of the dimensional tolerance at the manufacture thereof, the guide member of the printer becomes an obstacle for the automatically fed sheets and may induce skewing or jamming of the sheet or damage to the sheet end.

Such drawback can be resolved by precisely assembling the image forming apparatus with highly precise parts, but such assembling is difficult and the use of the highly precise parts results in an increased cost.

Furthermore, even if the guide member of the printer and that of the ASF are provided in substantially the same position in the transverse direction of the sheet, a sheet eventually skewed will interfere with the guide member of the printer, thus inducing skew or jamming of the sheet or damage to the sheet end.

SUMMARY OF THE INVENTION

In consideration of the foregoing, an object of the present invention is to provide an image forming apparatus for preventing skewing or jamming of a sheet or damage to an end of the sheet.

Another object of the present invention is to provide an inexpensive image forming apparatus.

Still another object of the present invention is to provide an image forming apparatus for matching an image recording position in a transverse direction of the sheet, regardless of whether a sheet feeding apparatus is used or not.

The above-mentioned objects can be attained, according to the present invention, by an image forming apparatus provided with a recording apparatus having a feeding port for feeding a sheet and recording an image on the sheet fed from the feeding port, and a sheet feeding apparatus detachably mountable on the feeding port and automatically feeding the sheets in succession to the recording apparatus.

In the present invention, the recording apparatus includes a first guide member for guiding an edge of the sheet in the transverse direction of the sheet.

The sheet feeding apparatus includes a second guide member for guiding the edge of the sheet in the transverse direction of the sheet.

The second guide member is disposed and displaced toward an inner side of the sheet with respect to the first guide member.

In such a case, the image recording position in the transverse direction of the sheet is preferably displaced, in case the sheet is fed by the sheet feeding apparatus, toward the inner side of the sheet, in comparison with the case in which the sheet is not fed by the sheet feeding apparatus, by an amount substantially equal to the amount of displacement between the first guide member and the second guide member.

There may also be provided mode discrimination means for discriminating whether the sheet feeding is executed by the sheet feeding apparatus, and the image recording position in the transversal direction of the sheet may be displaced according to the result of discrimination by the mode discrimination means.

In such case, the recording apparatus and the sheet feeding apparatus may be respectively provided with connectors allowing mutual electrical connection, and the mode discrimination means may electrically detect the connection state of the connectors.

On the other hand, the recording apparatus may be provided, together with the first guide member, with a third guide member for guiding an edge of the sheet in the transverse direction thereof, while a conveying path of the sheet when the sheet feeding apparatus is connected to the recording apparatus is disposed to make a detour to avoid the third guide member.

BRIEF DESCRIPTION OF THE DRAWINGS

FIG. 38 is a chart showing the content of a drive table T for a sheet feeding motor 27.

DETAILED DESCRIPTION OF THE PREFERRED EMBODIMENTS

Now the present invention will be described in detail by preferred embodiments thereof, with reference to the attached drawings.

[First Embodiment]

Figure 1:
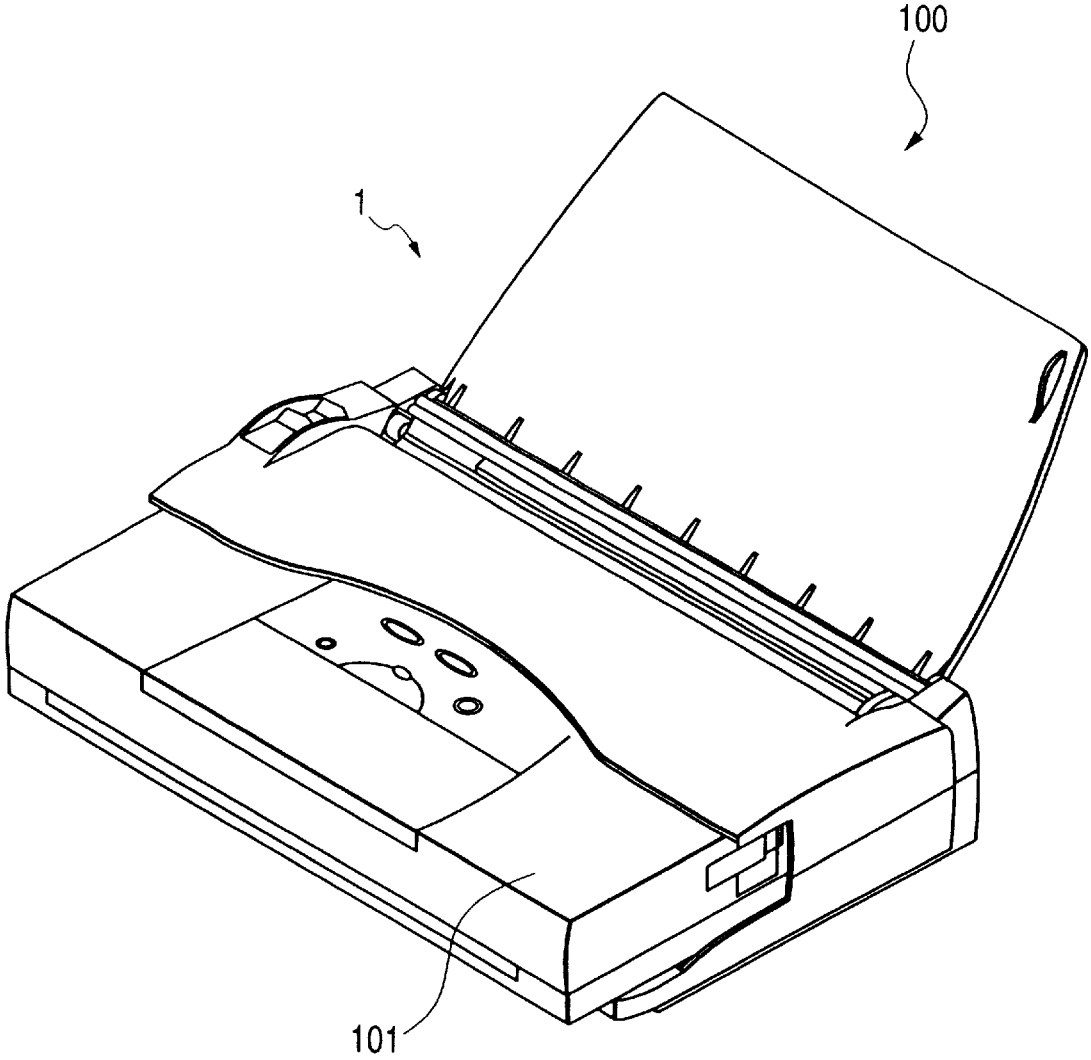
FIGS. 1 and 2 are perspective views showing embodiments of the present invention.
Figure 2:
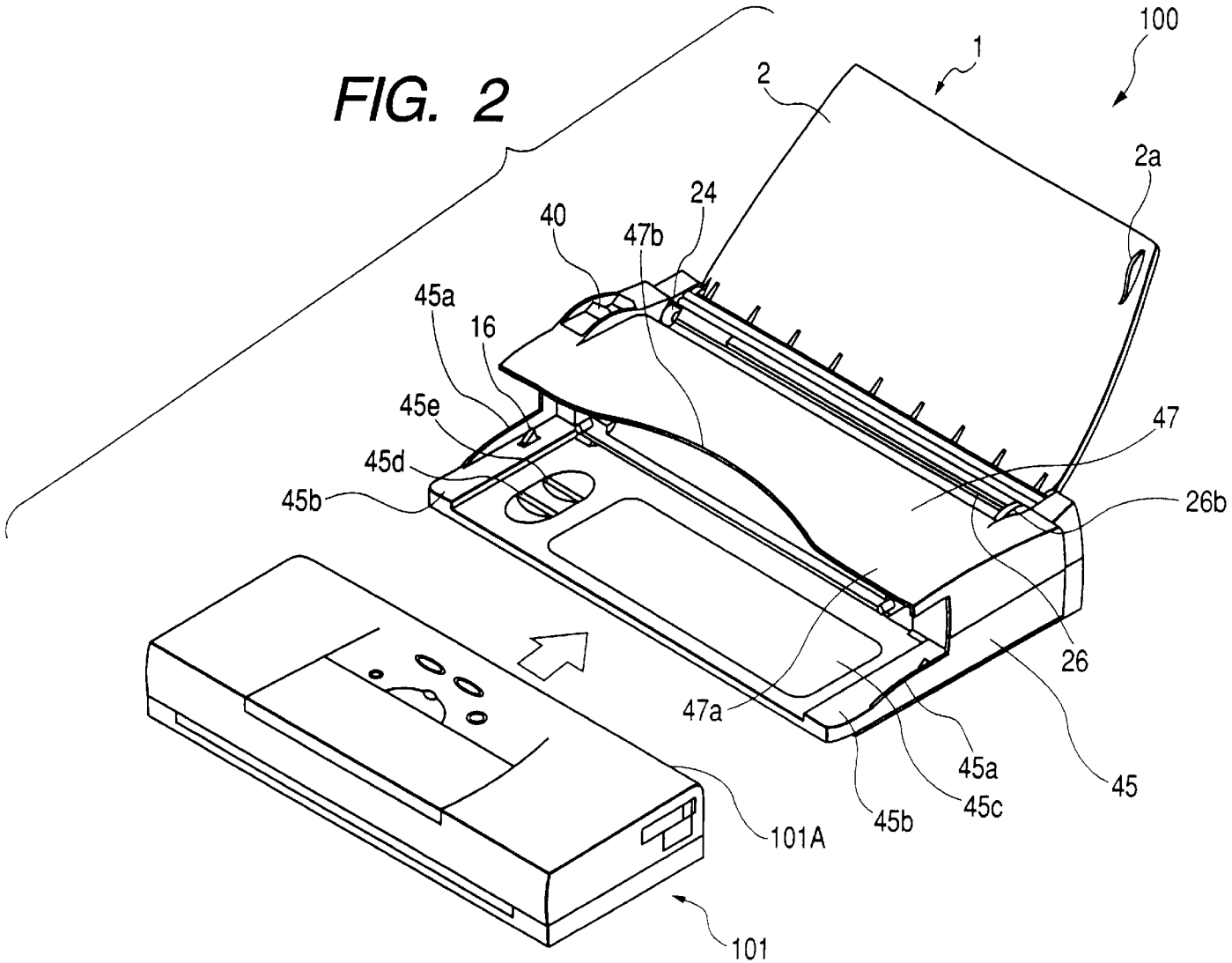
Figure 3:
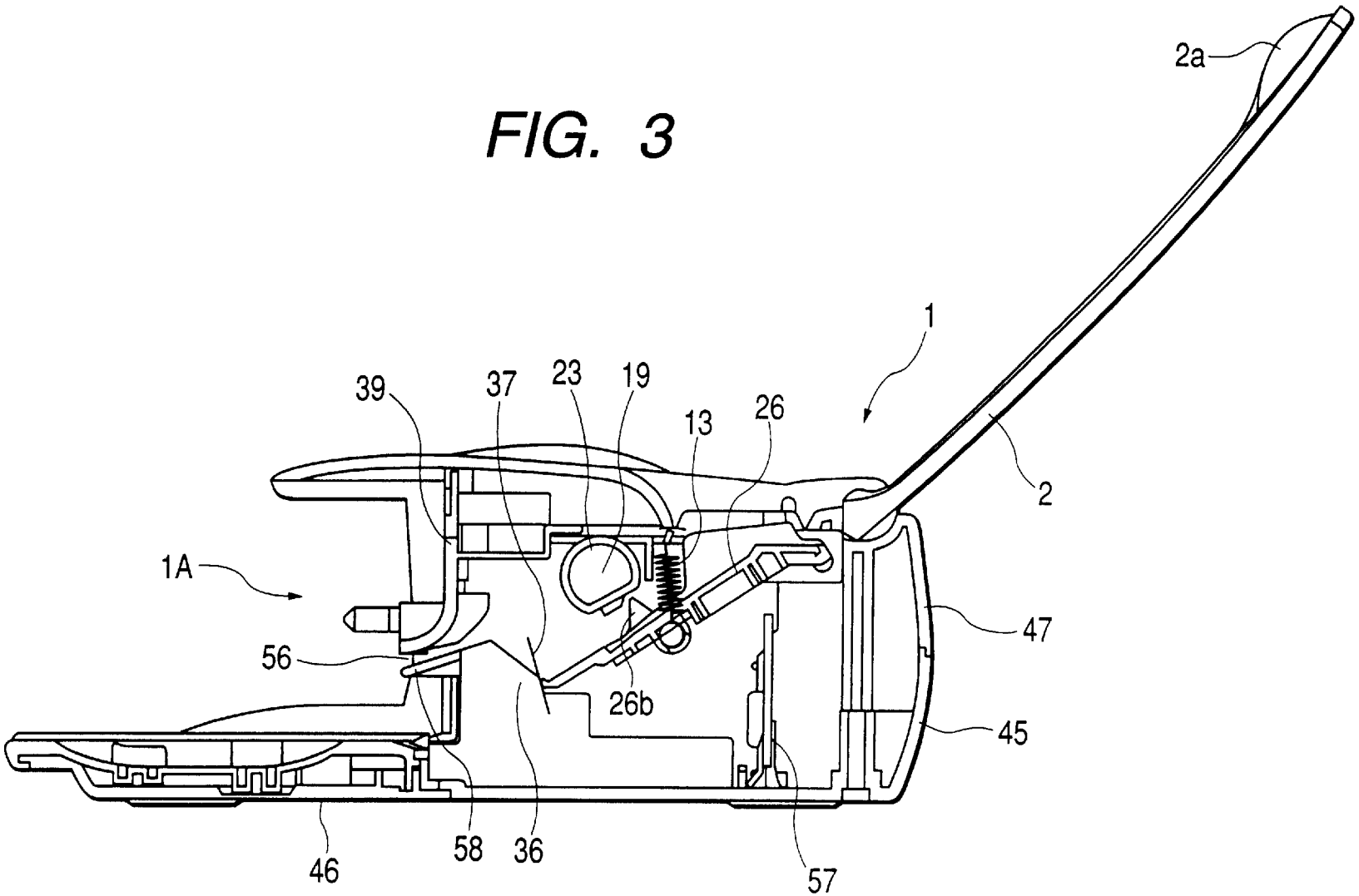
FIGS. 3 and 4 are cross-sectional views showing embodiments of the present invention.
Figure 4:
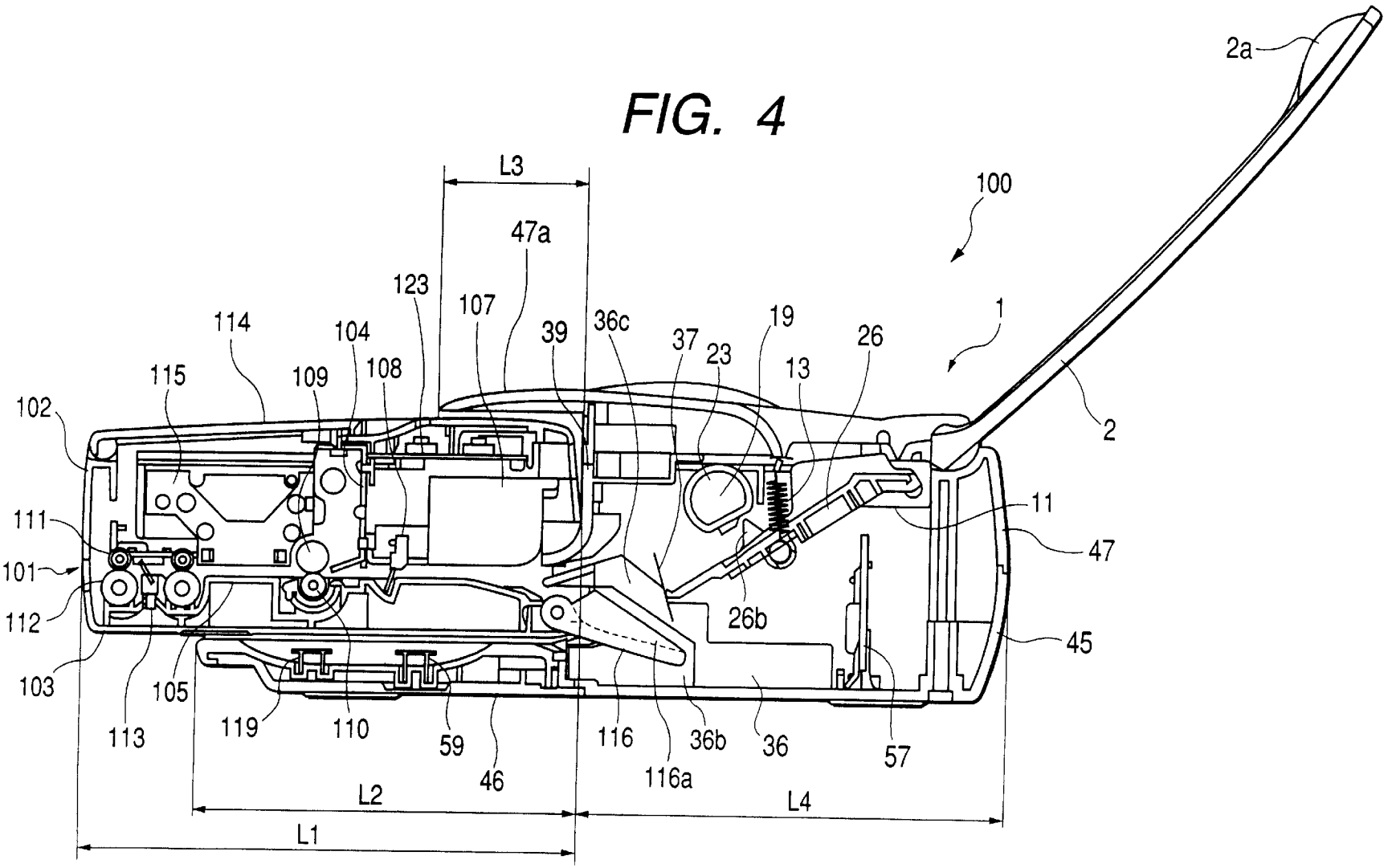

FIG. 1 is a perspective view showing a printer mounted to an ASF constituting a first embodiment of the present invention; FIG. 2 is a view showing the mode of mounting of the printer to the ASF; FIG. 3 is a cross-sectional view of the ASF; and FIG. 4 is a cross-sectional view of the ASF in a state in which the printer is mounted.

As shown in FIGS. 1 to 4, the image forming apparatus 100 is provided with a printer (recording apparatus) 101 for recording an image on a sheet, and an ASF (automatic sheet feeding apparatus) 1 for automatically feeding sheets in succession to the printer 101. The printer 101 is provided with a sheet feeding port (feeding port) 101A (cf. FIG. 5) for feeding the sheets, and the ASF 1 is so constructed as to be detachably mounted to the feeding port 101A. The printer 101 and the ASF 1 are respectively provided with connectors 117, 44 capable of mutual electrical connection, as will be explained later.

The above-mentioned printer 101 is a so-called mobile printer, which is compact, portable and is provided with a battery. In the present embodiment, the printer 101 is not provided with the ASF, so that the printer 101 alone can only achieve a sheet feeding in manual insert. Such configuration allows compactization, simplification and low cost in the printer 101, optimum for the mobile printer. However, the present invention is naturally applicable even if the printer 101 is provided with a compact ASF.

Such compact, portable printer 101 is assumed to be particularly used outdoors, in an automobile or in a customer's office at the visit of a salesman. In such situations, the number of the required recording sheets is relatively small, so that the manual insert sheet feeding or the simple internal ASF of a low capacity is presumed to be enough, but, if the printer 101 is used in the ordinary office environment, there may be encountered a requirement of printing the various sheets of a relatively large quantity.

The ASF 1 separated from the printer 101 is suitable for such requirement. The ASF 1 has a so-called desk-top form which is commonly found on the desk of the ordinary office environment, and the printer 101, when fitted to the ASF 1, can have the character of a desk-top printer. The ASF can automatically feed various recording media, not only ordinary paper but also postcards, envelopes, plastic films, fabrics etc. owing to the configuration to be explained later.

Thus the present embodiment can provide an extremely valuable printer, in which a printer which is compact and mobile when used singly can also be used as a desk-top printer of high performance by being mounted to the ASF of the present invention. The ASF 1 functions also as so-called docking station, serving as a storage box for the printer 101 when it is not used, and also adding the automatic sheet feeding function when the printer is mounted.

The ASF 1 of the present invention can stably stand by itself when the printer 101 is not mounted, and can separate the printer 101 while supporting the sheets. Thus, the stand-by state for the operation of the desk-top printer can be attained by simply mounting the separated printer 101 to the self-standing ASF 1. Consequently, there can be provided a docking station extremely convenient for use by the user.

In order to use the printer 101 both as the mobile printer and the desk top printer, it is important that the mounting and dismounting operations of the ASF 1 and the printer 101 can be easily achieved, because, for a user who carries the printer 101 without the ASF 1 almost everyday and combines the printer 101 with the ASF 1 whenever returning to his office, a complicated or time-taking operation of mounting and dismounting will be cumbersome.

In the present embodiment, as shown in FIG. 3, the ASF 1 is provided at the front face thereof with an aperture 1A, for accommodating the printer 101. The printer 101 is also provided with a substantially horizontal sheet passing path, and is so constructed as to be pushed into the front aperture 1A of the ASF 1 with the sheet feeding side of the printer 101 being moved substantially horizontally toward the ASF 1 whereby a sheet path as will be explained latter is formed.

Thus, in the present embodiment, the printer 101 having the horizontal path is pushed substantially horizontally into the ASF 1 and is mounted thereto. When the printer 101 is pushed substantially horizontally into the ASF 1, the printer 101 is automatically fixed thereto (method of mutual fixation when the printer 101 is mounted to the ASF 1 being explained later in detail). In order to separate the printer 101 from the ASF 1, it is merely necessary to push a lever 40 provided on the upper face of the ASF 1, whereby the printer 101 is unlocked from the ASF 1 and is pushed out toward the front side of the ASF 1.

Such configuration allows the user to achieve extremely easily mounting and dismounting of the printer 101 and the ASF 1, whereby the printer can be used as the mobile printer and also as the desk-top printer.

In the present embodiment, in order to facilitate the mounting and dismounting operations, the ASF 1 is provided at the front side thereof with a table portion 45*c*. In case of mounting the printer 101 to the ASF 1, the printer 101 is at first placed on the table portion 45*c*. In this operation, the user grasps, with one hand, the top and bottom faces of the printer 101 at the approximate center portion of the front (a sheet discharging side) thereof and places the printer 101 in such a manner that the rear side (a sheet feeding side) of the printer 101 is lightly positioned on the table portion 45*c*. (Otherwise the user may hold both ends of the printer 101 with both hands.)

Then the printer 101 placed on the table portion 45*c* is pushed deeper with a hand, whereby the lateral faces of the printer 101 are guided, by printer side guide portions 45*a* provided at both ends of the table portion 45*c*, to a positioning boss (to be explained later), which is thus fitted with a positioning hole (to be explained later) of the printer 101 and the positioning is achieved. In this operation, the user is only required to place the printer 101 at the approximate center of the table portion 45*c* and to press in the printer 101, and any precise positioning operation is not required.

The table portion 45*c* is provided, at both lateral portions, with printer sliding areas 45*b* on which the bottom face of the printer slides. The printer 101 is provided, on the bottom face thereof, with plural rubber feet (not shown), in order that the printer 101 is less easily moved by the external force when the printer 101 is singly used for example on a desk.

However, in mounting the printer 101 to the ASF 1, there will be required a large pressing force and the pressing operation of the printer 101 will become difficult if the rubber feet are in contact with the table portion 45*c*. Consequently, the printer sliding portions 45*b* are formed with a step difference larger than the height of the rubber feet, in order that the rubber feet do not come into contact with the table portion 45*c*.

On the other hand, the upper case 47 of the ASF is provided with an eaves portion 47*a* substantially parallel to the table portion 45*c*, and forms, in cooperation with the table portion 45*c*, a pocket for accommodating the printer 101. The pocket thus formed indicates to the user, by its form, the direction of substantially parallel pushing of the printer 101 toward the ASF 1, and the user can push the printer 101 only in such direction.

This pushing direction coincides with the connection direction of the connectors to be explained later for electrically connecting the printer 101 and the ASF 1, and the connectors are mutually connected in the course of pushing the printer 101 into the ASF 1. Such configuration improves operability by eliminating other separate operations for connecting the connectors, and prevents destruction of the connectors resulting from abnormal interference thereof caused by pushing from a different direction.

Also, if the front portion (sheet discharging side) of the printer 101 receives an upward force after the printer 101 is mounted to the ASF 1, the eaves portion 47*a* prevents that the printer 101 is lifted upwards with respect to the ASF 1 to cause destruction of the mounting portion or release of the mounting.

Also in the present embodiment, the eaves portion 47*a* shows a largest protruding amount at both ends and has a recessed eaves portion 47*b* at the center. Such recessed eaves portion 47*b* avoids covering of an operation unit, such as a power switch, provided on the top face of the printer 101. The effect of preventing the above-mentioned upward lifting motion of the printer can be sufficiently obtained in case the clearance between the eaves portion 47*a* and the top face of the printer is within a range of 0.5 to 2 mm, but the desired effect cannot be obtained if the clearance is excessively large.

In the present embodiment, the depth L1 of the printer 101, the depth L2 of the table portion 45*c* and the depth L3 of the eaves portion 47*a* shown in FIG. 4 satisfy the following relation:

$$L1/2 \leq L2 \leq L1-15 \text{ mm}$$

The printer 101 can be stabilized when it is mounted in the ASF 1, by selecting the depth L2 of the table portion 45*c* larger than a half (L1/2) of the depth L1 of the printer. Such relationship need only be satisfied in a part of the table portion 45*c* but not in the entire area of the table portion 45*c*.

If L1/2≥L2, the printer 101 protrudes significantly from the ASF 1 in the mounted state, and the entire apparatus becomes very unstable, as the rear part thereof may be lifted for example by a downward external force applied to such protruding portion.

On the other hand, a finger inserting space can be secured under the front side of the printer 101 by selecting the depth L2 of the table portion 45*c* smaller, by at least 15 mm, than the depth L1 of the printer 101. Thus the user can hold the top and bottom faces of the printer 101 with a hand, in mounting and dismounting the printer 101. (Naturally the user may hold the printer with both hands.) Such relationship need not be satisfied over the entire width of the table portion 45*c* but a recess or recesses may be formed at the central portion or at the end portions so as to satisfy the above-mentioned relationship.

Furthermore, as a space is provided under the front face of the printer 101, there can be realized a design without a large height in the visual impression. The thickness (height) of the table portion 45*c* is preferably at least about 10 mm in order that the user can insert a finger under the printer 101.

The present embodiment further satisfies the following relationship:

$$L1/4 \leq L3 \leq L1/2$$

It is found possible to prevent the upward lifting the printer 101 and there can be obtained sufficient effect for limiting the pressing direction of the printer 101 if the depth L3 of the eaves portion 47*a* is equal to or more than ¼ of the depth L1 of the printer 101. It is also found, if the depth L3 of the eaves portion 47*a* exceeds ½ of the depth L1 of the printer 101, the pushing amount of the printer 101 is excessively large with respect to the depth of the printer 101 and the feeling for operation becomes unsatisfactory.

Also, the large eaves portion 47*a* results in visual disadvantages that the entire apparatus appears larger and oppressive to the user. It may also interfere with the manipulation of the printer 101 on the top face of the printer 101, so that the depth L3 of the eaves portion 47*a* preferably does not exceed ½ of the depth of the printer 101. The protruding amount within the above-mentioned range can maintain a sufficient strength in thus protruding eaves portion 47*a*, thus providing sufficient toughness in the entire apparatus.

The configuration of the table portion 45*c* and the eaves portion 47*a* under the above-mentioned conditions allows a form capable of fully exhibiting the effects such as extremely good operability, limitation of the pressing direction and prevention of the upward lifting of the printer 101.

Between the table portion 45*c* and the eaves portion 47*a* there are laterally formed large apertures, as the height of the printer side guide portions 45*a* need only be larger than the clearance between the eaves portion 47*a* and the top face of the printer 101. Such a large aperture avoids interference with a power supply cord, an interface connector or an infrared communication unit eventually provided on the lateral faces of the printer 101. Thus, the printer 101 with the power supply cord or the interface connector mounted thereon may be mounted to or detached from the ASF 1.

Below there will be explained the connectors 117, 44 for enabling mutual electrical connection of the printer 101 and the ASF 1, and connector covers 119, 59 for protecting these connectors.

The printer 101 and the ASF 1 are respectively provided with detachable and attachable connectors 117, 44, which are electrically connected for exchanging the power supply or the control signals. (In the following description, the connector 117 at the side of the printer 101 will be referred to as "printer connector 117", while the connector 44 of the ASF 1 will be referred to as "ASF connector 44".

Figure 5:
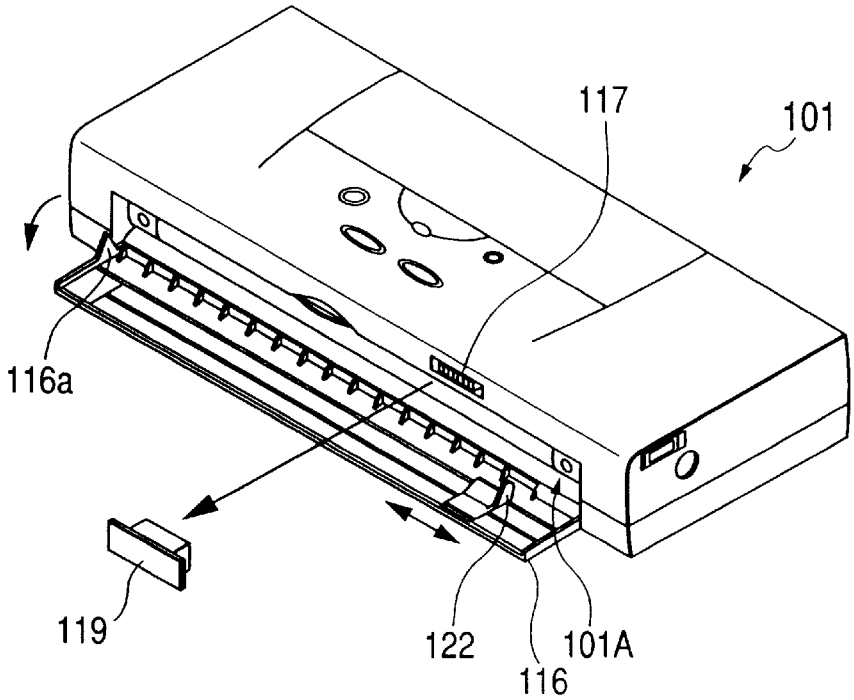
FIGS. 5 and 6 are perspective views showing embodiments of the present invention.
Figure 6:
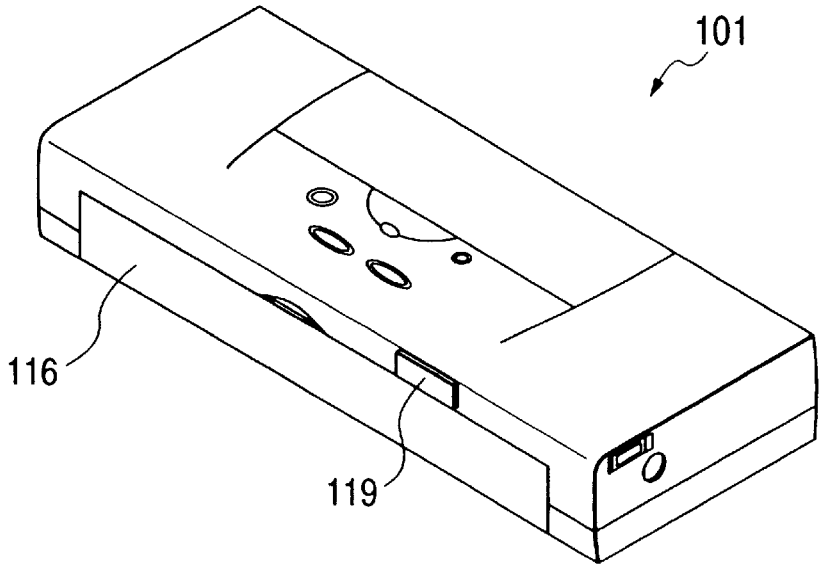
Figure 11:
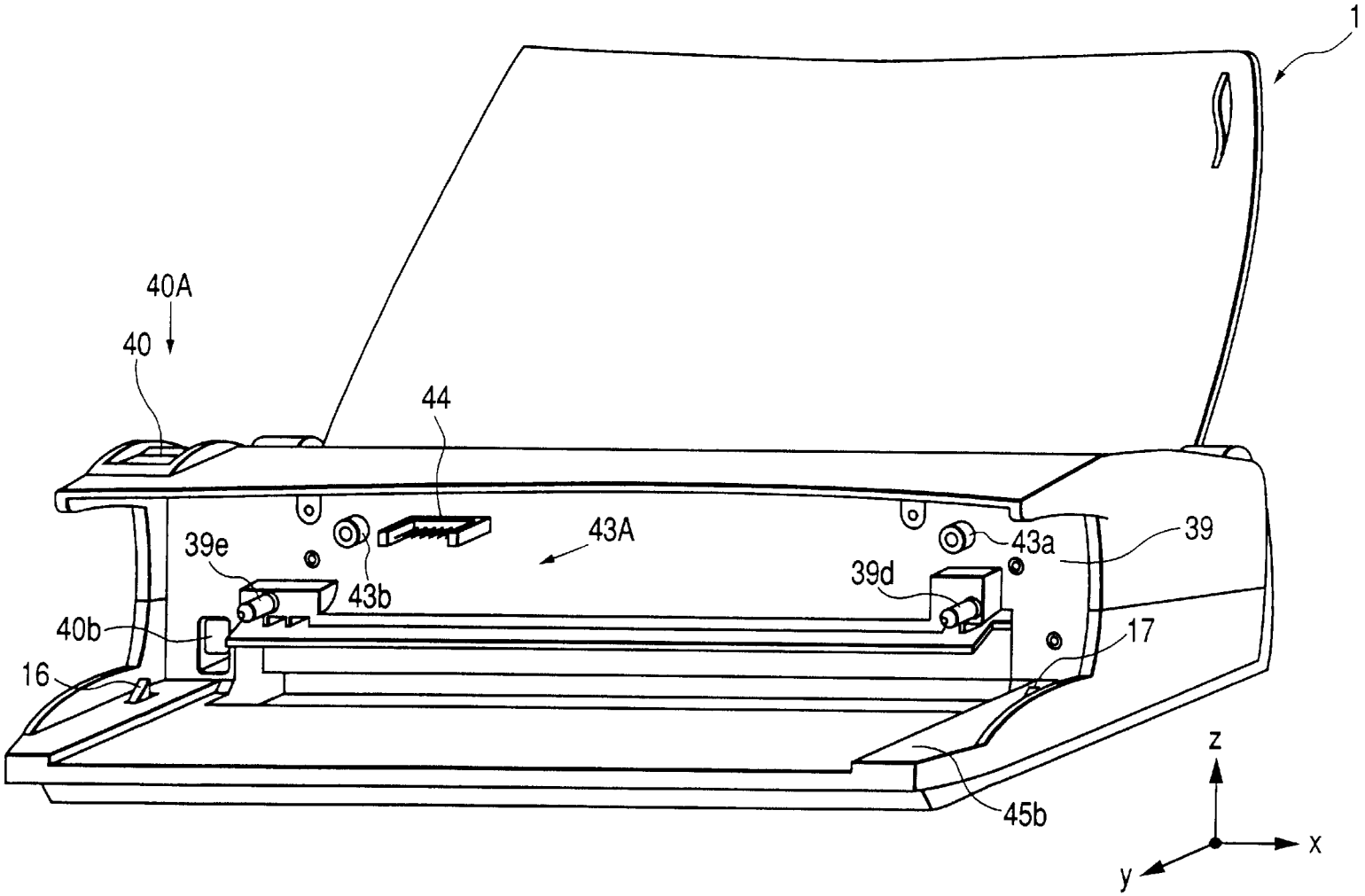
FIG. 11 is a perspective view showing an arrangement of parts relating to a printer mounting and dismounting mechanism of the ASF of the present invention.

The printer connector 117 is provided, as shown in FIG. 5, in the upper part of a face opposed to the ASF 1 on the mounting operation of the printer 101 to the ASF 1, and the ASF connector 44 is provided, as shown in FIG. 11, in a position opposed to the printer connector 117 when the printer 101 is mounted.

The printer 101 and the ASF 1 are respectively provided with connector covers 119, 59 detachably mountable on the connectors 117, 44. (In the following description, the connector cover for protecting the printer connector 117 will be referred to as "printer connector cover 119", while the connector cover for protecting the ASF connector 44 will be referred to as "ASF connector cover 59". See FIGS. 5 and 4 respectively for the printer connector cover 119 and the ASF connector cover 59). When the printer 101 and the ASF 1 are mutually separated, the connector covers 119, 59 are respectively fitted on the connectors 117, 44 for protecting the same. Thus the connectors 117, 44 are protected from dust deposition, whereby the conductivity in the connected state can be satisfactorily maintained. It is also rendered possible to prevent application of excessive large static electricity to the internal electrical circuits through the connectors 117, 44, thereby preventing destruction of such electrical circuits. Furthermore, such detachable connector covers 119, 59 allows to achieve a lower cost and space saving, and are particularly suitable for an ultra compact printer such as the mobile printer.

On the other hand, on the upper face of the table portion 45*c* of the ASF 1 (namely the surface on which the printer 101 rests), there are provided connector cover storage areas 45*d*, 45*e* for storing the connector covers 119, 59 detached from the connectors 117, 44, whereby, in the mutually connected state of the printer 101 and the ASF 1, the connector covers 119, 59 detached from the connectors 117, 44 are placed in such storage areas 45*d*, 45*e* (cf. FIG. 4). The storage areas 45*d*, 45*e* are composed of projections corresponding to the dimensions of the connectors, within the thickness of the table portion 45*c*.

The connector covers 119, 59 stored in the storage areas 45*d*, 45*e* are supported between the printer 101 and the ASF 1, thus being protected from being lost. Such configuration is also preferable from an aesthetic standpoint as the connector covers 119, 59 become no longer visible from the outside. Furthermore, in detaching the printer 101 from the ASF 1, the connector covers 119, 59 stored in the storage areas 45*d*, 45*e* become easily visible so that the user does not forget fitting of the connector covers 119, 59 on the connectors 117, 44.

With respect to the present embodiment relating to the connector covers, the present invention is applicable to the printer and the ASF even when they are for example a notebook personal computer and a station therefor.

Furthermore, the printer connector 117 and the ASF connector 44 of the present embodiment are both protected by the connector covers 119, 59, but either of the connectors 117, 44 may be protected by a connector cover.

Furthermore, the connector cover storage areas are provided, in the present embodiment, on the upper face of the table portion 45*c* of the ASF 1, but they may be provided in another part of the ASF 1. Also, the connector cover storage areas may be provided in the printer 101 instead of the ASF 1.

Below there will be outlined how the recording sheet is fed and recorded in a state where the printer 101 is mounted to the ASF 1 (details being given later).

FIG. 4 is a cross-sectional view showing a state in which the printer 101 is mounted to the ASF 1, wherein a pressure plate 26 is provided for setting a predetermined number of sheets to be explained later. The pressure plate 26 is rotatably supported at an end thereof by an ASF chassis 11 and is clockwise biased, by a pressure plate spring 13, toward a pickup rubber member 23, wound around a pickup roller 19.

At the sheet setting, the pressure plate 26 is displaced and retained in a direction separated from the pickup rubber member 23, by means of a cam to be explained later. In such state, a predetermined clearance is maintained between the pickup rubber member 23 and the pressure plate 26, and the sheets are inserted and set in such clearance.

The leading end of the sheet impinges on and is defined in position by a bank sheet 37, composed of a plastic film, provided on a bank 36. A major portion of a trailing end of the sheet is supported by an ASF sheet feeding tray 2, which is rotatably supported at an end thereof by an upper case 47 and is supported at a certain angle in a sheet supporting state.

When the ASF 1 receives a sheet feeding command from the printer 101, the pickup roller 19 starts clockwise rotation and the cam at the same time releases the pressure plate 26 from the supported state. Thus, the pressure plate 26 comes into contact with the pickup rubber member 23 whereby the sheet starts to move by the surface friction of the pickup rubber member 23. A sheet is then separated by the bank sheet 37 and is transported in an ASF sheet path 58 (cf. FIG. 3) formed by the bank 36 and a positioning base 39.

Thereafter, the sheet is conveyed from an ASF sheet discharge portion 56 (cf. FIG. 3) to a sheet path, formed by a platen 105 and a bottom surface of a battery 107 in the printer and constituting a manual insertion port in the printer 101 alone.

When a sheet end sensor 108 detects the sheet conveyed in the above-mentioned sheet path, the printer 101 recognizes the sheet conveyance from the ASF 1, and a leading end of the sheet impinges on a nip between an LF roller 109 and a pinch roller 110. Also in response to the information from the sheet end sensor 108 of the printer 101, the ASF 1 transmits, at a predetermined timing, a response signal indicating the completion of sheet feeding to the printer.

In this state the sheet is pressed, by the rigidity thereof, toward the nip between the LF roller 109 and the pinch roller 110, thereby achieving so-called registration of the leaving end of the sheet. Upon receiving the response signal indicating the completion of the sheet feeding from the ASF 1, the printer 101 rotates the LF roller 109 at a predetermined timing, thereby advancing the sheet toward a recording unit provided with a head 115. Thus, the sheet is advanced by a predetermined manner and the head 115 executes the recording on the sheet surface. Subsequently, the sheet is conveyed between a discharging roller 112 and a spur 111 and is discharged.

In the present embodiment, the sheet path is formed in the above-described manner when the printer 101 is mounted to the ASF 1, and the mounting direction of the connectors 44, 117 is substantially parallel to the direction of such sheet path of the printer 101.

In the case the sheet conveyed from the ASF 1 to the printer 101 and present over the ASF 1 and the printer 101 is jammed in any part, it becomes necessary to separate the printer 101 from the ASF 1. The substantially parallel configuration of the sheet path and the connecting direction of the connectors enables mutual separations of the sheet path and the connection of the connectors in such situation.

If the sheet path is perpendicular to the connecting direction of the connectors, the sheet has to be moved in a direction of a thickness of the sheet for separating the printer 101 in the connecting direction of the connectors, whereby the sheet may be broken or the broken sheet may remain in the apparatus. Furthermore, if the sheet is thick enough and cannot be easily broken, the separation itself of the printer 101 becomes impossible.

However, in the configuration of the present embodiment in which the sheet path is substantially parallel to the connecting direction of the connectors, the printer 101 can be separated in the case of a sheet jamming by a movement along the sheet, whereby the sheet jamming can be extremely easily handled without the sheet breaking or without a broken sheet remaining in the apparatus.

Below there will be explained the method of guiding the conveyed sheet (method of positioning the sheet in the transverse direction thereof).

In the present embodiment, as the ASF 1 is so constructed as to be detachably mountable on the sheet feeding port of the printer 101, there can be achieved both:

sheet feeding without the ASF 1; and automatic feeding of sheets in succession with the mounted ASF 1.

Thus, there can be enabled both the manual insert sheet feeding and the automatic sheet feeding, and the apparatus can be made more compact in comparison with a configuration having a manual insert sheet feeding port and an automatic sheet feeding port separately.

The printer 101 is provided, as shown in FIG. 5, with a sheet feeding tray 116, which is pivotably supported at an end thereof and is rendered openable and closable. The sheet feeding tray 116 constitutes the sheet path and stabilizes the sheet feeding operation, in case of sheet feeding in manual insertion without the mounting of the ASF 1. The sheet feeding tray 116 (or sheet path) is supported substantially horizontally in case of the manual insert sheet feeding.

At one end of the upper face of the sheet feeding tray 116, there is perpendicularly formed a reference guide (third guide member) 116*a* parallel to the edge thereof, and, at the other end of the upper face, there is provided a right edge guide 122 which is slidably movable in the transverse direction of the sheet. These guides 116*a*, 122 guide both lateral edges of the manually inserted and fed sheet. These guides 116*a*, 122 have a substantially same shape (seen in the transverse direction of the sheet).

On the other hand, the ASF 1 is provided, as shown in FIG. 4, with a reference guide accommodating portion 36*b*, formed by a reference guide guiding portion 36*c* positioned thereabove. When the printer 101 is pressed into the ASF 1, the reference guide 116*a* of the printer is pressed downwards by the guiding portion 36*c* and is rotated further downwards, and is accommodated, together with the right edge guide 122, in the accommodating portion 36*b*. Above the reference guide accommodating portion 36*b*, there is formed a sheet path for automatic sheet feeding so as to make a detour to avoid the reference guide (third guide member) 116*a*. In the present embodiment, as the sheet feeding tray 116 is accommodated, in a downward rotated state, in the reference guide accommodating portion 36*b*, the sheet path on the automatic sheet feeding can be formed horizontally (particularly in the vicinity of the accommodating portion 36*b*), like the sheet path on the manual insert sheet feeding, there avoiding drawbacks (such as a backward tension on the sheet) resulting from an unnaturally shaped sheet path. The reference guide accommodating portion 36*b* is so formed as to accommodate the right edge guide 122 in any sliding position. On the automatic sheet feeding, a lateral edge of the sheet in the transverse direction thereof is guided by a sheet reference guide (second guide member) 26*b* of the ASF.

If the sheet automatically fed by the ASF 1 is guided both by the guide 26*b* of the ASF and the guide 116*a* of the printer, and if the guide 116*a* of the printer is eventually positioned at the inner side of the sheet than the guide 26*b* of the ASF because of the dimensional tolerance in the manufacture, the guide 116*a* of the printer constitutes an obstacle for the automatically fed sheet, resulting in skewed sheet advancement, damage to the sheet end or sheet jamming.

However, the present embodiment can avoid such drawbacks since the sheet automatically fed by the ASF 1 is guided solely by the guide 26*b* of the ASF.

Also, it is not necessary to precisely form the guide 26*b* of the ASF and the guide 116*a* of the printer or to employ precisely formed parts therefor in order to avoid such drawbacks, so that there can be avoided an increase in the cost resulting therefrom.

Furthermore, even if the sheet is somewhat skewed, the sheet can be protected from interference with the guide 116*a* of the printer, whereby skewed sheet advancement, damage to the sheet end or sheet jamming resulting from such interference can be avoided.

In the printer, the sheet is guided by the guide (third guide member) 116*a* of the sheet feeding tray 116, but it is also possible to provide the interior of the printer with a similar guide (first guide member 124) in a same position in the transverse direction of the sheet to guide a lateral edge of the manually inserted and fed sheet 200 with the guide 116*a* on the sheet feeding tray and such internal guide. The skewed sheet advancement can be further prevented by defining the sheet conveying direction with a longer section along the sheet conveying direction.

Figure 7:
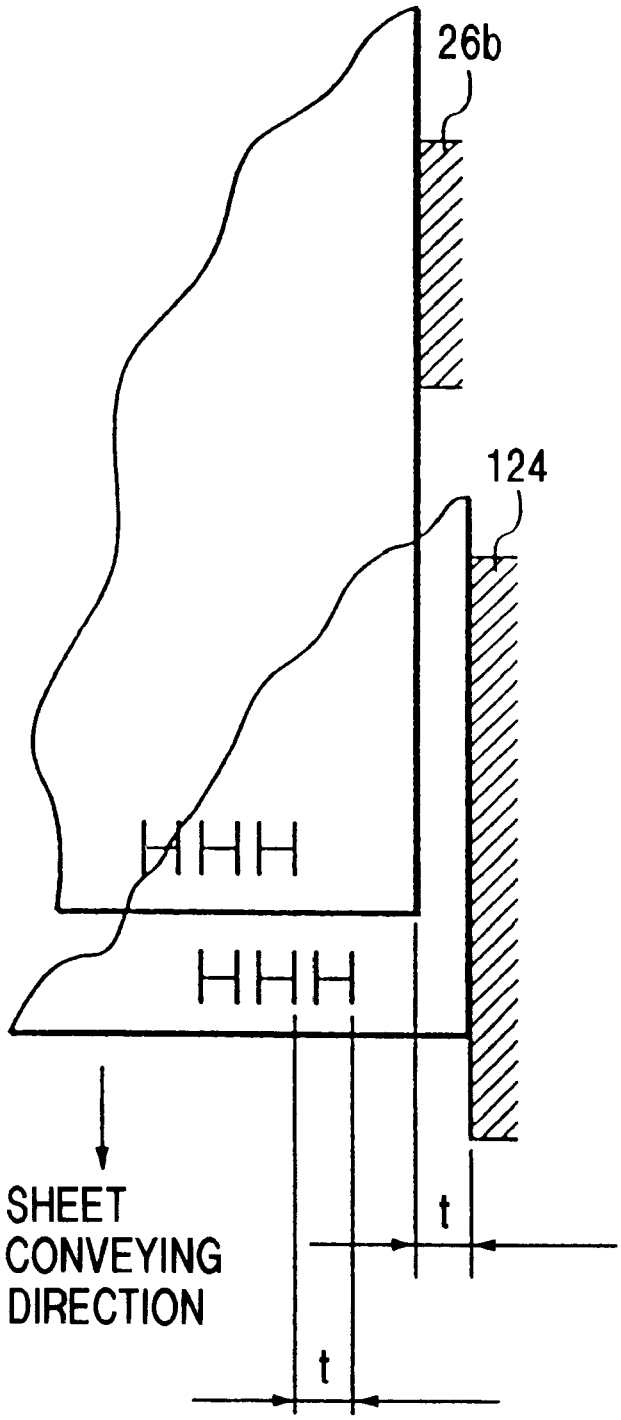
FIG. 7 is a schematic plan view showing an embodiment of the present invention.

In the case the guide (first guide member 124) is provided in the interior of the printer, the sheet reference guide (second guide member) 26*b* of the ASF can be formed, as shown in FIG. 7, at a position displaced, by a predetermined amount t, toward the inner side of the sheet (namely toward the recording position by the head). Thus, in case of automatic sheet feeding, the sheet can be prevented from interference with the internal guide of the printer, whereby skewed sheet advancement, damage to the sheet end or sheet jamming resulting from such interference can be avoided. The displacement amount t is determined to be equal to or more than the positioning tolerance between the printer 101 and the ASF 1 in the transverse direction of the sheet. In consideration of eventual skewed sheet feeding from the ASF, the displacement amount t may be, for example, about 0.6 mm.

Furthermore, in the case the guide of the ASF is displaced by t from that of the printer as explained above, the image recording position on the sheet in the transverse direction of the sheet in the case of sheet feeding by the ASF 1 (namely in case of automatic sheet feeding) may be displaced by an amount approximately equal to t (amount of displacement between the first and second guide members), in comparison with a case where the sheet feeding is not executed by the ASF 1 (namely in case of sheet feeding in manual insert). In this manner, the image is recorded in the same position regardless of the automatic or manual insert sheet feeding, thereby avoiding a drawback resulting from the difference in the image recording position (for example difference in the image recording position on a pre-printed sheet).

In the case the recording position is automatically displaced according to whether the sheet feeding is executed or not by the ASF, there may be provided mode discrimination means for discriminating whether the sheet feeding is executed by the ASF 1, and the recording position may be displaced according to the result of discrimination by the mode discrimination means. Such mode discrimination means can be composed, for example, of:

- means for electrically detecting the connection state of the printer connector 117 and the ASF connector 44; or
- a switch or a sensor provided on the printer for exclusively detecting the presence or absence of the ASF 1 (namely detecting the automatic/manual insert sheet feeding).

The amount of displacement between the guides of the ASF and of the printer and the amount of displacement in the recording position between the automatic and manual insert sheet feedings need not be exactly same, but have to be selected same in such a level that an ordinary person observes that "the image is recorded in a same recording position regardless whether the sheet is automatically fed or manually inserted and fed".

Below there will be explained an ASF sheet feeding tray 2 for supporting the stacked sheets.

Figure 8:
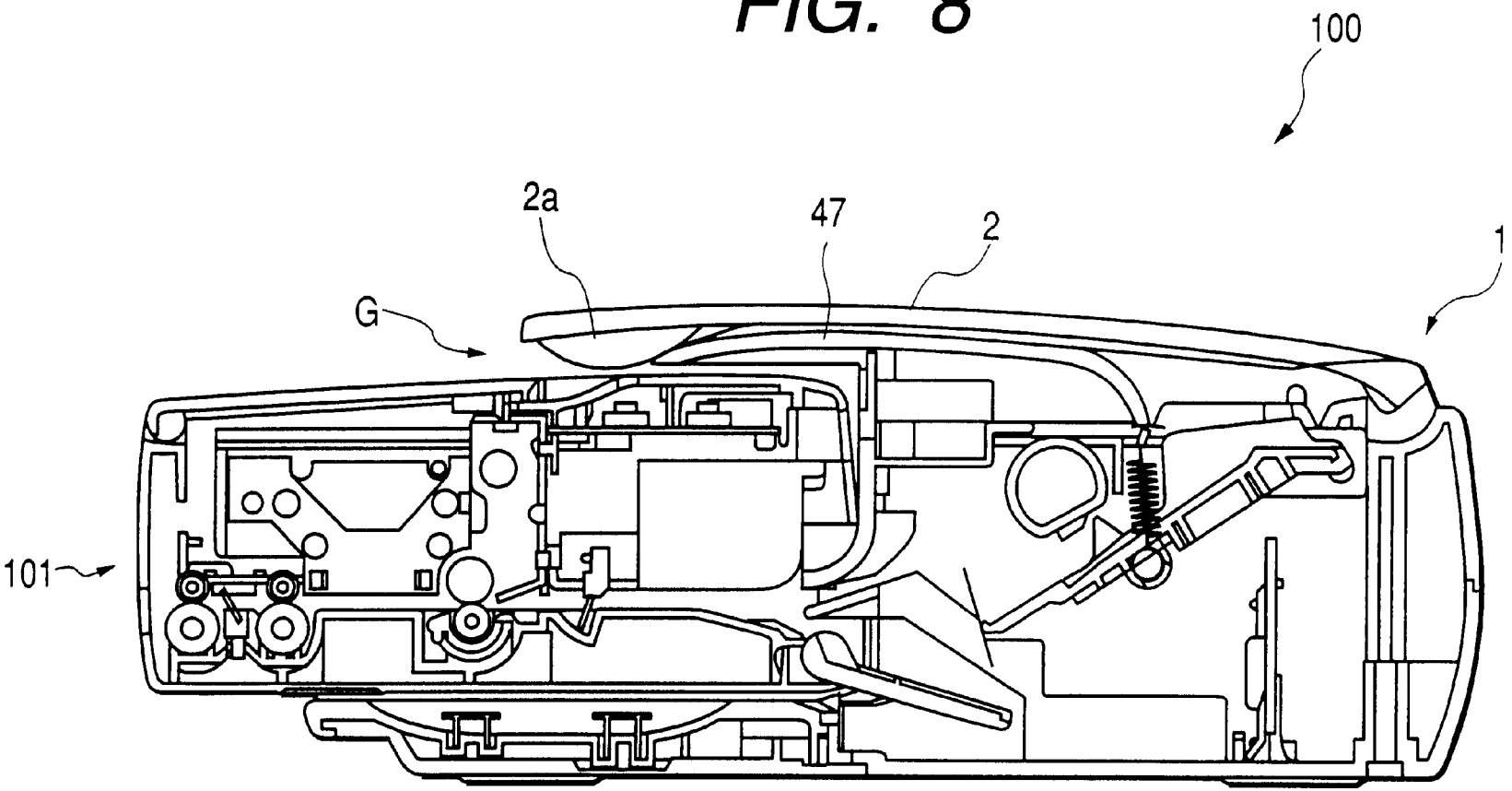
FIG. 8 is a cross-sectional view showing an embodiment of the present invention.

As shown in FIGS. 1 to 4, the ASF sheet feeding tray 2 is supported at an end thereof by the upper case 47 of the ASF and is rendered rotatable about the supporting portion. Thus, the ASF sheet feeding tray 2 is opened with a predetermined angle when supporting sheets and can be closed, as shown in FIG. 8, in the absence of the stacked sheets thereon.

Such configuration is not for using the mobile printer 101 as the desk-top printer in combination with the ASF 1 but indicates that the printer 101 is very compact and portable even in a state mounted in the ASF 1.

In order to enable such use, the ASF sheet feeding tray 2 needs to be closed, as far as possible in a form along the external form of the ASF 1 mounted with the printer. For this reason, the ASF sheet feeding tray 2 is composed of a thin plate.

Figure 9:
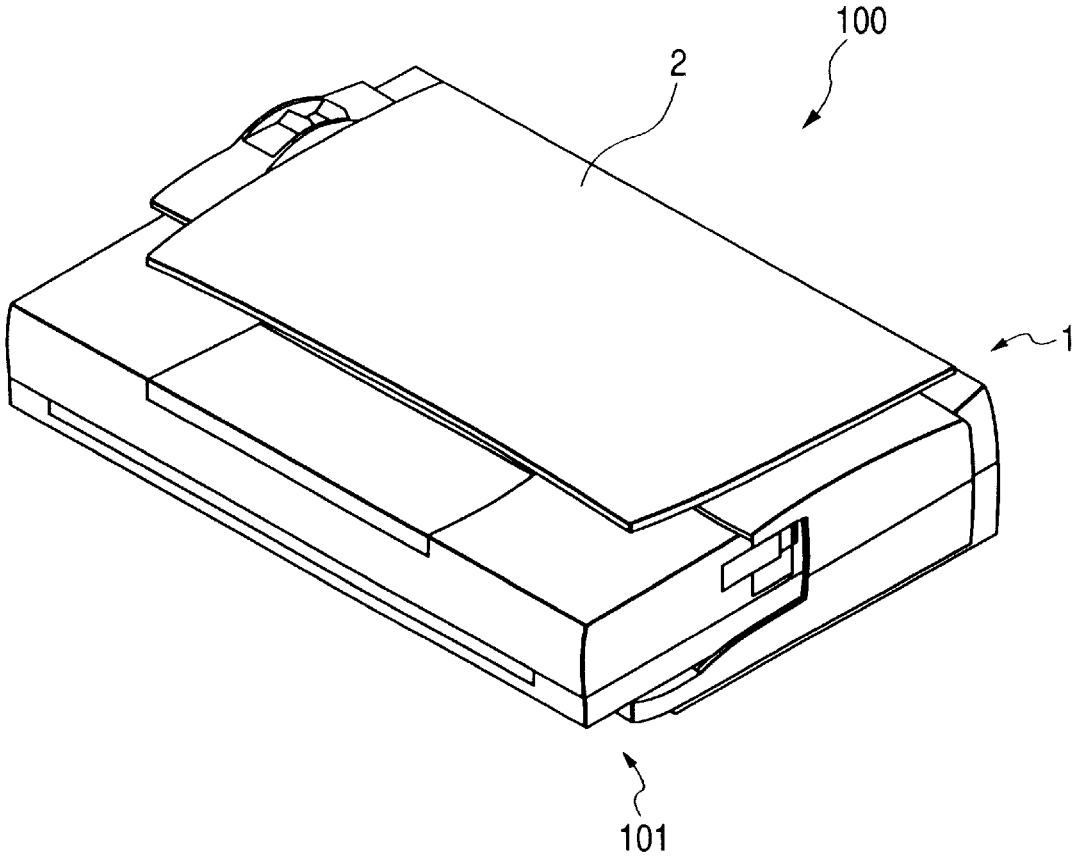
FIGS. 9 and 10 are perspective views showing embodiments of the present invention.

Also in the present embodiment, the sheet feeding tray 2 is so shaped as to cover, in the closed state, the operation unit of the printer 101 as shown in FIG. 9, in order to prevent the function of the printer 101 caused by an unexpected manipulation of the operation unit when the ASF 1 is carried with the closed sheet feeding tray 2 and with the printer 101 mounted therein. Furthermore, the sheet feeding tray 2 preferably engages with an arbitrary portion of the upper case 47 of the ASF 1, in order to prevent unexpected opening of the tray 2 when the ASF is carried.

Figure 10:
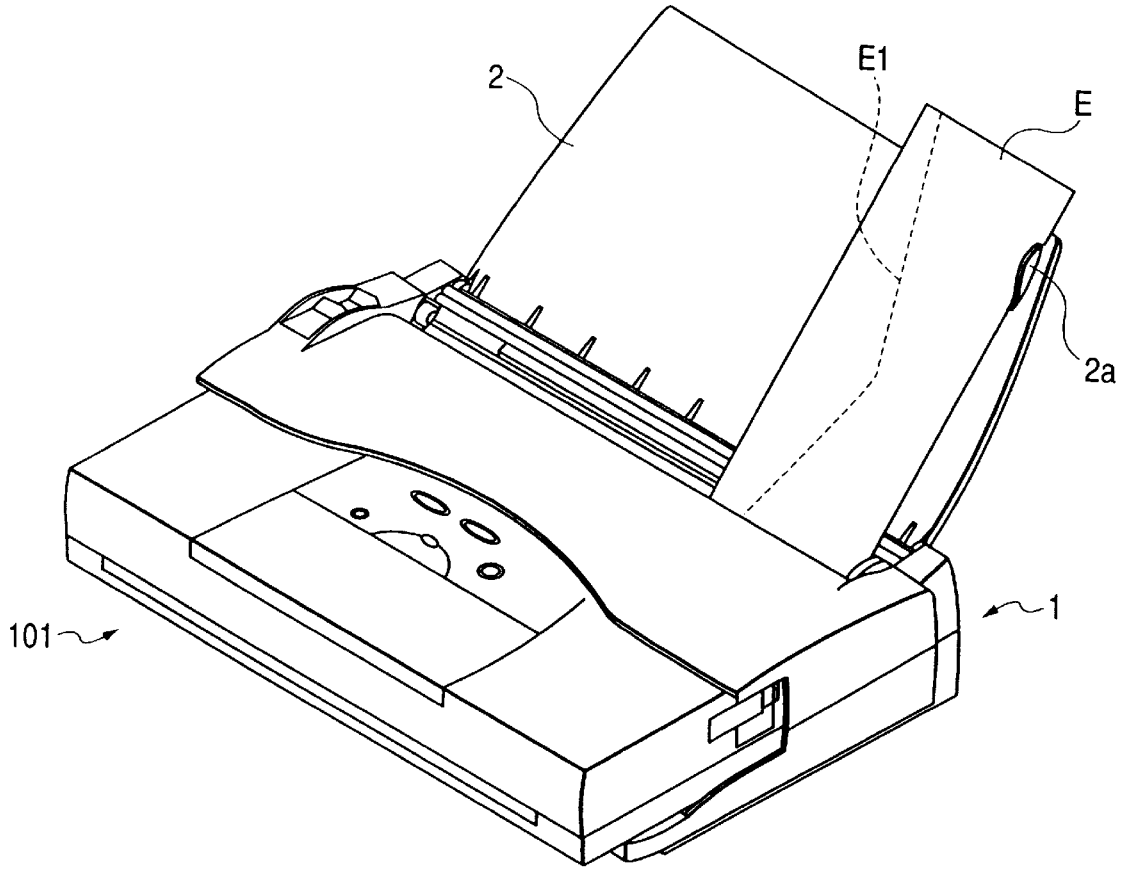

On the other hand, in case of feeding an envelope E in the longitudinal position as shown in FIG. 10, the tab E1 of the envelope E is usually positioned at the left hand side, and the ASF 1 of the present embodiment receives a strong resistance at the tab side (left side) for example by the swelling of the tab portion by moisture, whereby the envelope E receives a clockwise rotating force.

In the present embodiment, in order to prevent such clockwise rotation of the envelope E, the ASF sheet feeding tray 2 is provided, at an upstream position in the sheet feeding direction, with an ASF sheet feeding tray side guide 2*a* (hereinafter simply referred to as side guide). Thus, when the envelope E is set in the longitudinally oblong position on the ASF 1, a right edge of a trailing end of the envelope lies along the side guide 2*a* and is prevented from the clockwise rotation.

The envelope in the longitudinally oblong position is subjected to a resistance of the tab portion E1 at the timing of feeding the envelope E, particularly in the present embodiment when the envelope E proceeds over the bank sheet 37 and when a leading end of the envelope E is lifted immediately thereafter along the inclined surface of the bank 36. After these situations the resistance of the envelope tab E1 becomes smaller so that the clockwise rotation is not generated even without the side guide 2*a*.

For these reasons, in the present embodiment, the side guide 2*a* is provided in a part in the vicinity of a trailing end of the envelope E for preventing the clockwise rotation of the envelope E, but not in the entire longitudinal range of the envelope. The side guide 2*a* is so shaped, when the ASF sheet feeding tray 2 is closed, as to be accommodated in a step difference G formed between the upper case 47 of the ASF and the printer 101 (cf. FIG. 8), whereby, when the sheet feeding tray 2 is closed, the side guide 2*a* does not interfere with other portions and the portability is not deteriorated as the sheet feeding tray 2 can be accommodated in a form matching the external shape of the ASF.

The side guide 2*a* can be effective if the height thereof is equal to or more than the thickness of the stacked sheets such as the envelopes, and a step difference at least equal to the thickness of the stacked sheets is formed between the upper case 47 of the ASF and the printer 101.

Furthermore, the configuration of the present embodiment is effective for preventing not only the clockwise rotation of the envelope in the longitudinal feeding but also eventual clockwise rotation of any other sheet of a length comparable to that of the envelope, caused by any reason. The side guide 2*a*, being integral with the ASF sheet feeding tray 2, can also be very inexpensive in cost. The side guide 2*a* may also be so formed as to be accommodated, in the closed state, in a recess formed in the printer 101 or the ASF 1, instead of the step difference G mentioned above.

Below there will be explained a mounting and dismounting mechanism of the ASF 1 and the printer 101.

Figure 12:
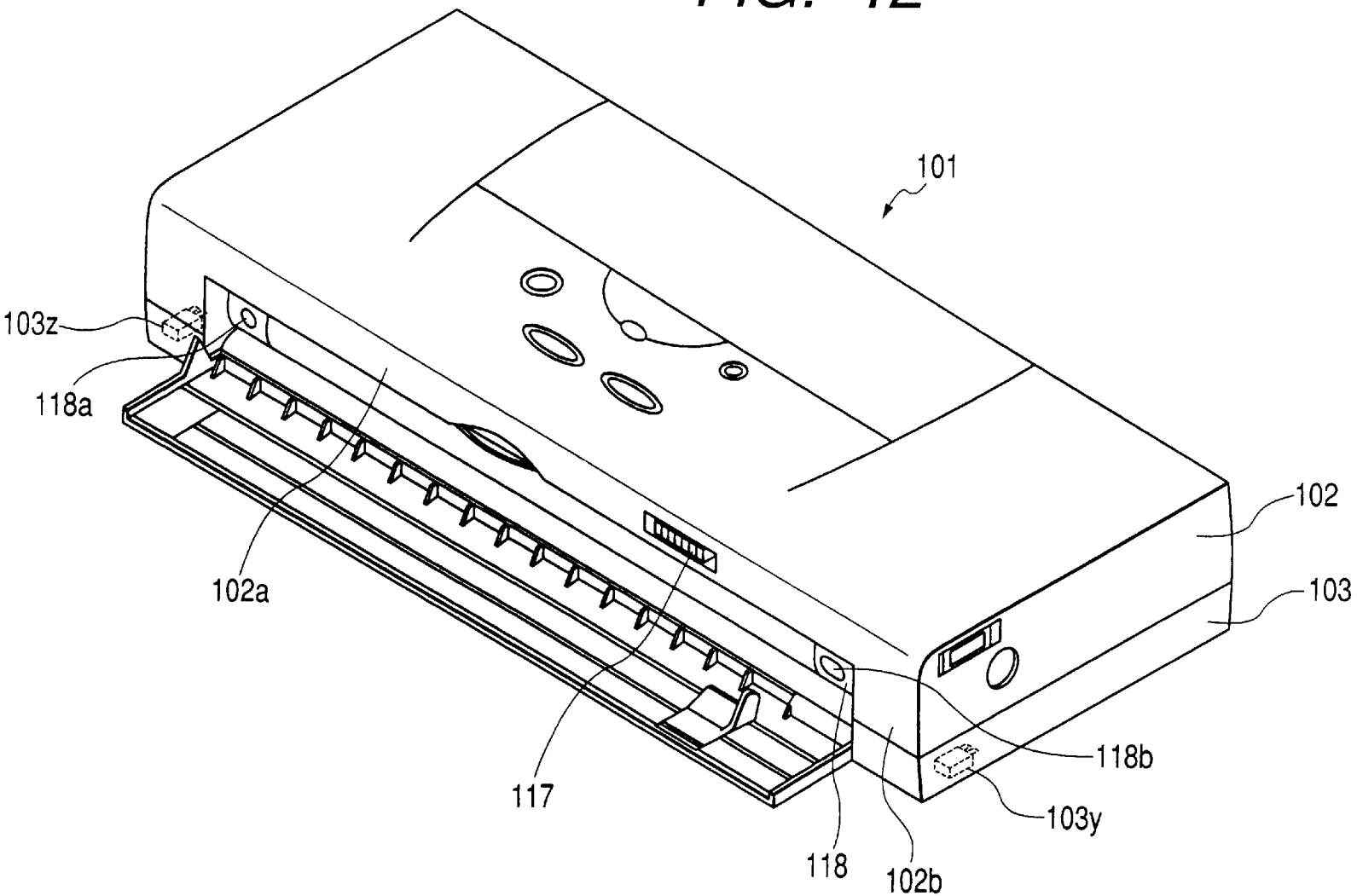
FIG. 12 is a perspective view showing an arrangement of parts, associated with the mounting and dismounting mechanism of the ASF, of a printer to be connected with the ASF of the present invention.
Figure 13:
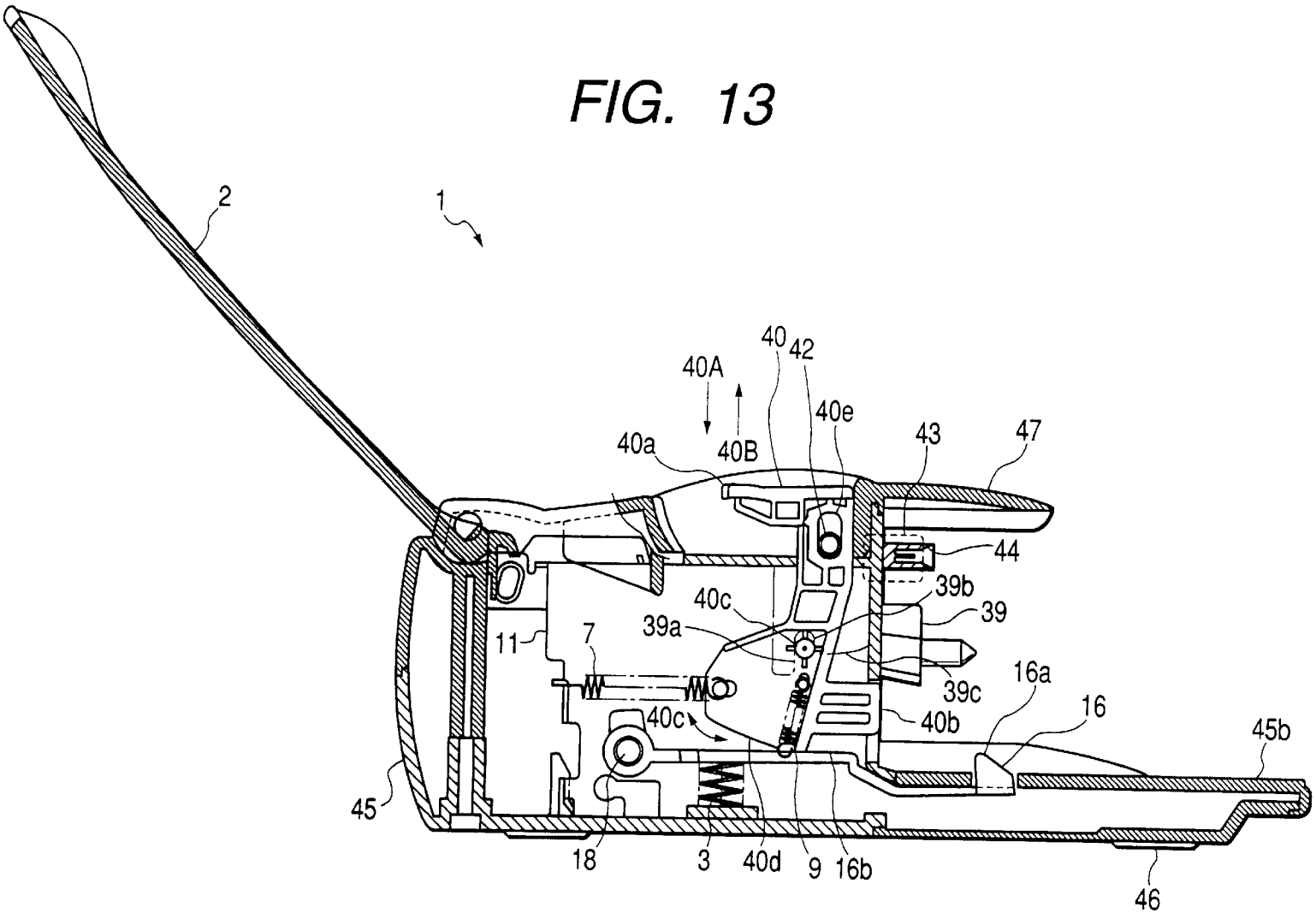
FIGS. 13, 14, 15, 16, 17 and 18 are cross-sectional views seen from the left hand side and showing the mounting and dismounting mechanism of the printer and the ASF of the present invention.

FIG. 11 is a perspective view showing the mounting and dismounting mechanism of the ASF 1; FIG. 12 is a perspective view showing the mounting and dismounting mechanism of the printer 101; and FIG. 13 is a cross-sectional view showing the mounting and dismounting mechanism of the ASF 1.

As shown in FIG. 11, the ASF 1 is provided with a positioning base 39 which is provided with two positioning bosses 39*d*, 39*e*. On the other hand, the printer 101 is provided, as shown in FIG. 12, with a board holder 118 so positioned as to oppose to the positioning base 39 and provided with a positioning hole 118*a* opposed to a first positioning boss 39*d* and a positioning oblong hole 118*b* opposed to a second positioning boss 39*e*. In connecting the printer 101 with the ASF 1, before the connection is made between the ASF connector 44 and the printer connector 117, the bosses 39*d*, 39*e* are fitted with the positioning holes 118*a*, 118*b* (oblong hole) to define the relative position of the printer 101 and the ASF 1 in the x and z directions. Thus the ASF connector 44 and the printer connector 117 can be exactly connected without damage by the misalignment of the connectors. Also, the sheet path of the ASF 1 can be exactly connected with the sheet path in the printer 101.

On the other hand, the ASF 1 is provided, as shown in FIG. 11, with a horizontal printer sliding portion 45*b* for defining the moving direction of the printer 101 on the connecting operation. Also, there are provided hooks 16, 17 (more exactly hook claws 16*a*, 17*a* of the hooks 16, 17) so as to be protrudable upwards from the printer slidable portion 45*b*. These hooks 16, 17 (in the following they are distinguished if necessary as a left hook 16 and a right hook 17) are both fixed on a hook shaft 18 as shown in FIG. 13 and are rotatably mounted on the chassis 11 so as to rotate integrally. Between the hook 16 and the ASF base 45, there is provided a hook spring 3, composed of a compressed coil spring, to bias the hooks 16, 17 upwards (namely in a direction that they engage with hook fixing holes 103*y*, 103*z* to be explained in the following).

On the other hand, the base 103 of the printer 101 is provided with, as shown in FIG. 12, hook fixing holes 103*y*, 103*z* in positions corresponding to the claws 16*a*, 17*a* of the hooks 16, 17 when the ASF 1 is mounted, and the engagement of the claws 16*a*, 17*a* with the fixing holes 103*y*, 103*z* defines the relative position of the ASF 1 and the printer 101 in the y direction.

On the other hand, on the positioning base 39 of the ASF, there is fixed, as shown in FIG. 13, a lever shaft 42 supporting a push lever 40 so as to be movable in directions 40A and 40B and rotatable in a direction 40C. Between the push lever 40 and the chassis 11 there is provided a push lever spring 7 for clockwise biasing the push lever 40. Between the push lever 40 and the left hook 16 there is provided a connecting spring 9 so as to maintain the upper face of the left hook 16 and the lower end 40*d* of the push lever 40 in constant contact (engagement).

Furthermore, the push lever 40 is provided with a boss 40*c* for limiting the rotation thereof, and the positioning base 39 is provided with slide faces 39*a*, 39*b*, 39*c* for impinging on the boss 40*c*. The slide faces 39*a*, 39*b*, 39*c* are represented by chain lines in order to clarify the configuration. In the above-described configuration, the rotation of the push lever 40 about the lever shaft 42 is limited by impingement of the boss 40*c* of the push lever 40 against the guide face 39*a*.

In the foregoing description, the hooks 16, 17 and the push lever 40 are provided on the ASF 1 while the hook fixing holes 103*y*, 103*z* are provided on the printer 101, but it is also possible to provide the printer 101 with the hooks and a push lever and the ASF 1 with the hook fixing holes. Also, there are provided two hooks 16, 17 and the corresponding fixing holes 103*y*, 103*z*, but such number is not restrictive and there may be provided three or more hooks and the corresponding fixing holes. Furthermore, the hooks 16, 17 do not need to be rotatable as explained in the foregoing but they only need to be displaceable. Furthermore, the hooks 16, 17 are so formed as to rotate integrally by fixing on the hook shaft 18, but it is also possible to press the hooks 16, 17 by the lever shaft 42 and to achieve integral rotation by such configuration.

Thereafter, popup members 43*a*, 43*b* provided on the ASF 1 press an upper part 102*a* of the printer 101 in the sheet feeding side thereof in a direction 43A (y direction) to release the connection between the connectors 117, 44. The popup members 43*a*, 43*b* are biased by an elastic member (not shown), in the direction 43A (y direction) and are rendered slidable in the y direction.

The biasing force for the popup members 43*a*, 43*b* is selected at a suitable level, because such biasing force, functioning as a repulsive force in mounting the printer 101 to the ASF 1, renders such mounting impossible if it is excessively strong (for example at a level with which the ASF 1 is not moved by the biasing force at the mounting of the printer 101 thereto).

However, the force required for detaching the connectors may exceed the biasing force of the popup members 43*a*, 43*b*, and, in such case, the connection between the connectors cannot be released solely by the popup members 43*a*, 43*b*. For this reason, in the present embodiment, a protruding portion 40*b* of the push lever 40 protrudes in the y direction by a movement of the push lever 40 in a direction of the arrow 40A.

The protruding portion 40*b* of the push lever 40 presses a lower (or central) portion 102*b* of the printer 101 at the sheet feeding side thereof, thereby releasing the connection between the connectors 44, 117. It is thus rendered possible, for the user, to easily extract the printer 101 in the y direction from the ASF 1.

Figure 14:
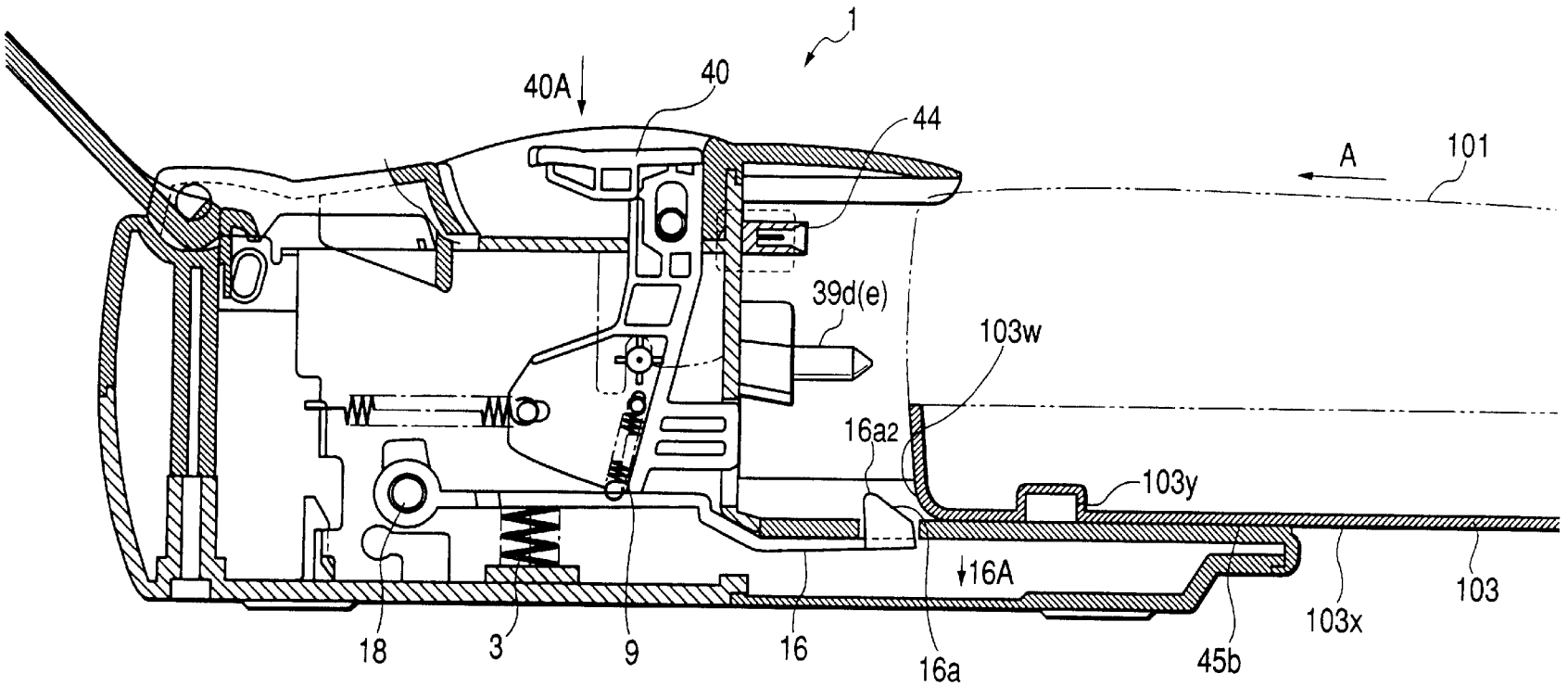
Figure 15:
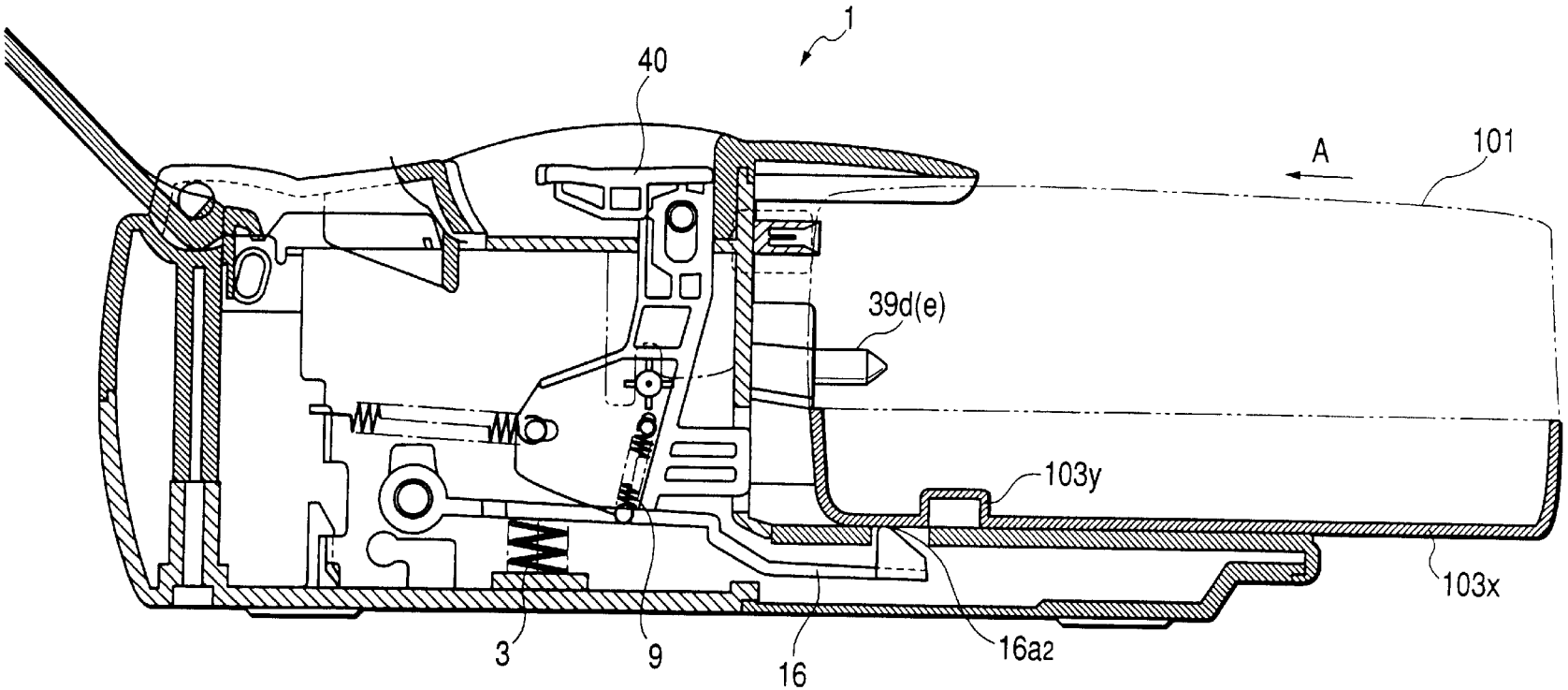
Figure 16:
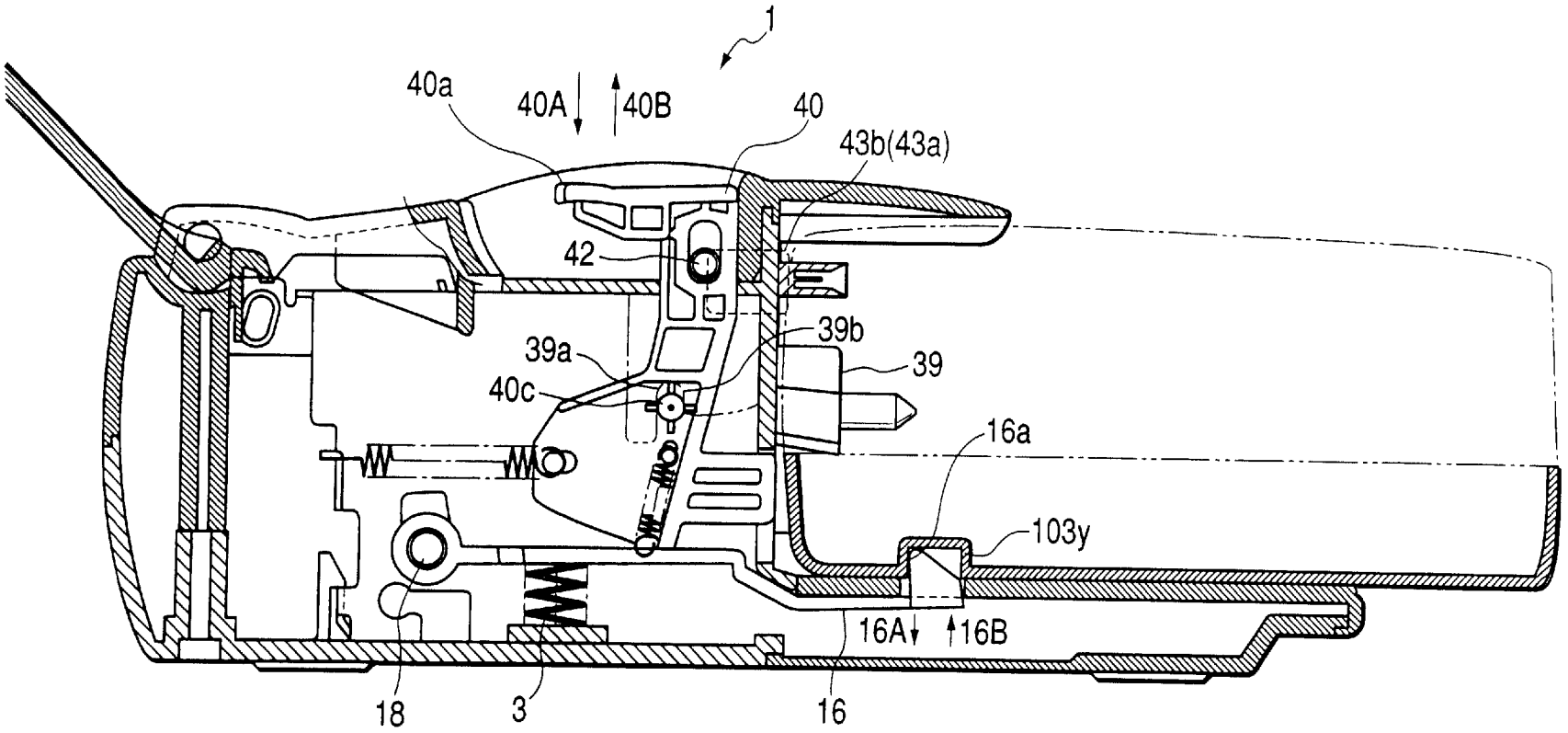

Now there will be explained, with reference to FIGS. 14 to 16, the operations in connecting the printer 101 and the ASF 1 and the functions of such operations. FIG. 14 is a view showing a state in which the printer 101 is rested on the printer sliding portion 45*b*; FIG. 15 is a view showing a state in which the printer 101 is pressed in; and FIG. 16 is a view showing a state in which the printer 101 is connected to the ASF 1.

At first referring to FIG. 14, as the printer 101 is pressed in a direction indicated by the arrow A along the printer sliding portion 45*b* of the ASF base 45, the hooks 16, 17 are rotated clockwise and the claws 16*a*, 17*a* are pressed downwards in a direction indicated by the arrow 16A (hook 17 and claw 17*a* being omitted in FIG. 15). In this operation, the push lever 40 is moved downwards through the connecting spring 9. The printer 101 is pressed further in this state and, the bosses 39*d*, 39*e* of the ASF engage with the positioning holes 118*a*, 118*b* (oblong hole) of the printer to define the relative position in the x and z directions. Thereafter, the ASF connector 44 and the printer connector 117 are mutually connected.

When the hook fixing holes 103*y*, 103*z* reach the positions of the claws 16*a*, 17*a*, they are moved counterclockwise (in a direction indicated by the arrow 16B) by the biasing force of the hook spring 3, whereby the fixing holes 103*y*, 103*z* respectively engage with the claws 16*a*, 17*a*. Also the push lever 40, already moved downwards, is pushed up to the normal position by the hook spring 3, through the hooks 16, 17. In this manner the connection between the printer 101 and the ASF 1 is completed. As the hooks 16, 17 are so constructed as to rotate integrally, they do not rotate unless both claws 16*a*, 17*a* match and engage with the fixing holes 103*y*, 103*z* and the push lever is not pushed up.

Consequently, for example if the printer 101 is mounted in an inclined state to the ASF 1, the push lever 40 is not pushed up to the normal position, and the user can easily know whether the printer 101 is properly mounted to the ASF 1, by observing the state of the push lever 40.

Furthermore, if the height of the claws 16*a*, 17*a* in a state engaging with the fixing holes 103*y*, 103*z* is selected substantially same as or somewhat higher than the height of the hook shaft 18 (constituting the rotary center of the hooks 16, 17), the hooks 16, 17 do not rotate under the application of a force in an opposite direction (or in a direction opposite to the direction indicated by the arrow A) to the printer 101, whereby the printer 101 can be protected from detachment from the ASF 1.

Below there will be explained the operations in separating the printer 101 and the ASF 1 and the functions of such operations.

Figure 17:
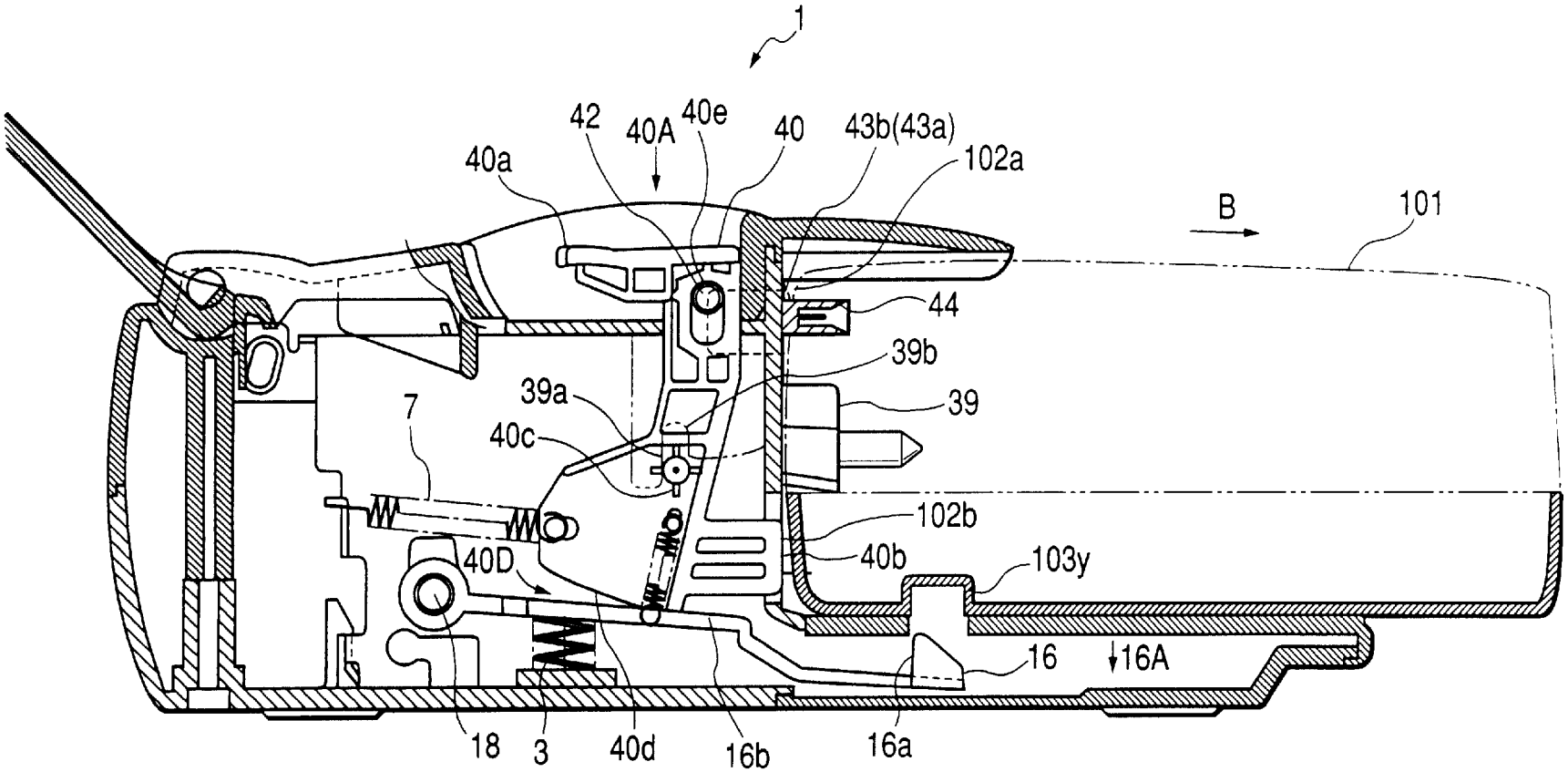

For separating the printer 101 and the ASF 1, a push portion 40*a* of the push lever 40 is pressed down (in the direction indicated by the arrow 40A) as shown in FIG. 17. The push lever 40, of which boss 40*c* is sandwiched between guide faces 39*a*, 39*b* formed on the positioning base 39, is incapable of rotation about the lever shaft 42 until the end of the guide face 39*b* and descends in the direction indicated by the arrow 40A. Thus, the hooks 16, 17 integrally rotate in a downward direction indicated by the arrow 16A about the hook shaft 18 whereby the claws 16*a*, 17*a* are disengaged from the fixing holes 103*y*, 103*z*. In the present embodiment, as the hooks 16, 17 are so constructed as to rotate integrally, the manipulation of the push lever 40 allows for simultaneous disengagement of both claws 16*a*, 17*a* thereby achieving a simple separating operation. Also, in disengaging the claws 16*a*, 17*a* from the fixing holes 103*y*, 103*z*, it is not necessary to unmovably hold the image forming apparatus 100 itself, and a simple separating operation is realized by merely depressing the push lever 40 with one hand.

When the claws are disengaged as explained above, the popup members 43*a*, 43*b*, shown by broken lines in FIGS. 16 and 17, push the upper portion 102*a* of the printer 101 in the sheet feeding side thereof, thereby pushing out the printer 101 in a direction indicated by the arrow B. At the same time, the ASF connector 44 and the printer connector 117 are mutually disengaged.

A state shown in FIG. 15 is reached when the user terminates the depression of the push lever 40 in the direction indicated by the arrow 40A. In this state, the connectors 44, 117 are disconnected and the hook 16 and the printer 101 are disengaged, whereby the user can easily remove the printer 101 from the ASF 1.

However, if the force required for disengaging the connectors exceeds the pushing force of the popup member 43*a*, 43*b* as explained in the foregoing, the state shown in FIG. 15 is not reached because the printer 101 does not move when the hook 16 is disengaged from the printer 101, so that the user cannot remove the printer 101 from the ASF 1.

Consequently, in the present embodiment, there is added the above-described pushing function by the user.

FIG. 17 shows a state in which the printer 101 does not move even after the hook 16 is disengaged from the printer 101. In this state, the (left) hook 16 is disengaged from the fixing hole 103*y* while the boss 40*c* of the push lever 40 is released from the limitation in the moving direction by the guide face 39*b* of the positioning base 39.

Also the lever shaft 42 is pressed to the upper end face of a sliding hole 40*e* of the push lever 40, thereby limiting the downward movement of the (left) hook 16. Furthermore, as a contact face 40*d* of the push lever 40 with the (left) hook 16 is formed as an arc around the lever shaft 42, the position of the (left) hook 16 does not change by the rotation of the push lever 40.

If the user continues to depress the push portion 40*a* of the push lever 40, it rotates in a direction indicated by the arrow 40D about the lever shaft 42, and such rotation brings the protruding portion 40*b* of the push lever 40 in contact with the lower portion 102*b* of the printer 101 in the sheet feeding side thereof while the (left) hook 16 is disengaged from the printer 101, whereby the printer 101 is pushed out in a direction indicated by the arrow B.

Figure 18:
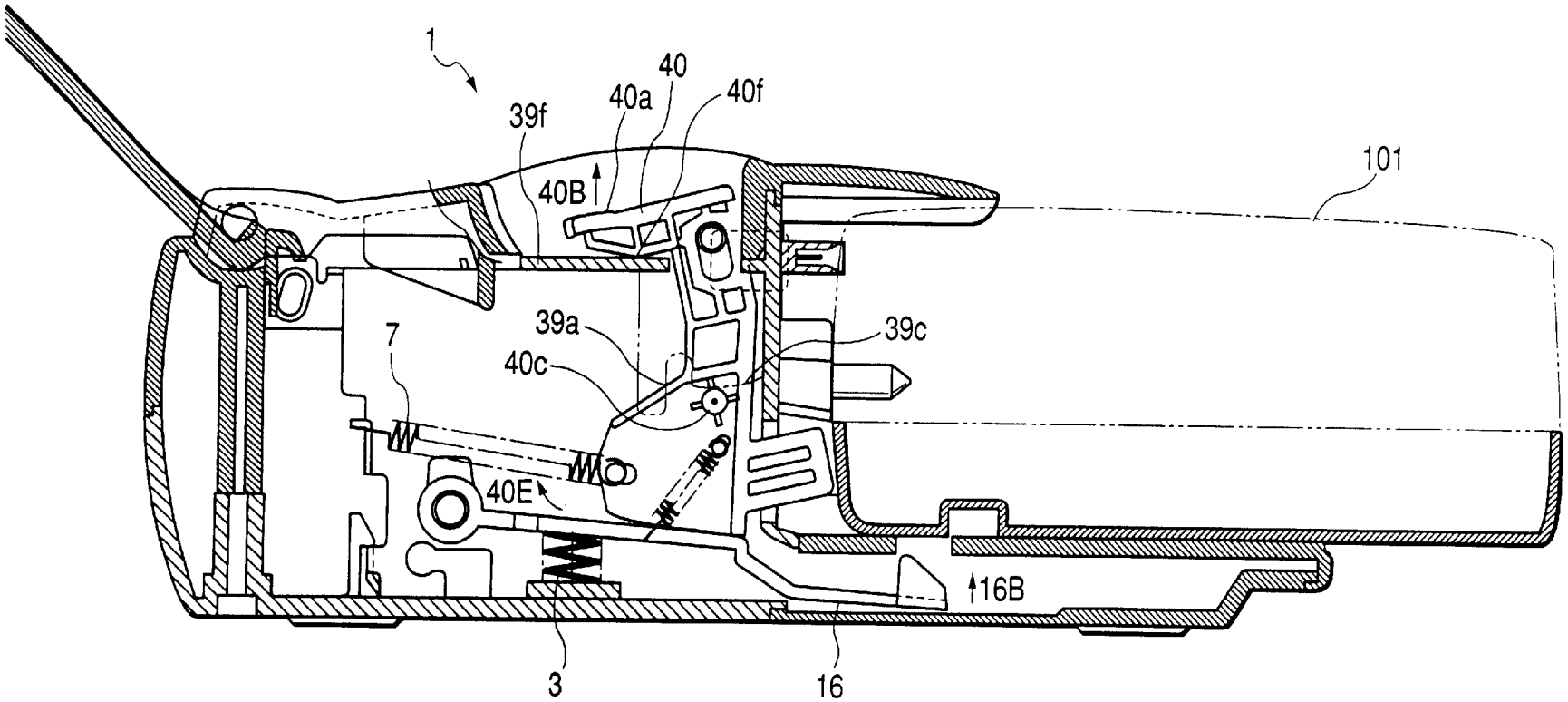

If the push lever 40 continues to be depressed thereafter, a contact face 40*f* of the push lever 40 impinges on a stopper portion 39*f* of the positioning base 39 as shown in FIG. 18, whereupon the rotation of the push lever 40 is limited. The push-out (shifting) amount of the printer 101 by the push lever 40 is so selected as to release the engagement between the (left) hook 16 and the printer 101 and the engagement between the connectors.

After the printer 101 is thus pushed out, the user terminates the depression of the push portion 40*a* of the push lever 40, whereupon the (left) hook 16 is elevated in a direction indicated by the arrow 16B by the function of the hook spring 3. At the same time the push lever 40 is pushed up by the (left) hook 16, whereby the boss 40*c* of the push lever 40 impinges on the guide face 39*c* of the positioning base 39 and the push lever 40 rotates thereafter in a direction indicated by the arrow 40E by the tension of the spring 7. When the boss 40*c* of the push lever 40 impinges on the guide face 39*a* of the positioning base 39, the push lever 40 is limited in rotation and is elevated in a direction indicated by the arrow 40B by the force of the hook spring 3.

Thus, the connectors are eventually disconnected as shown in FIG. 15, while the (left) hook 16 is disengaged from the printer 101, and the user can easily remove the printer 101 from the ASF 1.

In the present embodiment, as explained in the foregoing, the push lever 40 is depressed substantially vertically in detaching the printer 101 from the ASF 1, so that a vertical force is applied to the ASF itself. For this reason, the ASF 1 is not displaced when the printer 101 is pushed out substantially horizontally. Also, since the printer 101 is pushed out substantially horizontally, there will not result a failure in the detachment, caused by the movement of the printer 101 in the mounting direction by the weight thereof.

Figure 19:
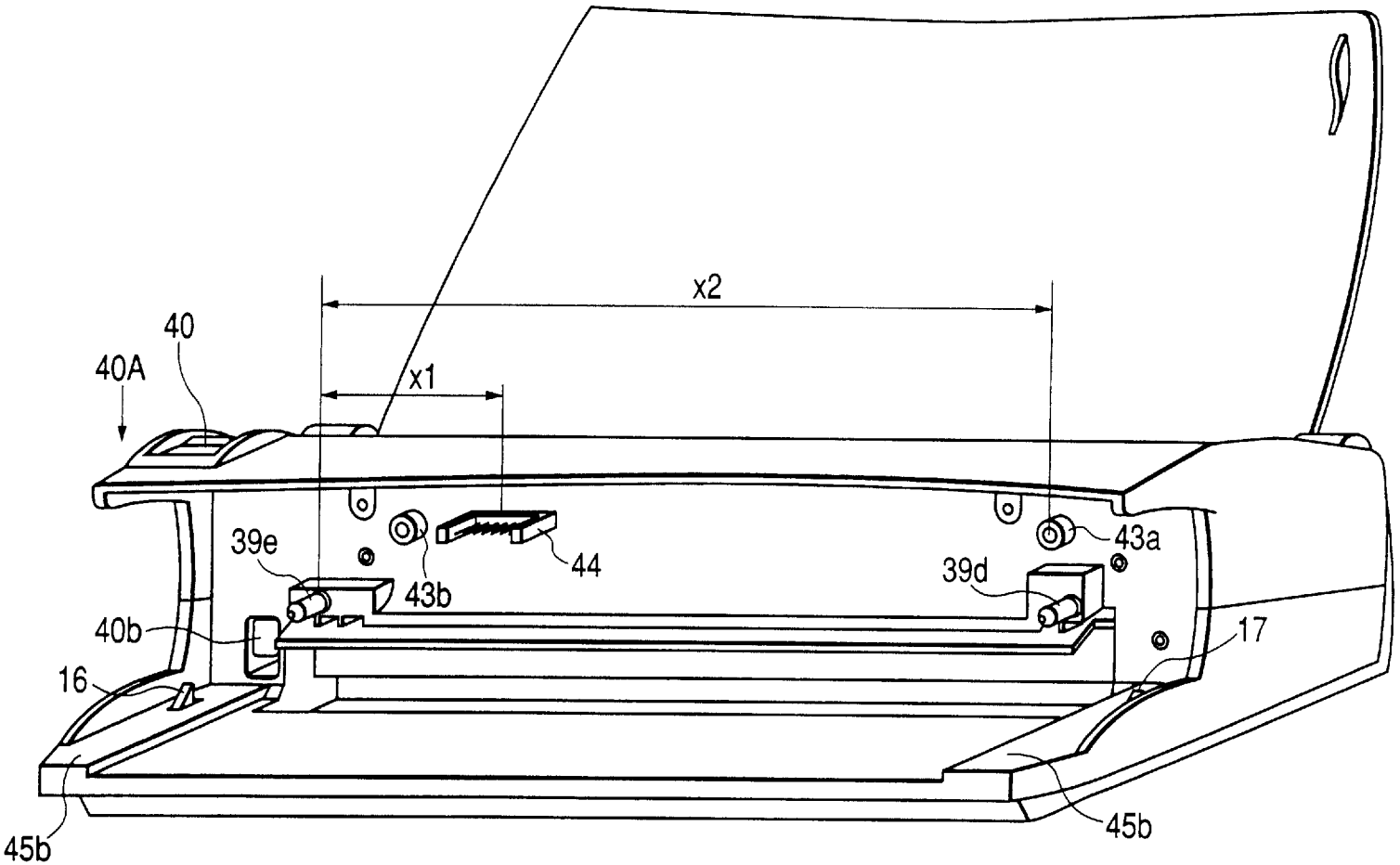
FIG. 19 is a perspective view showing the arrangement of parts and relationship of forces in symbols, relating to the mounting and dismounting mechanism of the printer and the ASF of the present invention.
Figure 20:
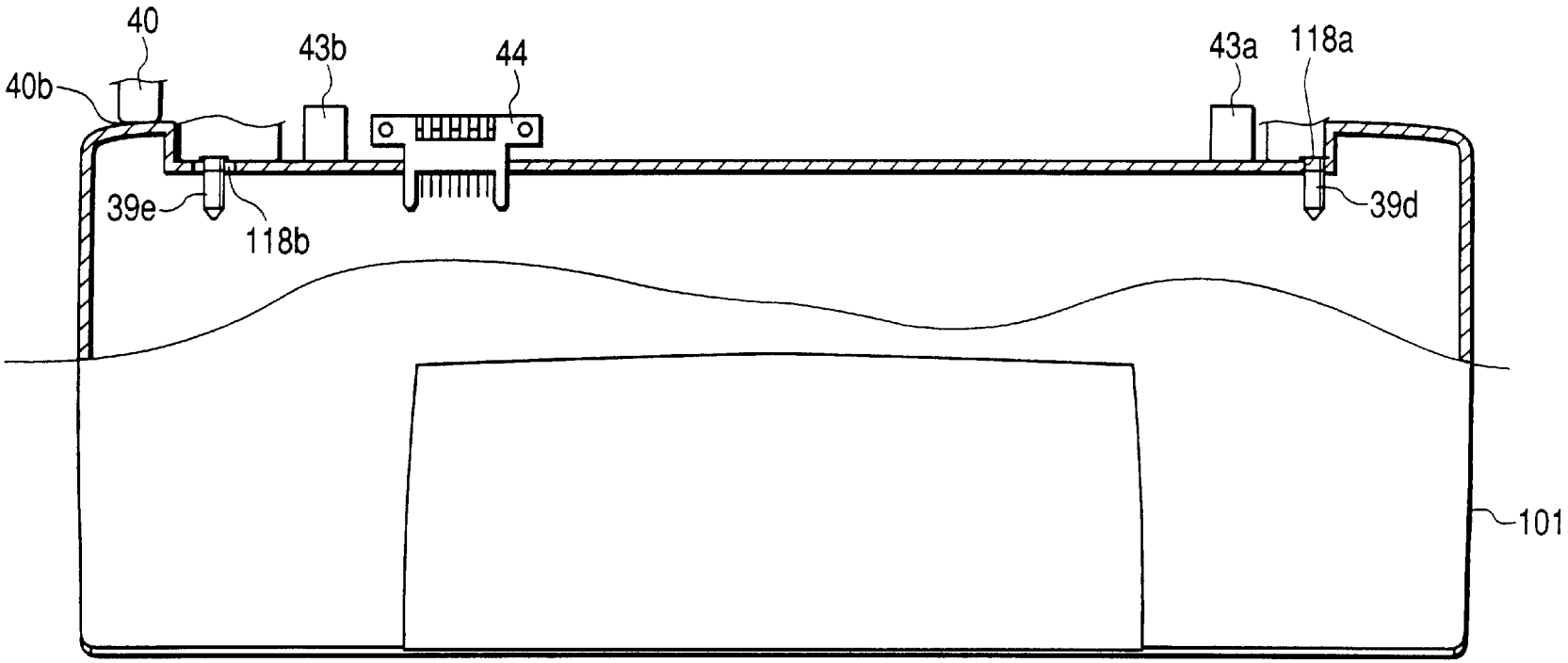
FIGS. 20, 21, 22 and 23 are plan views showing the mounting and dismounting mechanism of the printer and the ASF of the present invention.

FIG. 19 is a view showing the arrangement of the push lever 40, the popup members 43*a*, 43*b*, the positioning bosses 39*d*, 39*e*, the (left) hook 16, the (right) hook 17, and the ASF connector 44 and the relationship of forces thereof, and FIG. 20 is a partial cross-sectional view of the upper face of the ASF 1.

As shown in FIGS. 19 and 20, the positioning bosses 39*d*, 39*e* of the printer 101 and the hooks 16, 17 are provided in the vicinity of both ends of the printer 101 in the width thereof. The ASF connector 44 is positioned between the positioning bosses 39*d*, 39*e*, close to the second positioning boss 39*e*. The push lever 40 and the second popup member 43*b* are positioned farther, than the ASF connector 44, from the first positioning boss 39*d*.

In the above-described configuration, the detachment of the printer 101 from the ASF 1 is achieved by the depression of the push lever 40 in the direction indicated by the arrow 40A as explained in the foregoing, whereupon the hooks 16, 17 are disengaged from the fixing holes 103*y*, 103*z* (cf. FIG. 14) while the protruding portion 40*b* of the push lever 40 impinges on and pushes out the printer 101. In this manner there can be achieved disconnection of the connectors and disengagement of the hooks 16, 17 from the fixing holes 103*y*, 103*z*.

The popup members 43*a*, 43*b* are auxiliary members for reducing the force required for depressing the push lever 40 by the user, and are slidably biased, by an elastic member (not shown), at a predetermined position.

In the present embodiment, the printer 101 is pushed out, while sliding on the printer sliding portion 45*b* by rotation about the positioning boss 39*d* or 39*e*.

Figure 21:
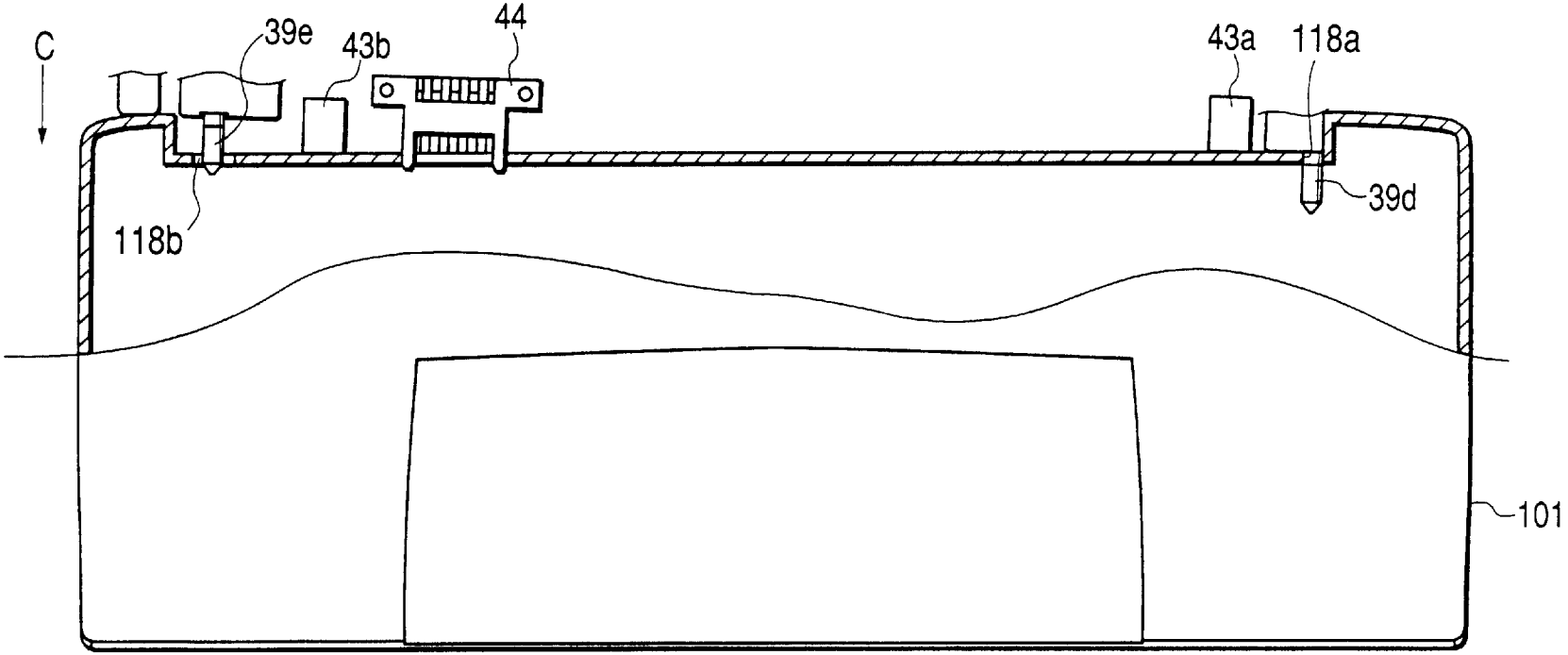

The positioning hole 118*a* at the side of the first positioning boss constituting the center of rotation is formed as a circular hole while the positioning hole 118*b* at the side of the second positioning boss is formed as an oblong hole (cf. FIG. 12), so that, in case of detaching the printer 101 from the ASF 1 by rotation about the first positioning boss 39*d* starting from the state shown in FIG. 20, there is reached a positional relationship between the printer 101 and the ASF 1 as shown in FIG. 21.

In such state, however, the printer 101 cannot be moved by the pushing force of the first popup member 43*a* alone, because of the sticking engagement between the first positioning boss 39*d* and the positioning hole 118*a*. Also, in case the user forcedly remove the printer 101 from the ASF 1, there may result deformation or destruction of the first positioning boss 39*d*.

Therefore, in order to avoid such sticking engagement, the present embodiment adopts a configuration in which, before the printer 101 is pushed out by the push lever 40 and the second popup member 43*b*, the engaging position between the first positioning boss 39*d*, constituting the center of rotation of the printer 101, and the positioning hole 118*a* is displaced toward the connector disengaging direction by the pushing force of the first popup member 43*a*.

More specifically, in the dimensional relationship shown in FIG. 19, the force required to push out the printer 101 by the pushing force of the first popup member 43*a* by rotation about the first positioning boss 39*d* is represented by:

$$F1 \geq (X1/X2) \times P1 + P2$$

wherein F1 is the printer pushing force of the first popup member 43*a*, P1 is the force required for detaching the connectors, P2 is the frictional force between the printer 101 and the printer sliding portion 45*b* of the ASF 1, X1 is the distance from the second positioning boss 39*e* constituting the center of rotation to the connector 44, and X2 is the distance from the second positioning boss 39*e* constituting the center of rotation to the first popup member 43*a*.

As will be apparent from the foregoing relation, the pushing force F1 of the first popup member 43*a* can be made smaller as the distance between the first popup member 43*a* and the ASF connector 44 becomes larger or as the ratio X1/X2 becomes smaller. In consideration of the aforementioned fact that the pushing force F1 of the first popup member 43*a* functions as a repulsive force in mounting the printer 101 to the ASF 1 and a fact that the force required for disconnecting the connectors is generally within a range of 1 to 2 kgf, the ratio X1/X2 is advantageously selected at 0.5 or smaller.

On the other hand, in the present embodiment, the claw of the (right) hook 17 is formed lower than that of the (left) hook 16, whereby the (right) hook 17 is disengaged from the fixing hole 103*z* (cf. FIG. 12) earlier than the disengagement of the (left) hook 16 from the fixing hole 103*y*.

Figure 22:
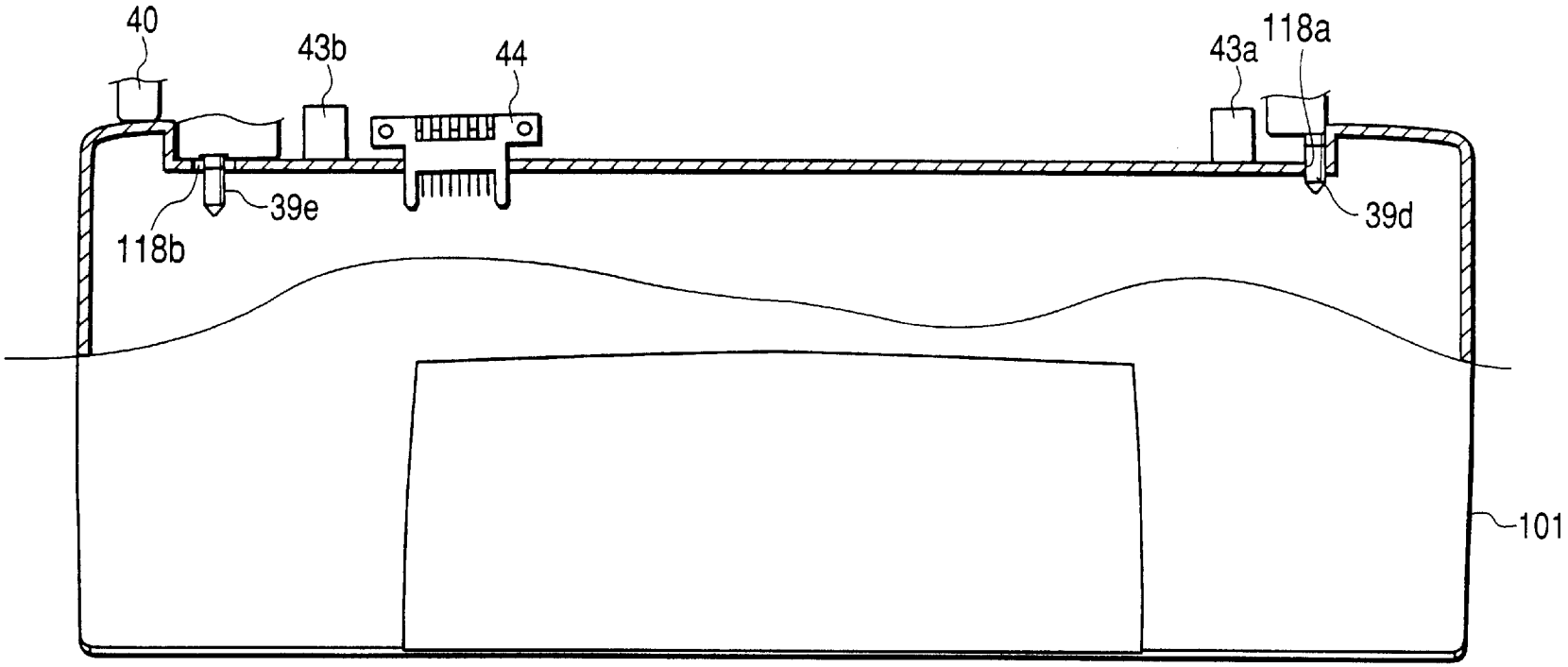

Therefore, at the moment when the (right) hook 17 is disengaged from the fixing hole 103*z* of the printer 101, the printer 101 rotates about the second positioning boss 39*e* by the pushing force of the first popup member 43*a*, whereby the engaging position between the first positioning boss 39*d* and the positioning hole 118*a* moves toward the connector disengaging side as shown in FIG. 22.

Figure 23:
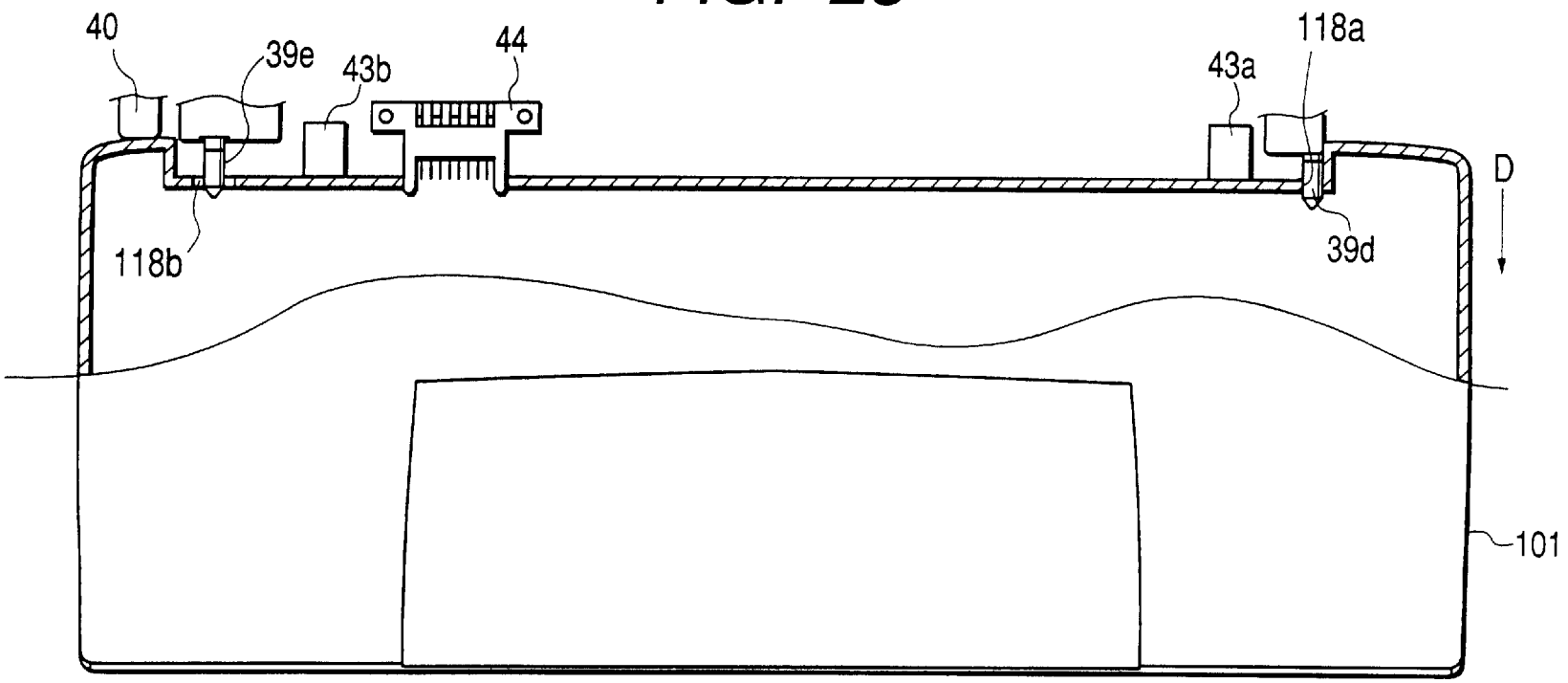

Subsequently the (left) hook 16 is disengaged from the fixing hole 103*y* of the printer 101 whereupon the printer 101 is pushed out by the push lever 40 and the second popup member 43*b*. Thus it is rendered possible to detach the printer 101 from the ASF 1 in a state shown in FIG. 23 without the sticking engagement between the first positioning boss 39*d* and the positioning hole 118*a*.

If the push lever 40 and the second popup member 43*b* are provided between the ASF connector 44 and the first positioning boss 39*d* constituting the center of rotation of the printer 101, and if the connectors has a large connecting force, the connector 44 becomes the center of rotation of the printer 101 whereby a sticking engagement is generated between the first positioning boss 39*d* and the circular positioning hole 118*a* of the printer 101, eventually resulting in deformation and/or destruction of the boss 39*d*.

Based on these facts, the push lever 40 and the second popup member 43*b* have to be positioned farther, than the ASF connector 44, from the first positioning boss 39*d* constituting the center of rotation of the printer 101.

[Control Unit]

Figure 24:
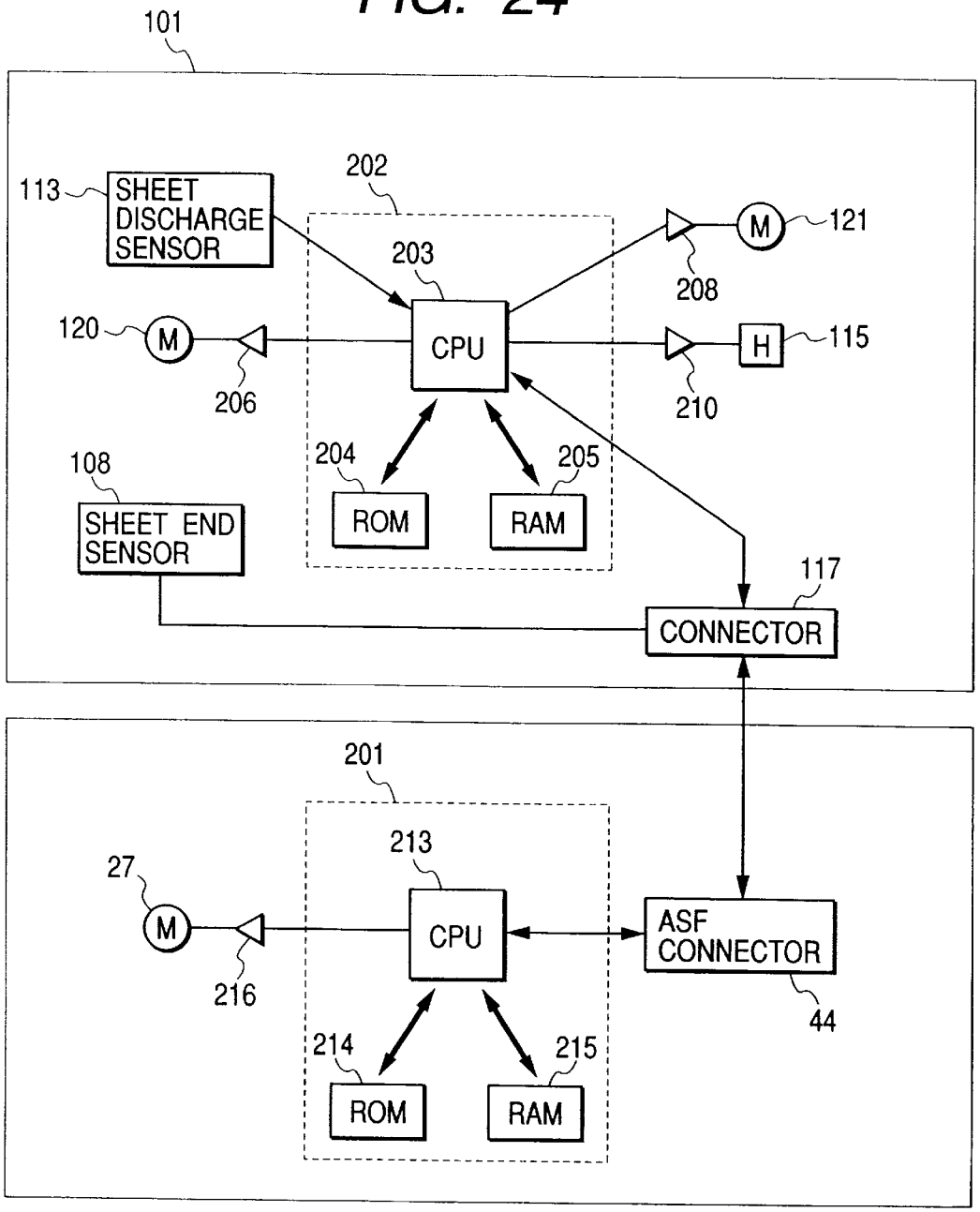
FIG. 24 is a block diagram showing a connection of a printer 101 and an ASF 1 of the present invention.

FIG. 24 is a block diagram of a main control unit for the printer and a control unit for the external ASF of the present invention.

A main control unit 202 for controlling the printer 101 is provided on a main body board 123 shown in FIG. 4, and is provided with a microcomputer in which a CPU 203, a ROM 204, and a RAM 205 are connected through buses.

In the recording operation by the printer 101, the main control unit 202 drives a carriage motor 121 through a motor driver 208 and also drives a recording head 115 mounted on a carriage (not shown) connected to the carriage motor 121 through a head driver 210 according to a main control program stored in the ROM 204, thereby effecting recording of a line.

Subsequently the main control unit 202 advances the sheet by driving a sheet feeding motor 120 through a motor driver 206, and then repeats the driving of the carriage motor 121 and the recording head 115, thereby completing the recording on the sheet. The connector 117 functions as a bothway communication port capable of transmitting command signals from the CPU 203 of the main control unit to the exterior and receiving response signals from the exterior into the CPU 203, and is also capable of power supply to the exterior as will be explained later. A sheet end sensor 108 is provided in the printer body and has an optical or mechanical switch. When the sheet 200 is inserted into the printer main body, the output voltage of the sheet end sensor 108 changes from a LOW state to a HIGH state. A sheet discharge sensor 113 similar in configuration to the sheet end sensor 108 outputs a voltage of a HIGH state if the sheet 200 after recording remains in the printer body.

The output voltages of the sheet end sensor 108 and the sheet discharge sensor 113 can be monitored by the CPU 203, and the output voltage of the sheet end sensor 108 can be directly outputted to the exterior through the connector 117.

The ASF control unit 201 for controlling an external ASF 1 is provided, as in the main control unit 202, with a microcomputer in which a CPU 213, a ROM 214 and a RAM 215 are connected through buses. The CPU 213 controls a sheet feeding motor 27 through a motor driver 216, based on an ASF control program stored in the ROM 214. The ASF connector 44 functions as a bothway communication port for receiving signals from external equipment such as the printer 101 and transmitting signals from the CPU 213 of the ASF control unit.

[Communication Port]

Figure 26:
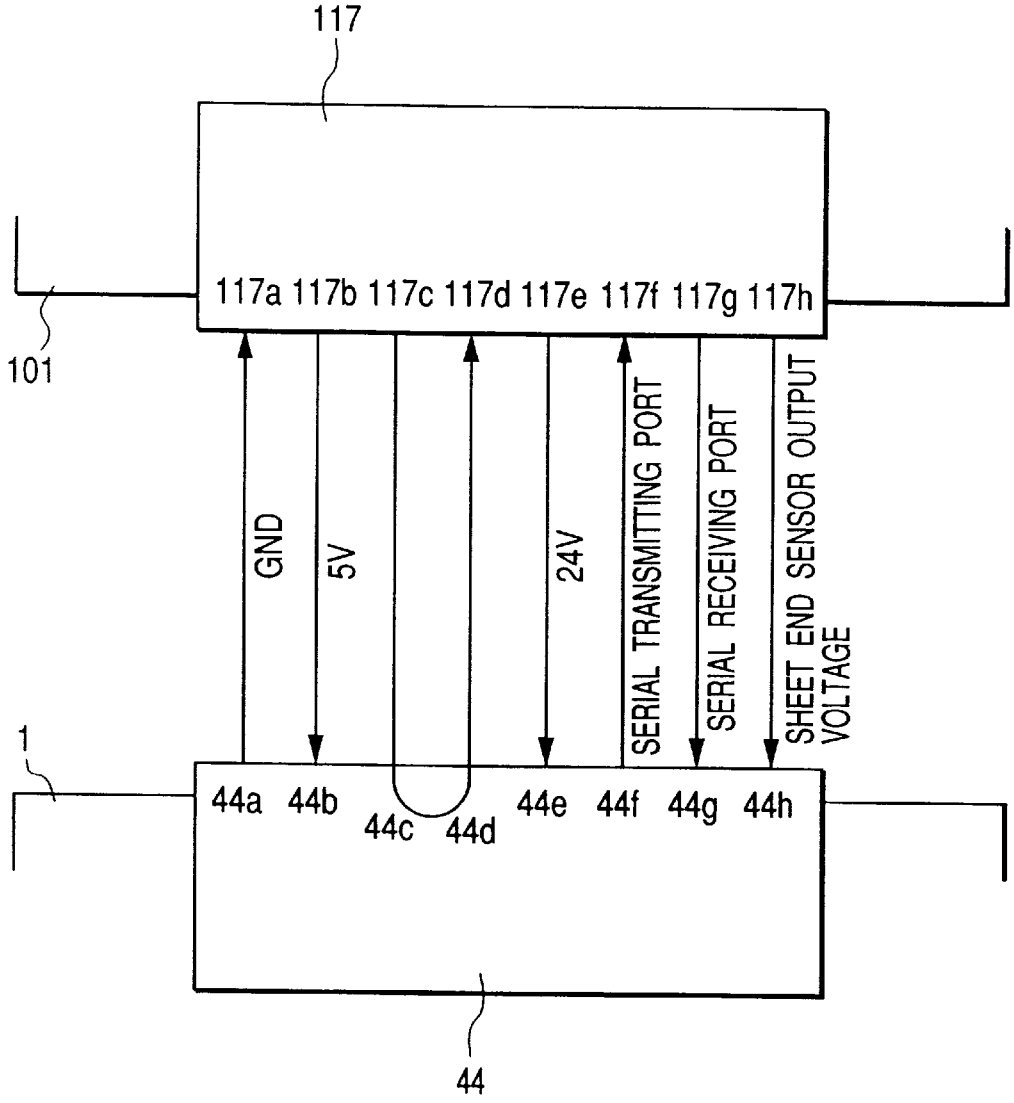
FIG. 26 is a schematic view showing the connection between a connector 117 and an ASF connector 44.

FIG. 26 is a schematic view showing the detailed configuration of the connector 117 and the ASF connector 44 mentioned above. The connector 117 and the ASF connector 44 are respectively provided with eight ports 117*a* to 117*h* and 44*a* to 44*h*, and ports having a same alphabetical suffix are mutually connected electrically when the printer 101 is mounted to the ASF 1.

In the ASF side, there are provided a ground (GND) line 44*a*; a 5 V power supply line 44*b* for signals; a 24 V power supply line 44*e* for driving the sheet feeding motor 27; a transmission port 44*f* for transmitting signals to the printer; a reception port 44*g* for receiving signals from the printer; and a line 44*h* for receiving the output voltage of the sheet end sensor 108 provided in the printer body. Ports 44*c* and 44*d* are mutually short circuited, whereby the printer 101 can easily identify, utilizing ports 117*c* and 117*d*, connection of an external equipment.

[Separating and Conveying Mechanisms of ASF]

Figure 25:
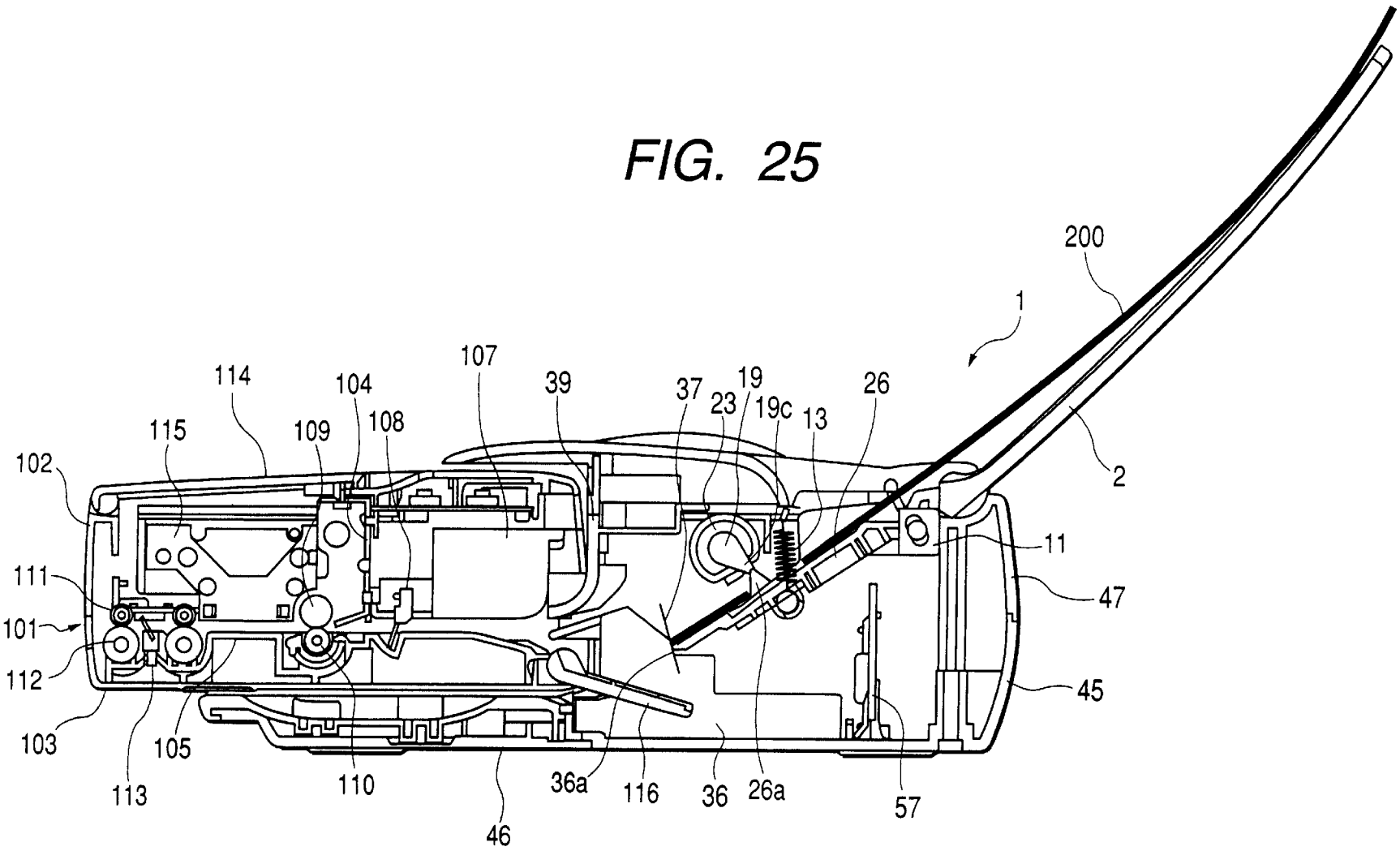
FIG. 25 is a schematic cross-sectional view showing the printer 101 and the ASF 1 of the present invention in a connected state.

FIG. 25 is a cross-sectional view showing a state in which the external ASF of the present invention is mounted on the printer body.

A sheet feeding roller 19 for feeding the sheet 200 is fitted with a sheet feeding rubber member 23, and, when the sheet feeding roller 19 is rotated, the sheet 200 is conveyed, by the frictional force of the sheet feeding rubber member 23.

A pressure plate 26 for supporting the stacked sheets 200 is pivotably supported by the ASF chassis 11 at the upstream end in the sheet conveying direction. The pressure plate 26 is biased toward the sheet feeding rubber member 23 by a pressure plate spring 13. But, in the initial state, the sheet feeding rubber member 23 and the pressure plate 26 are mutually separated because cam portions 19*c* provided on both ends of the sheet feeding roller 19 engage with cam portions 26*a* provided on both ends of the pressure plate 26, whereby the sheets 200 can be smoothly set. A bank 36 is provided with an impingement face 36*a* in the extension of the sheet conveying direction of the pressure plate 26, and the sheets 200 are set in such a manner that the front end thereof impinges on the impingement face 36*a*. The impingement face 36*a* is provided with a bank sheet 37 constituting a sheet separating member. The bank sheet 37 is composed of an elastic member such as a plastic sheet, and serves to separate the sheets one by one, utilizing an elastic force generated by bending.

[Conveying and Printing Mechanisms of the Printer]

In the following there will be explained, with reference to FIG. 25, a conveying mechanism and a printing mechanism in the printer.

An LF roller 109 for conveying the sheet 200 is composed of a metal pipe and a film of a material with a high friction coefficient such as urethane resin formed on the metal pipe. The LF roller 109 is rotated by the sheet feeding motor 120 shown in FIG. 24 and pinches and conveys the sheet 200 in cooperation with a pinch roller 110.

A recording head 115 for recording image information on the sheet 200 conveyed by the LF roller 109 is mounted on a carriage (not shown), capable of reciprocating motion along the longitudinal direction of the LF roller 109. The recording head 115 is driven together with the carriage by the carriage motor 121 shown in FIG. 24, and is capable of a reciprocating motion in the transverse direction of the sheet (a direction perpendicular to the plane of the drawing).

Spurs 111 and sheet discharge rollers 112 are positioned in two sets at the downstream side of the LF roller 109 and the recording head 115, for conveying the sheet 200 after the recording. The sheet discharge rollers 112 are linked with the LF roller 109 through transmission members (not shown) and are rotated by the LF roller 109 so as to convey the sheet 200 in a direction the same as the conveying direction of the LF roller 109.

Also the sheet end sensor 108 is provided in the sheet path of the upstream side in the sheet conveying direction with respect to the LF roller 109 while the sheet discharge sensor 113 is positioned between the two sets of sheet discharge rollers, and each sensor changes the output voltage from the LOW state to the HIGH state in response to the passing of the sheet 200.

[Driving Mechanism of ASF]

Figure 27:
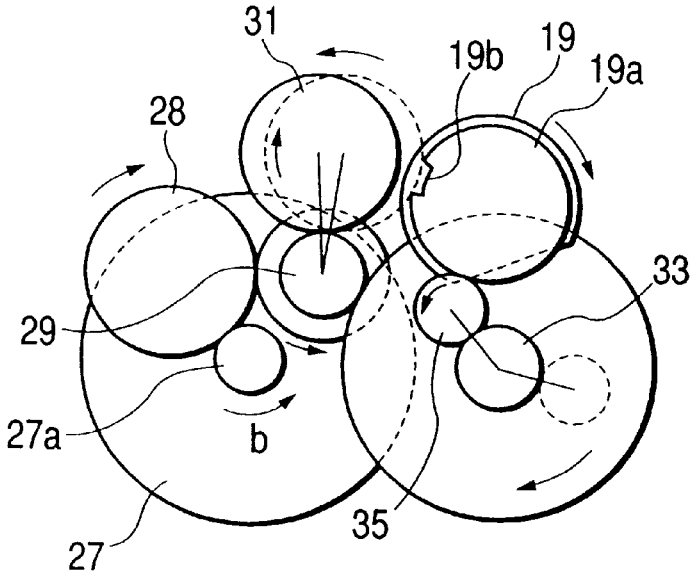
FIGS. 27 and 28 are schematic views showing the connection and the operating direction of a driving mechanism of the ASF 1.
Figure 28:
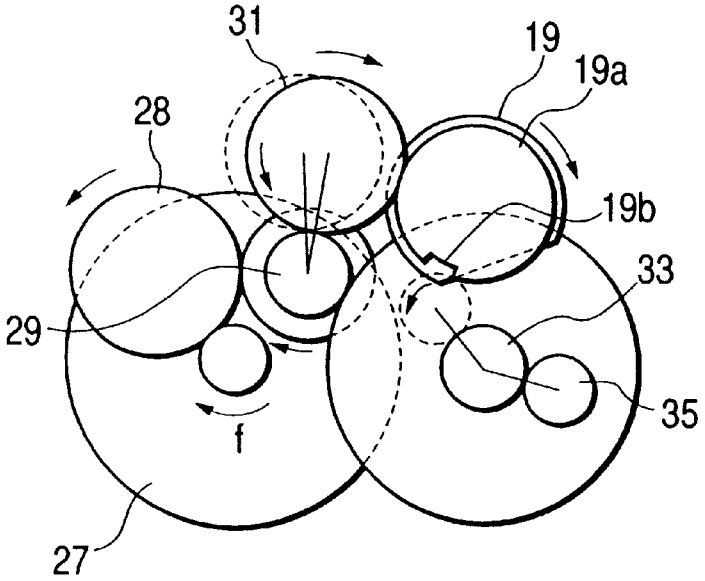

FIGS. 27 and 28 show the driving mechanism of the external ASF of the present invention.

There are provided a sheet feeding motor 27 composed of a stepping motor capable of forward and reverse rotation; an idle gear 28 meshing with a motor gear 27*a* of the sheet feeding motor 27; an ASF double gear 29 having two gears different in diameter and meshing with the idle gear 28; a forward rotating planet gear 31 meshing with the smaller one of the above-mentioned double gear and rotating around the double gear; a reverse rotating sun gear 33 having two gears different in diameter and meshing with the smaller one of the above-mentioned double gear 29; and a reverse rotating plane gear 35 meshing with the smaller gear of the above-mentioned reverse rotating sun gear 33 and rotating around the reverse rotating sun gear. A sheet feeding roller gear 19*a* provided on the shaft end of the sheet feeding roller 19 has a toothless portion 19*b*. The sheet feeding roller gear 19*a* is positioned on the rotating trajectory of the forward rotating planet gear 31 and the reverse rotating planet gear 35 so as to mesh with these gears.

In the following there will be explained the functions of these gears. Referring to FIG. 27, when the sheet feeding motor 27 rotates in a direction indicated by the arrow b (reverse rotation), the gears rotate respectively in directions indicated by arrows. More specifically, through the idle gear 28 and the ASF double gear 29, the reverse rotating planet gear 35 moves about the reverse rotating sun gear 33 from a broken-lined position in FIG. 27 to a solid-line position as indicated by an arrow, and meshes with the sheet feeding roller gear 19*a*, thereby rotating the sheet feeding roller 19 in a direction indicated by an arrow (namely in a direction to advance the sheet 200 on the pressure plate 26 toward the printer 101). The sheet feeding roller gear 19*a*, rotating by meshing with the reverse rotating planet gears 35, is released from the meshing when the toothless portion 19*b* reaches a position opposed to the reverse rotating planet gear 35, whereby it is no longer rotated by the reverse rotation of the sheet feeding motor 27.

In this operation, the forward rotating planet gear 31 moves from a broken-lined position in FIG. 27 to a solid-line position in a direction indicated by the arrow and is stopped therein by impinging on a stopper (not shown), so that it does not influence the rotation of the sheet feeding roller 19.

Then, referring to FIG. 28, when the sheet feeding motor 27 rotates in a direction indicated by the arrow f (forward rotation), the gears rotate respectively in directions indicated by arrows. More specifically, through the idle gear 28 and the ASF double gear 29, the forward rotating planet gear 31 moves about the ASF double gear 29 from a broken-lined position in FIG. 28 to a solid-line position as indicated by an arrow, and meshes with the sheet feeding roller gear 19*a*, thereby rotating the sheet feeding roller 19 in a direction indicated by an arrow in FIG. 28 (namely in a direction to advance the sheet 200 on the pressure plate 26 toward the printer 101). The sheet feeding roller gear 19*a*, rotating by meshing with the forward rotating planet gear 31, is released from the meshing when the toothless portion 19*b* reaches a position opposed to the forward rotating planet gear 31, whereby it is no longer rotated by the forward rotation of the sheet feeding motor 27.

In this operation, the reverse rotating planet gear 33 moves from a broken-lined position in FIG. 28 to a solid-line position and is stopped therein by impinging on a stopper (not shown), so that it does not influence the rotation of the sheet feeding roller 19.

In a position where the toothless portion 19*b* of the sheet feeding roller gear 19*a* is opposed to the forward rotating planet gear 31, the cam portion 19*c* of the sheet feeding roller engages with the cam portion 26*a* of the pressure plate 26 as in the initial state, thereby separating the pressure plate 26 from the sheet feeding rubber member 23.

Consequently, when the sheet feeding motor 27 is continuously rotated in the forward direction, the cam portion 19*c* of the sheet feeding roller 19 engages with the cam portion 26*a* of the pressure plate 26 whereby the sheet feeding roller 19 terminates rotation in a phase the same as in the initial state where the pressure plate 26 is separated from the sheet feeding rubber member 23, and the forward rotating planet gear 33 and the reverse rotating planet gear 35 thereafter rotate idly in the solid-lined positions in FIG. 28 whereby the mechanism is stabilized in a state not transmitting the rotation to the sheet feeding roller 19.

As explained in the foregoing, the sheet feeding roller 19 rotates only in a direction for advancing the sheet 200 toward the printer 101 regardless whether the sheet feeding motor 27 is rotated in the forward (normal) or reverse direction, and never rotates in the opposite direction.

[Sheet Feeding Operation and Recording Operation (in the Printer)]

In the following there will be explained a series of operations for feeding, conveying and recording the sheet 200 and thereafter discharging the sheet 200, to be executed by the printer and the ASF of the present invention.

In response to a recording command received from an external information device such as a computer, the printer 101 executes at first a sheet feeding operation and then a recording operation.

Figure 29:
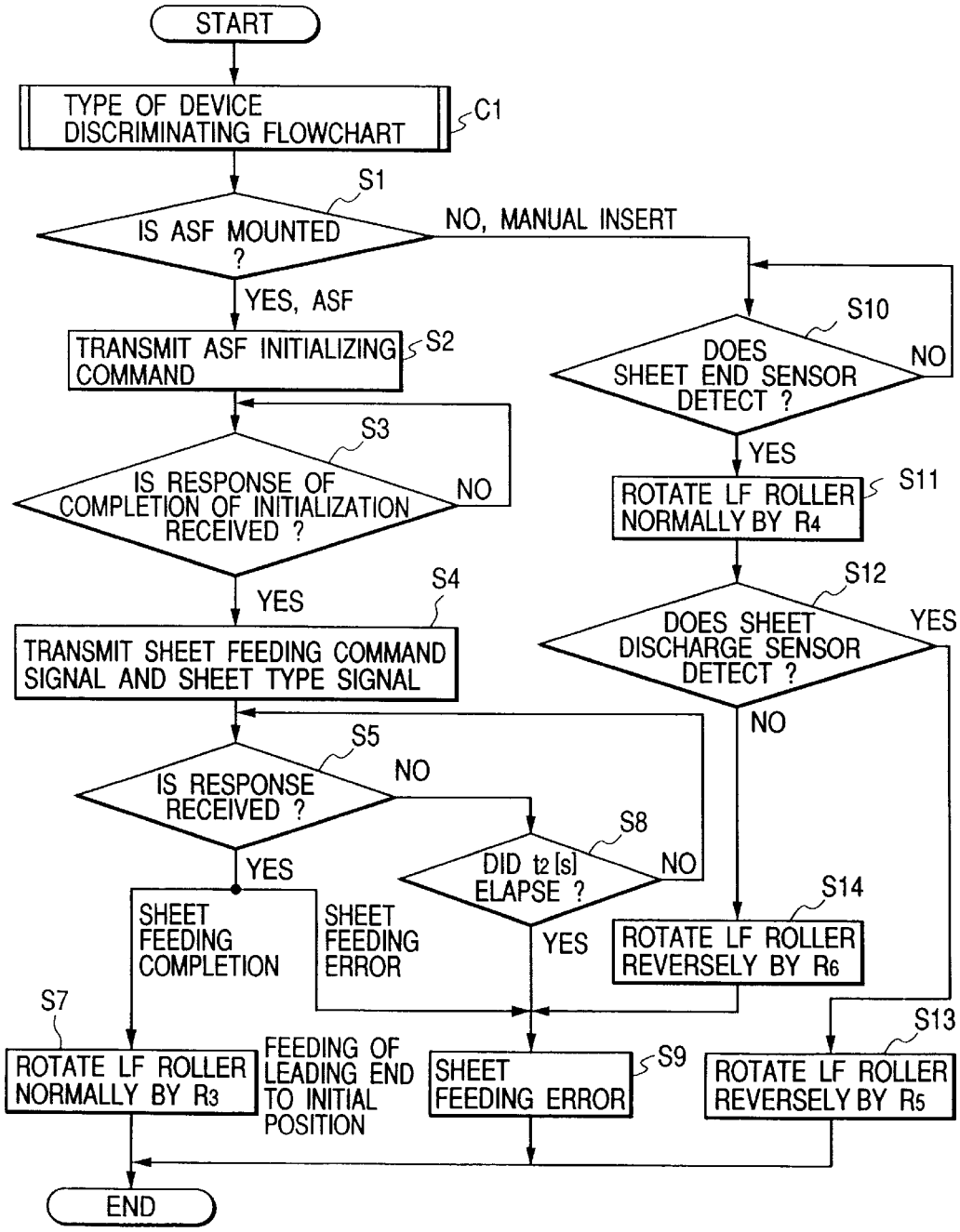
FIG. 29 is a flowchart showing the control sequence for the sheet feeding operation in a printer control unit 202 in a first embodiment.

FIG. 29 is a flowchart showing the control sequence in case the printer 101 executes a sheet feeding operation. At first the main control unit 202 of the printer 101 executes a sub flow C1 of which details will be explained later with reference to FIG. 33. The sub flow C1 is to discriminate, a type of the external device mounted to the printer, through the ports 117*f*, 117*g* shown in FIG. 26.

Then the sequence proceeds to a step S1, and, if the result of the sub flow C1 indicates that the ASF is mounted to the printer 101, the sequence proceeds to a step S2 as the sheet feeding is to be executed by the ASF. In a step S2, the main control unit 202 transmits an initializing command signal to the ASF, and the sequence proceeds to a step S3.

If a response signal indicating the completion of initialization in the ASF is not received in the step S3, the sequence repeats the step S3. Upon receiving such response signal, the sequence proceeds to a step S4 in which the main control unit 202 transmits a sheet feed command signal and a sheet type signal indicating the kind of the sheet (such as ordinary paper, coated paper, postcard, glossy film etc.) to the ASF, and the sequence proceeds to a step S5.

The sequence proceeds to a step S8 if the response signal is not received from the ASF in the step S5, but repeats the step S5 if a predetermined limit time t2 has not elapsed. If a step S8 identifies that the limit time t2 has elapsed, the sequence proceeds to a step S9 in which the main control unit 202 issues a sheet feeding error and terminates the sheet feeding operation. If a step S5 receives a response signal from the ASF, indicating the completion of the sheet feeding, the sequence proceeds to a step S7. A step S7 executes so-called head feeding operation for the sheet 200 (an operation for feeding a leading end of a sheet to an initial position), whereby the main control unit 202 drives the sheet feeding motor 120 to rotate the LF roller 109 by a predetermined amount R3 in the sheet conveying direction in the recording operation (forward (normal) rotation), thereby terminating the sheet feeding operation. The predetermined amount R3 is so selected that the leading end of the sheet 200 does not reach the detecting area of the sheet discharge sensor 113 but reaches a position directly under the recording head 115. Consequently, when the printer 101 starts recording on the sheet 200, it need not be reversed toward the upstream side in the conveying direction, so that the trailing end of the sheet 200 does not collide with the internal components of the ASF and that the sheet 200 can be protected from creasing or misfeeding.

Also if the step S5 receives a response signal from the ASF, indicating a sheet feeding error, the sequence proceeds to a step S9 in which the main control unit 202 issues a sheet feeding error and terminates the sheet feeding operation.

If, in the step S1, the result of the sub flow C1 indicates that the ASF is not mounted on the printer 101, the sequence proceeds to a step S10 as the sheet feeding is to be executed by manual insert.

If the user does not insert a sheet in the step S10, the sheet is not detected and the sheet end sensor 108 provides a low output voltage, whereupon the sequence repeats the step S10. When the user inserts the sheet 200 in the printer 101 to impinge the sheet 200 on the LF roller 109, the sheet end sensor 108 releases a High output voltage, indicating the sheet detection, whereupon the sequence proceeds to a step S11. In the step S11, the main control unit 202 drives the sheet feeding motor 120 through the sheet feeding motor driver 206, so as to rotate the LF roller 109 normally by a predetermined amount R4 (in the forward direction for conveying the sheet in the conveying direction in the recording operation). The predetermined amount R4 is so selected that the leading end of the sheet 200 reaches the detection area of the sheet discharge sensor 113. Then a step S12 identifies that the sheet feeding is successful if the sheet discharge sensor 113 detects the sheet 200, and the sequence proceeds to a step S13. In the step S13, the main control unit 202 drives the sheet feeding motor 120 through the sheet feeding motor driver 206, so as to rotate the LF roller 109 reversely by a predetermined amount R5 (in the reverse direction for conveying the sheet in a direction opposite to the conveying direction in the recording operation). The predetermined amount R5 is so selected that the sheet 200 conveyed to the detection area of the sheet discharge sensor 113 is returned to the recording start position and that the leading end of the sheet 200 does not come out of the nip between the LF roller 109 and the pinch roller 110.

In the step S12, if the sheet discharge sensor 113 does not detect the sheet 200, for example if the sheet 200 does not impinge strongly enough on the LF roller 109 and is not pinched between the LF roller 109 and the pinch roller 110 or if the leading end of the sheet 200 does not reach the detection area of the sheet discharge sensor 113 even after sheet conveyance by the amount R4 because of a skewed impingement of the sheet 200 on the LF roller 109, the main control unit 202 identifies a failure in the sheet feeding in manual insert and the sequence proceeds to a step S14. In the step S14, the main control unit 202 drives the sheet feeding motor 120 through the sheet feeding motor driver 206 so as to rotate the LF roller 109 reversely by a predetermined amount R6. The predetermined amount R6 is so selected that the leading end of the sheet 200, conveyed to the detection area of the sheet discharge sensor 113, can satisfactorily escape from the nip between the LF roller 109 and the pinch roller 110.

Thus, in the manual insert operation, the successful feeding can be securely confirmed by discriminating whether the sheet discharge sensor 113 detects the sheet 200, and, in case of a failure in the sheet feeding, the sheet 200 is returned to a position where it is not pinched by the LF roller 109 whereby the sheet 200 can be easily removed and manually inserted anew.

In contrast to the ASF sheet feeding, there are no mechanical components colliding with the returning sheet 200 in case of manual insert, so that the returning conveyance thereof does not result in creasing or misfeeding.

After the completion of the sheet feeding operation by the above-described sheet feeding control sequence, the printer 101 executes the recording operation. The main control unit 202 drives the carriage motor 121 through the motor driver 208 and the recording head 115, mounted on the carriage (not shown) connected to the carriage motor 121, through the head driver 210, thereby affecting recording of a line. Subsequently the main control unit 202 drives the sheet feeding motor 120 through the motor driver 206 to advance the sheet 200 by a line, and then repeats the driving of the carriage motor 121 and the recording head 115, thereby completing the recording on the sheet. After completion of the recording, the main control unit 202 drives the sheet feeding motor 120, thereby rotating the LF roller 109 normally. Thus, the sheet discharge roller 112 is driven to discharge the sheet 200 from the printer 101.

[Sheet Feeding Operation (in the ASF)]

Figure 30:
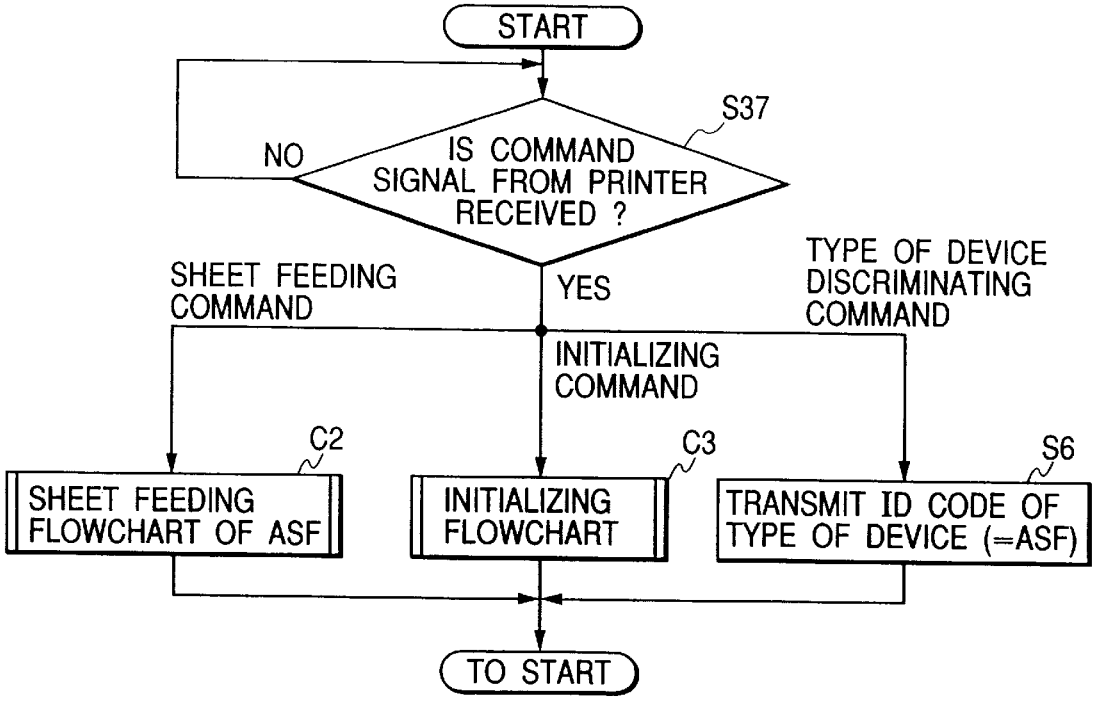
FIG. 30 is a flowchart showing the main control sequence of an ASF control unit 201.

FIG. 30 is a flowchart showing the main control sequence of the ASF which can be externally attached to the printer of the present invention. The control unit 201 of the ASF 1 of the present invention is normally in a stand-by state when connected to the printer 101, and repeats a step S37, if a command signal is not received from the printer 101, until the command signal is received. When a command signal from the printer 101 is received through the serial receiving port 44*g* shown in FIG. 26, the sequence proceeds to following sub flows or steps according to the content of the command signal. If the command signal from the printer 101 is a "sheet feed command" or an "initializing command", the sequence respectively proceeds to a sub flow C2 for controlling the ASF sheet feeding operation or a sub flow C3 for controlling the initializing operation, and, after the completion of each sub flow, the sequence returns to the step S37 to enter the stand-by state. If the command signal from the printer 101 is a "type of device discriminating command", the sequence proceeds to a step S6 for transmitting an ID code indicating the type of the ASF 1 itself to the printer 101 through the serial transmitting port 44*f*, and then proceeds to the step S37 for entering the stand-by state.

Among the two sub flows mentioned above, the sub flow C2 for controlling the ASF sheet feeding operation will be explained in the following, and the sub flow C3 for controlling the initializing operation will be explained later.

Figure 31:
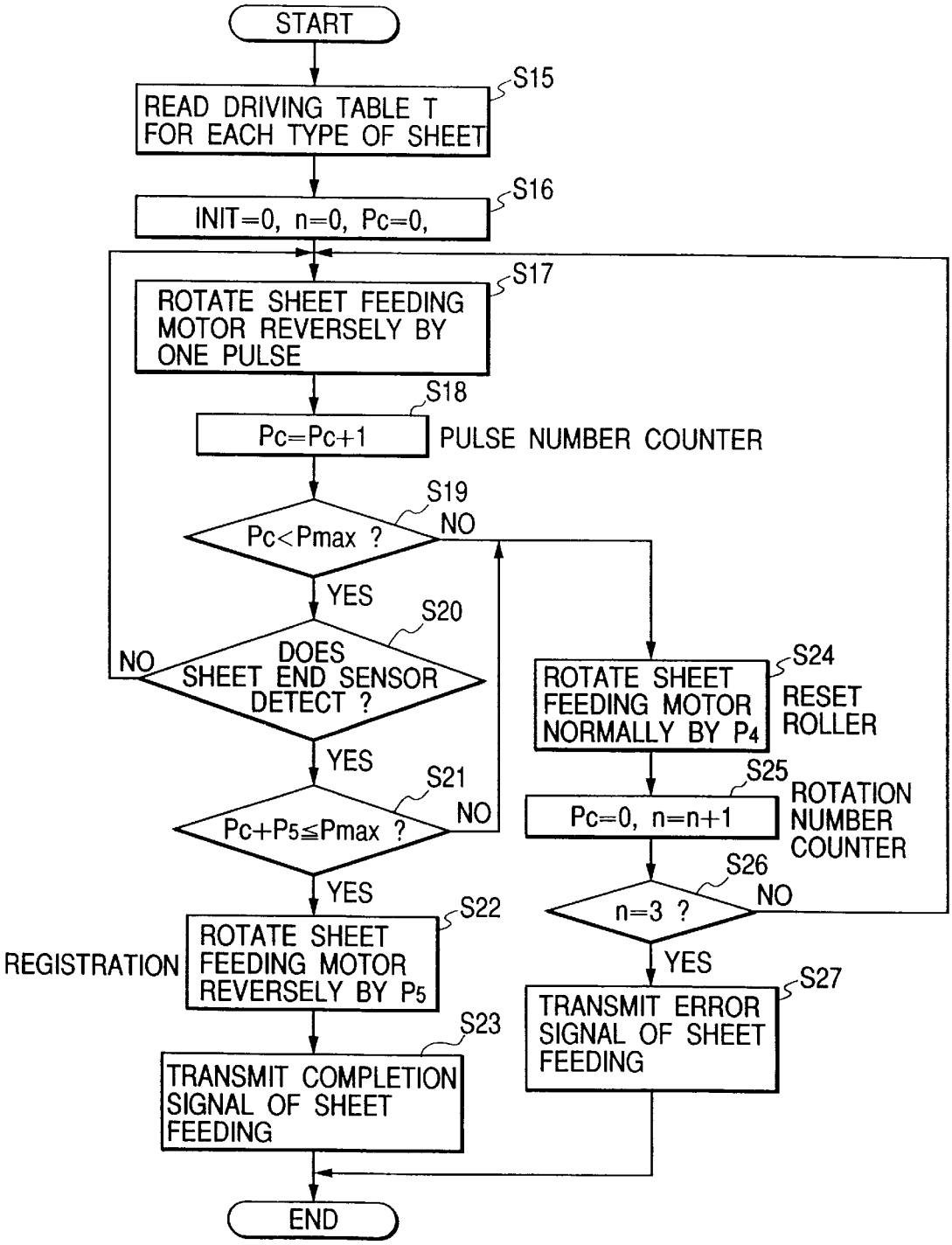
FIG. 31 is a sub flowchart C2 for controlling a sheet feeding operation by the ASF control unit 201 in the first embodiment.

FIG. 31 is a flowchart showing the sub flow C2 for controlling the sheet feeding operation in the ASF 1.

At first in a step S15, the ASF control unit 201 reads a driving table T for the sheet feeding motor 27 optimum for the sheet type to be fed, from the ROM 214 to the CPU 213, based on the sheet type information received together with the sheet feeding command signal from the printer 101. The driving table T contains information such as the drive speed of the sheet feeding motor 27 composed of a pulse motor, a registration pulse number P5 for rotating the sheet feeding roller 19 by an optimum amount according to the sheet type for registering operation in a step S22 to be explained later etc., and plural tables are prepared according to the characteristics of anticipated sheets.

After reading the driving table T, the sequence proceeds to a step S16 in which the ASF control unit 201 sets "0" as the initial value for variables INIT, n and Pc. These variables are stored in the RAM 215. The variable INIT is a flag indicating whether the rotating phase of the sheet feeding roller 19 is in an initial position; n is a rotation number counter indicating the number of rotations of the sheet feeding roller 19 after the start of the sheet feeding flow C2; and Pc is a pulse number counter indicating the number of pulses given to the sheet feeding motor 27 for driving in the reverse direction.

In a next step S17, the ASF control unit 201 drives, through the sheet feeding motor driver 216, the sheet feeding motor 19 by one pulse in the reverse direction. A next step S18 increases the value of the pulse number counter Pc by 1, and, in a next step S19, the ASF control unit 201 compares the value of the pulse number counter Pc with a permitted pulse number Pmax.

The permitted pulse number Pmax is the total pulse number from the start of reverse rotation of the sheet feeding motor 27 to the end of rotation of the sheet feeding roller to a position where the toothless portion 19*b* of the sheet feeding roller gear comes opposed to the reverse rotation planet gear 35 as explained in FIG. 27. Since the condition Pc<Pmax is satisfied immediately after the start of sheet feeding, the sequence proceeds to a step S20, in which the ASF control unit 201 confirms the output voltage of the sheet end sensor 108 in the printer 101 through the port 44*h* shown in FIG. 26. As the sheet 200 does not reach the interior of the printer 101 immediately after the start of sheet feeding, the sheet end sensor 108 provides a LOW output voltage, so that the sequence returns to the step S17. Through the repetition of the steps S17 through S20, the reverse rotation planet gear 35 shown in FIG. 27 moves from the broke-lined position to the solid-lined position and meshes with the sheet feeding roller gear 19*a*, whereby the sheet feeding roller 19 starts rotation. When the sheet feeding roller 19 starts rotation from the initial phase state, the sheet feeding roller cam 19*c* and the pressure plate cam 26*a* are disengaged whereby the pressure plate 26 is lifted upwards by the pressure plate spring 13 and the sheets 200 stacked on the pressure plate 26 are brought into pressure contact with the sheet feeding rubber member 23. In this operation,the leading end of the sheets 200, impinging on the impinging face 36*a* of the bank 36, is also lifted upwards and is maintained in contact with the approximate center of the bank sheet 37.

The steps S17 through S20 are further repeated to continue the reverse rotation of the sheet feeding motor 27, whereby the sheet feeding roller 19 is rotated to initiate the conveyance of the sheet 200 by the frictional force of the sheet feeding rubber member 23. The leading end of the sheet 200 is separated from the underlying sheets by a repulsive force generated by bending the elastic bank sheet 37, whereby only one sheet is advanced.

However, the relationship Pc<Pmax no longer stands when the reverse rotation of the sheet feeding motor 27 is continued until the value of the pulse number counter Pc reaches a certain magnitude, whereupon the sequence branches to a step S24 from step S19. In the step S24, the ASF control unit 201 drives the sheet feeding motor 27 in the forward direction by a predetermined pulse number P4, which is enough for rotating the sheet feeding roller 19 to the initial position by the forward rotating planet gear 31. Thus, by the execution of the step S24, the sheet feeding roller 19 rotates to a phase of one exact rotation from the initial position, wherein the toothless portion 19*b* of the sheet feeding roller gear reaches a position opposed to the forward rotating planet gear 31 so that the sheet feeding roller gear is disengaged and stopped. Then, a step S25 returns the pulse number counter Pc to "0" and increases the value of the rotation number counter n by "1". As n=1 in this state in a next step S26, the sequence returns to the step S17 to start the reverse rotation of the sheet feeding motor 27 again.

The ASF control unit 201 repeats the steps S17 through S20 as explained in the foregoing whereby the sheet feeding roller 19 starts a twice rotation and the sheet 200 is further conveyed. When the leading end of the sheet 200 reaches the sheet end sensor 108 in the printer 101, the sheet end sensor 108 generates a HIGH output voltage whereby the sequence proceeds from S20 to S21. In the step S21, the ASF control unit 201 compares a sum of the value of the pulse number counter Pc and the registration pulse number P5 in the read driving table T, with the permitted pulse number Pmax. If Pc+P5≤Pmax, the sequence proceeds to a step S22 since, in case the sheet feeding motor 27 is further driven in the reverse direction by P5 pulses, the reverse drive is not released in the course of the drive.

On the other hand, if Pc+P5>Pmax, the sequence proceeds to a step S24 since, by further driving the sheet feeding motor 27 in the reverse direction by P5 pulses, the toothless portion 19*b* of the sheet feeding roller gear comes opposed to the reverse rotation planet gear 35 in the course of such drive whereby the driving transmission to the sheet feeding roller 19 is interrupted. The step S24 again drives the sheet feeding motor normally by P4 pulses to return the sheet feeding roller 19 to the initial position. Then a step S25 sets "0" for Pc and n+1 for n, and the sequence proceeds to a step S26. In this state there stands n=2 because the sheet end sensor 108 normally detects the sheet 200 in the twice rotation of the sheet feeding roller, so that the sequence returns to the step S17. At this time, as the sheet end sensor 108 has generated a HIGH output voltage and the pulse number counter Pc has just been reset, the sequence proceeds from the step S17 to S18→S19→S20→S21 and S22 because there is now satisfied a relation Pc+P5≤Pmax.

The step S22 executes so-called registering operation. The ASF control unit 201 drives the sheet feeding motor 27 reversely by the pulse number PS in the read driving table T, thereby rotating the sheet feeding roller 19. In this operation, the leading end of the sheet 200 is further advanced into the printer 101 from the position detected by the sheet end sensor 108, and is stopped by impinging on the nip formed between the stopped LF roller 109 and the pinch roller 110, but the trailing portion of the sheet 200 is further advanced by the sheet feeding roller 19. Consequently, the leading end of the sheet 200 is aligned parallel to the nip formed between the LF roller 109 and the pinch roller 110.

In a next step S23, the ASF control unit 201 transmits a signal indicating the completion of sheet feeding to the printer 101 through the serial transmitting port 44*f* shown in FIG. 26, whereupon the sequence is completed.

In case no sheet is present on the pressure plate 26, the sheet end sensor 108 does not generate the HIGH output voltage regardless of the number of rotations of the sheet feeding roller 19.

Therefore, the ASF control unit 201 repeats twice a sequence of executing a loop of S17→S18→S19→S20→S17 by a predetermined number of times and then returning to S17 through S19→S24→S25→S26, and, upon reaching the step S26 for the third time, the rotation number counter of the sheet feeding roller 19 becomes n=3 and the sequence then proceeds to a step S27 for transmitting a sheet feeding error signal to the printer 101, whereupon the sequence is terminated.

[Other Operations (Printer and ASF)]

Figure 32:
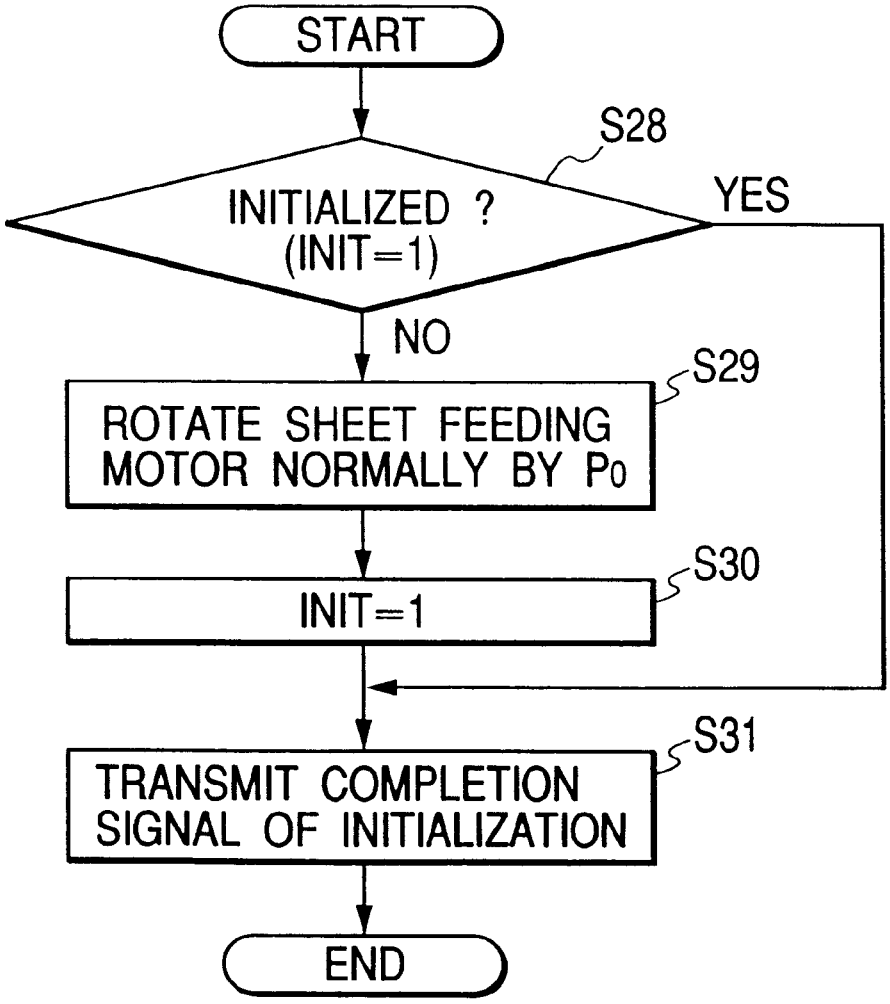
FIG. 32 is a sub flowchart C3 for controlling an initializing operation by the ASF control unit 201.

FIG. 32 is a flowchart of a sub flow C3 for controlling the initializing operation of the ASF 1. Upon receiving an initializing command signal from the printer 101, the ASF control unit 201 proceeds to a step S28 for confirming the value of a flag INIT indicating whether the rotational phase of the sheet feeding roller 19 is in an initial position. If INIT=1 indicating that the sheet feeding roller 19 is already in the initial position, the sequence proceeds to a step S31 for transmitting an initialization completion signal to the printer 101, whereupon the sequence is terminated. If INIT=0, the sequence proceeds to a step S29 for driving the sheet feeding motor 27 normally by a predetermined pulse number P0, which is selected to be sufficient for rotating the sheet feeding roller gear until the toothless portion 19*b* thereof reaches a position opposed to the forward rotating planet gear 31 thereby rotating the sheet feeding roller 19 to the initial position from any rotational phase. Thus, the step S29 rotates the sheet feeding roller 19 to the initial position, and the pressure plate 26 and the sheet feeding rubber member 23 are mutually separated to enable smooth setting of the sheets 200.

A next step S30 sets "1" as the flag INIT in order to indicate that the sheet feeding roller is in the initial position. Then a step S31 transmits an initialization completion signal to the printer 101, and the sequence is terminated.

Figure 33:
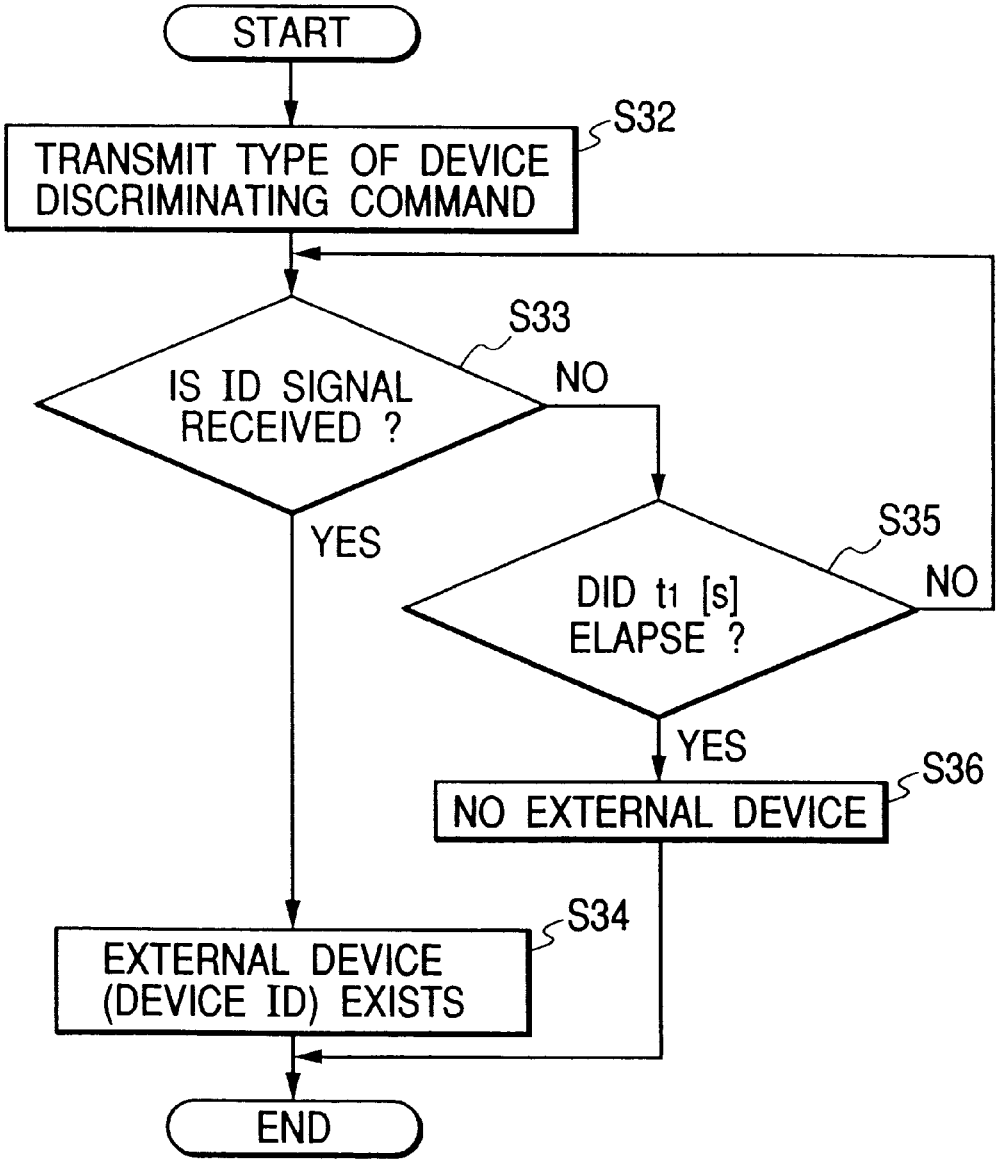
FIG. 33 is a sub flowchart C1 for controlling a device discriminating operation in the printer control unit 202.

FIG. 33 is a flowchart showing a sub flow C1 for discriminating, through ports 117*f*, 117*g* shown in FIG. 26, the type of the device externally connected to the printer. At first, in a step S32, the main control unit 202 transmits a device type discrimination command signal to the external device through the port 117*g*. If a response signal from the external device is not received through the port 117*f* in a step S33, the sequence proceeds to a step S35, and if a predetermined limit time t1 has not elapsed, the sequence returns to the step S33. If the limit time t1 has elapsed in the step S35, the sequence proceeds to a step S36 for discriminating that the external device is absent, whereupon the sequence is terminated.

If a response signal is received from the external device in the step S33, the sequence proceeds to a step S34, in which the main control unit 202 reads a partial code ID indicating the type of the mounted device from the received response signal, whereupon the sequence is terminated.

[Second Embodiment]

Figure 34:
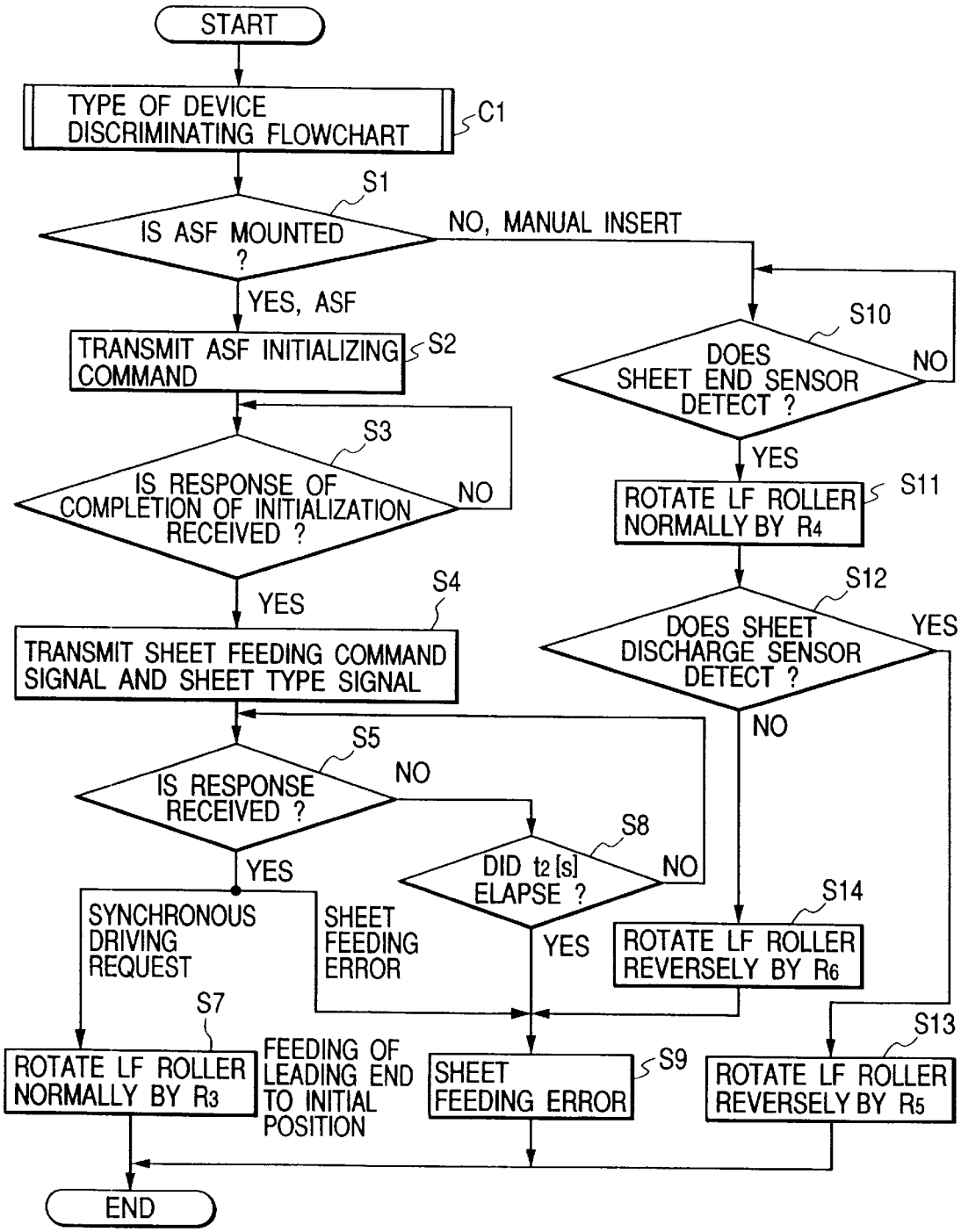
FIG. 34 is a flowchart for controlling the sheet feeding operation by the printer control unit 202 in a second embodiment.
Figure 35:
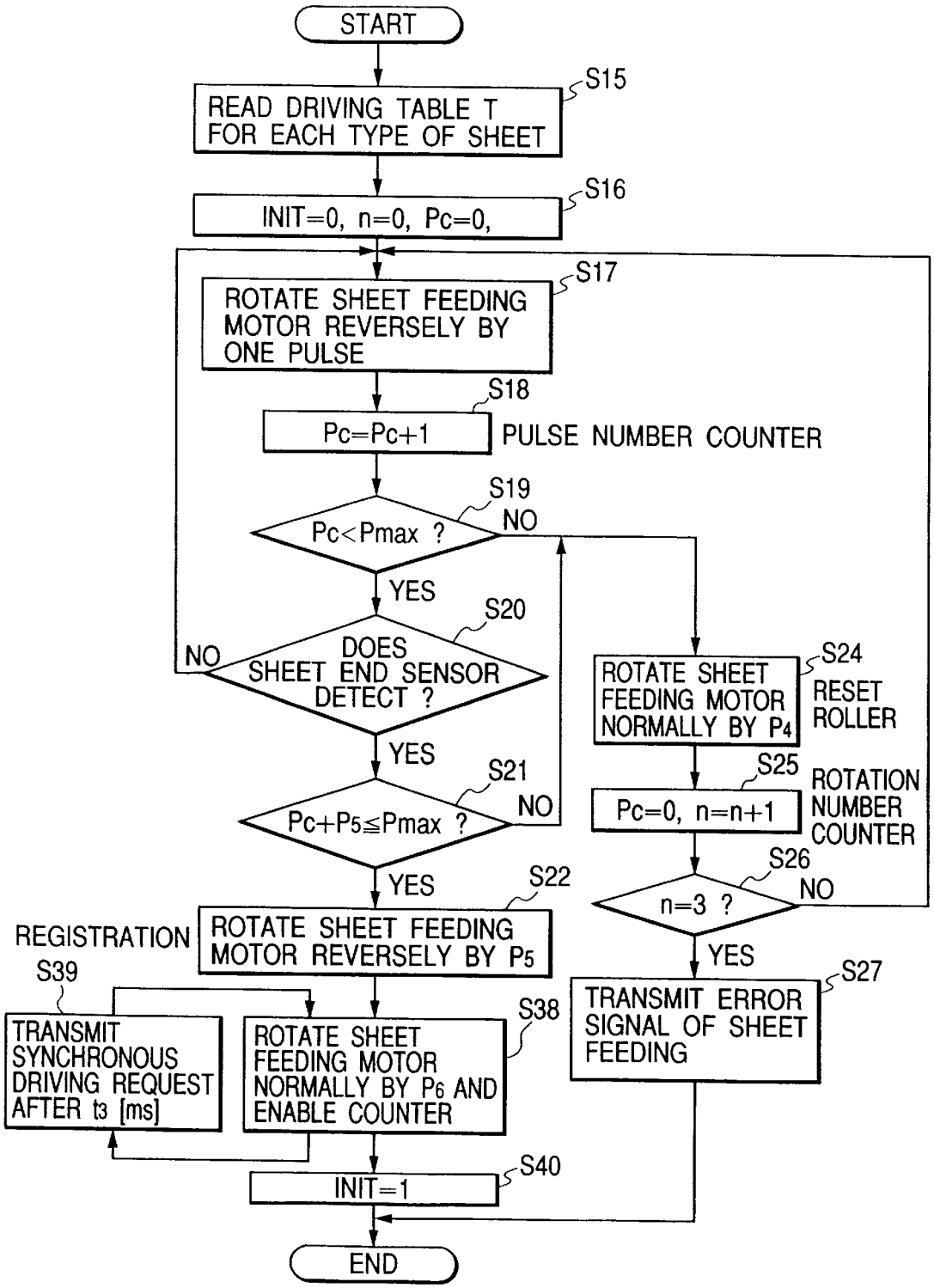
FIG. 35 is a sub flowchart C2 for controlling the sheet feeding operation by the ASF control unit 201 in the second embodiment.

FIGS. 34 and 35 show a second embodiment of the control sequence in the printer of the present invention and the external ASF which can be mounted to the printer. Parts or operations equivalent in function or shape to those in the first embodiment will be represented by the same numbers or symbols and will not be explained further.

Figure 36:
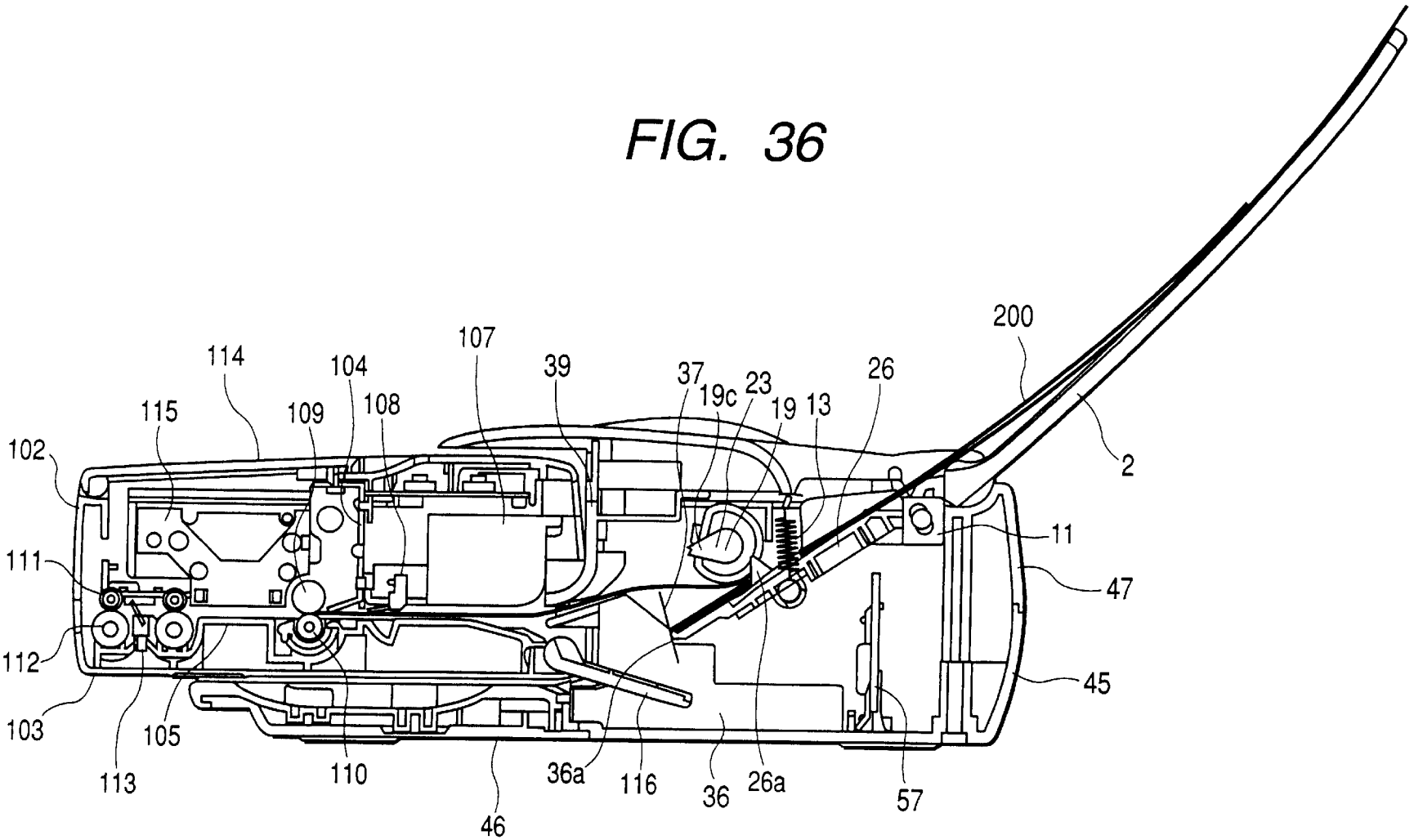
FIG. 36 is a schematic cross-sectional view showing a state after completion of a step S22 in the sheet feeding operation.

In the first embodiment, as shown in FIG. 31, the ASF control unit 201 drives the sheet feeding motor reversely by P5 pulses in the step S22, and then transmits the sheet feeding completion signal to the printer 101 in the step S23. In such case, however, the sheet feeding roller 19 is not returned to the initial position, so that the sheet feeding roller 19 remains in contact with the sheets 200 as shown in FIG. 36. If the leading end aligning operation or the recording operation is executed in the printer in this state simply by the LF roller 109 alone, the sheet feeding roller 19 generates a backward tension to deteriorate the accuracy of conveyance of the sheet 200.

The second embodiment is to avoid such drawback.

As shown in FIG. 35, after the registering operation in the step S22, the ASF control unit 201 proceeds to a step S38 for driving the sheet feeding motor 27 normally (forwardly) by a predetermined pulse number P6, which is selected sufficient for rotating the sheet feeding roller 19 to the initial position by the forward rotating planet gear 31. Simultaneous with the start of forward rotation of the sheet feeding motor 27, there is activated a counter for measuring a time elapsed from the start of drive, and, after the elapse of a predetermined time t3, the sequence proceeds to a step S39 to transmit a synchronous driving request signal to the printer 101. The predetermine time t3 is selected slightly longer than the time from the start of rotation of the sheet feeding motor 27 in the step S38 to the start of rotation of the sheet feeding roller 19 by the movement of the forward rotating planet gear 31 to the meshing position with the sheet feeding roller gear 19*a*.

Also, in the step S38, the drive speed of the sheet feeding motor 27 is so selected that the peripheral speed of the sheet feeding rubber member 23 mounted on the sheet feeding roller 19 is slightly larger than that of the LF roller 109 rotating in the step S7 in the printer.

Upon completion of the step S38, the sheet feeding roller 19 is rotated to a phase the same as in the initial position, and the sequence proceeds to a step S40, in which the ASF control unit 201 sets, in the INIT flag, a value "1" indicating that the rotational phase of the sheet feeding roller 19 is in the initial state, and the sequence is terminated.

On the other hand, the main control unit 202 of the printer, upon receiving the synchronous driving request signal transmitted by the ASF control unit 201 in the above-mentioned step S39, proceeds from the step S5 in FIG. 34 to a step S7 for starting the forward (normal) rotation of the LF roller 109.

Figure 37:
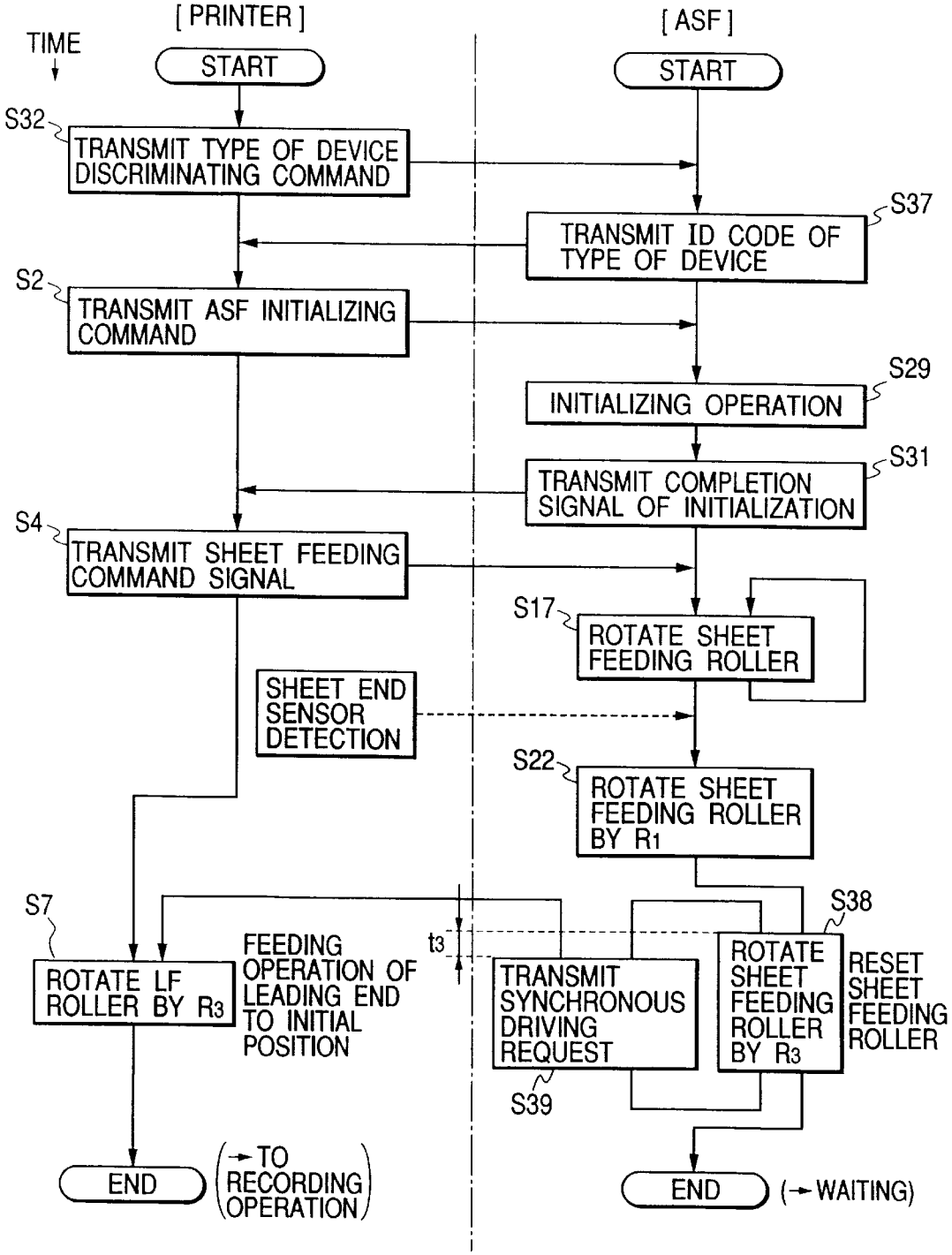
FIG. 37 is a timing chart showing the outline of the operation flow of the printer 101 and the ASF 1 in the second embodiment.

FIG. 37 is a timing chart outlining the operations of the printer 101 and the ASF 1 of the present embodiment in the course of time.

When the printer starts the sheet feeding operation, at first a device type discrimination command signal is transmitted to the ASF (S32). The ASF transmits an ID signal, indicating its own device type code to the printer (S37). Then the printer transmits an initializing command signal to the ASF (S2). The ASF, if not in the initialized state, executes initialization by rotating the sheet feeding roller (S29), and transmits an initialization completion signal to the printer (S31). Then the printer transmits a sheet feeding command signal to the ASF (S4).

The ASF reads an optimum driving table T based on the sheet type information transmitted together with the sheet feeding command signal (S15, omitted in FIG. 37) and drives the sheet feeding motor based on the sheet feeding operation control flow C2, thereby rotating the sheet feeding roller (S18). When the sheet end sensor provided in the printer detects a sheet and generates a HIGH output voltage, the ASF further rotates the sheet feeding roller by a rotation amount R1 based on the aforementioned pulse number P5, thereby achieving so-called registering operation (S22). After the registration, the ASF further rotates the sheet feeding roller by a rotation amount R3 to a position the same as the initial position (S38), and, after the elapse of a time t3 from the start of driving of the sheet feeding motor, transmits a synchronous driving request signal to the printer (S39).

Upon receiving the synchronous driving request signal from the ASF, the printer rotates the LF roller by a rotation amount R3, thereby executing so-called leading end feeding operation for feeding a leading end of the sheet to an initial position (S7).

In the present embodiments, as will be apparent from the foregoing description, the sheet feeding roller 19 starts rotation in a state after the completion of the step S22 as shown in FIG. 36, and the LF roller 109 starts rotation slightly later, and the peripheral speed of the sheet feeding rubber member 23 is slightly larger than that of the LF roller 109. Consequently, when the LF roller 109 starts rotation for the leading end feeding operation in the step S7, there is not generated a backward tension on the sheet 200 because the sheet feeding rubber member 23 maintained in contact therewith starts rotation slightly earlier, and the backward tension resulting from the difference in the peripheral speed is also not generated since the peripheral speed of the sheet feeding rubber member 23 is slightly larger than that of the LF roller 109. Consequently, the accuracy of transportation of the sheet 200 is stabilized in the leading end feeding operation.

If the time t3 is excessively small, the LF roller 109 may start rotation before the driving force of the sheet feeding motor 27 is transmitted to the sheet feeding roller 19, while, if the time t3 is excessively large, the sheet feeding roller 19 rotates by a large amount before the LF roller 109 starts rotation whereby the sheet 200 may be deformed on the way or may become not parallel to the nip formed by the LF roller 109 and the pinch roller 110. Based on experimental results, the optimum range of time t3 in the present embodiment is 10 ms to 100 ms. Also if the peripheral speed of the sheet feeding rubber member 23 mounted on the sheet feeding roller 19 is not fast enough with respect to the peripheral speed of the LF roller 109, there may be generated a backward tension when the sheet feeding rubber member 23 causes slippage depending on the type of the sheet 200 or on the environmental conditions, while the sheet 200 may be deformed in case the peripheral speed of the sheet feeding rubber member 23 is too fast. Based on experimental results, the optimum value of the peripheral speed of the sheet feeding rubber member 23 in the step S38 of the present embodiment is 5 to 50% faster than the peripheral speed of the LF roller 109 in the step S7.

Also in the present embodiment, a signal corresponding to the "sheet feeding completion signal" in the first embodiment is named as the "synchronous driving request signal" because of the difference in the meaning of operation, but the actual signal may be identical with the "sheet feeding completion signal". Consequently the sheet feeding control flow is basically same in the first and second embodiments (FIGS. 29 and 34). Stated differently, the printer shown in the first embodiment can be used in combination with either of the ASF's shown in the first and second embodiments.

In the following there will be explained, with reference to FIG. 38, the content of the plural driving tables T in the second embodiment.

For example, if the sheet type information received by the ASF 1 indicates an ordinary paper, the ASF control unit 201 selects a driving table T1. For the ordinary paper, the driving speed is set at a middle speed, because the registering operation in the step S22 receives a low resistance. Also, as the possibility of skew feed is low during sheet feeding, the amount of pressing to the LF roller 109 need not be large so that the registration pulse number P5 is selected small.

In case the sheet type information received by the ASF 1 indicates an envelope, the ASF control unit 201 selects a driving table T3. As the envelope shows a high resistance in feeding, particularly in the registering operation in the step S22, the drive speed is selected lower in comparison with the case of ordinary paper, thereby securing a large torque, in order to prevent the sheet feeding motor 27 from stepping out of the synchronization. On the other hand, as the envelope tends to cause a skew feed in the course of feeding in comparison with other sheet types, the registration pulse number P5 in the step S22 is selected at a middle value, which is larger than in the table T1 for the ordinary paper. Thus, the leading end of the envelope is pressed by a larger amount to the LF roller 109, and the leading end of the envelope can be more securely registered.

Also, in case the sheet type information indicates glossy paper, the ASF control unit 201 selects a driving table T4. The glossy paper shows a large resistance in the registering operation, but tends to generate less skewing. For this reason, in the driving table T4, the driving speed is selected low while the registration pulse number P5 is selected small as in the ordinary paper.

In case the sheet type information indicates a postcard, the ASF control unit 201 selects a driving table T2. Since the postcard does not show a large resistance in the registering operation, the driving speed in the registering operation is selected at a middle value as in the ordinary paper.

On the other hand, if the LF roller 109 of the printer and the sheet feeding roller 19 of the ASF rotate simultaneously in the state shown in FIG. 37, a rigid sheet such as a postcard is not easily deformed in the course of conveyance, so that the sheet feeding roller 19 of the larger peripheral speed may forcedly press in the postcard against the frictional force of the LF roller 109, whereby the leading end of the postcard may be conveyed in excess of the rotation amount R3 of the LF roller and the obtained print may become improper. In order to avoid such situation, in the driving table T2, the registration pulse number P5 in the step S22 is selected as large as possible. More specifically, it is set as a variable, represented by P5=Pmax−Pc and determined by the driving pulse number for the reverse rotation of the sheet feeding motor 27 required until the detection of the sheet 200 by the sheet end sensor 108. Thus, regardless of when the sheet 200 is detected by the sheet end sensor 108, the total pulse number of the reverse rotation of the sheet feeding motor 27 becomes Pmax at the end of execution of the step S22. Stated differently, the toothless portion 19*b* of the sheet feeding roller gear 19*a* securely rotates to a position of disengagement opposed the reverse rotating planet gear 35. Therefore, after the end of the step S22, the rotational phase of the sheet feeding roller 19 is significantly advanced from the initial position, and, if the sheet feeding roller 19 rotates in the step S40, the phase thereof promptly returns to the initial position. Consequently the postcards stacked on the pressure plate 26 are promptly separated from the sheet feeding rubber member 23 immediately after the start of the synchronous drive of the LF roller 109 and the sheet feeding roller 19, so that the sheet feeding roller 19 no longer presses in the postcard against the frictional force of the LF roller 109.

Also in case the sheet type information received by the ASF 1 from the printer 101 indicates a sheet type for which the ASF 1 is not prepared or does not indicate the sheet type, the ASF control unit 201 selects a driving table T5. The driving table T5 of the present embodiment has values the same as those in the driving table T2 for the postcard, but it is naturally possible, depending on the contemplated conditions, to provide the table T5 with values the same as those of the table for other sheet types or with values completely different from those of other tables.

According to the present invention, as explained in the foregoing, the second guide member of the sheet feeding apparatus is disposed and displaced toward an inner side of the sheet, with respect to the first guide member of the recording apparatus, so that the automatically fed sheet can be prevented from interfering with the first guide member, and there can therefore be avoided a skew feed of the sheet, damage to the sheet end or sheet jamming resulting from such interference.

Also, as there is not required a strict relative positional relationship between the first and second guide members, it is not necessary to employ highly precise parts and it is rendered possible to avoid an increase in the cost.

Furthermore, even if the sheet generates skewing of a certain extent, it can be prevented from interfering with the first guide member, and there can therefore be avoided the skew feed of the sheet, damage to the sheet end or sheet jamming resulting from such interference.

Also, by displacing the image recording position in the transverse direction of the sheet in the case of automatic sheet feeding toward the inner side of the sheet, in comparison with that in the case of manual insert sheet feeding, by an amount approximately equal to the displacement amount between the first and second guide members, it is rendered possible to record the image in a same position regardless of whether the sheet feeding is executing automatically or in manual insert, thereby avoiding a drawback resulting from the difference in the recording position (for example difference in the recording position on the preprinted sheet).

What is claimed is:

1. An image forming apparatus comprising a recording apparatus having a feeding port for feeding a sheet and recording an image on the sheet fed from said feeding port, and a sheet feeding apparatus detachably mountable on said feeding port and automatically feeding sheets in succession to said recording apparatus, wherein:

said recording apparatus includes a first guide member for guiding a lateral edge of a sheet within said recording apparatus when said sheet feeding apparatus is removed from said recording apparatus;

said sheet feeding apparatus includes a second guide member for guiding a lateral edge of a sheet; and said second guide member is disposed and displaced toward the inner side of the sheet with respect to said first guide member.

2. An image forming apparatus according to claim 1, wherein an image recording position on a sheet in the transverse direction of that sheet is positioned and displaced toward the inner side of the sheet when the sheet is fed by said sheet feeding apparatus, in comparison with an image recording position when the sheet is not fed by said sheet feeding apparatus, by an amount approximately equal to a displacement amount between said first and second guide members.

3. An image forming apparatus according to claim 2, further comprising:

mode discrimination means for discriminating whether the sheet feeding is executed by said sheet feeding apparatus;

wherein the image recording position on a sheet in the transverse direction of that sheet is displaced according to the result of discrimination by said mode discrimination means.

4. An image forming apparatus according to claim 3, wherein:

said recording apparatus and said sheet feeding apparatus respectively have connectors which are electrically connectable with each other; and said mode discrimination means electrically detects a connection state of said connectors.

5. An image forming apparatus according to claim 4, wherein:

said recording apparatus includes a third guide member for guiding an edge of a sheet in the transverse direction of that sheet in cooperation with said first guide member; and a sheet conveying path is disposed to avoid said third guide member when said recording apparatus is connected to said sheet feeding apparatus.

6. An image forming apparatus according to claim 3, wherein:

said recording apparatus includes a third guide member for guiding an edge of a sheet in the transverse direction of that sheet in cooperation with said first guide member; and a sheet conveying path is disposed to avoid said third guide member when said recording apparatus is connected to said sheet feeding apparatus.

7. An image forming apparatus according to claim 2, wherein:

said recording apparatus includes a third guide member for guiding an edge of a sheet in the transverse direction of that sheet in cooperation with said first guide member; and a sheet conveying path is disposed to avoid said third guide member when said recording apparatus is connected to said sheet feeding apparatus.

8. An image forming apparatus according to claim 1, wherein:

said recording apparatus includes a third guide member for guiding an edge of a sheet in the transverse direction of that sheet in cooperation with said first guide member; and a sheet conveying path is disposed to avoid said third guide member when said recording apparatus is connected to said sheet feeding apparatus.

* * * * *

UNITED STATES PATENT AND TRADEMARK OFFICE

CERTIFICATE OF CORRECTION

PATENT NO. : 6,213,464 B1 
DATED : April 10, 2001
INVENTOR(S) : Hiroyuki Inoue et al.

It is certified that error appears in the above-identified patent and that said Letters Patent is hereby corrected as shown below:

Title page,
Item [56], References Cited, U.S. PATENT DOCUMENTS,
"5,524,874 * 6/1996 Tojima" should read
-- 5,524,874 * 6/1996 Tojima et al. --.

Column 4,
Line 54, "everyday" should read -- every day --; and
Line 65, "latter" should read -- later --.

Column 5,
Line 11, "easily" should read -- easy --.

Column 6,
Line 23, "$L1/2 \lesssim L2 \lesssim L1$-15 mm" should read -- $L1/2 \leq L2 \leq L1$-15 mm --;
Line 30, "$L1/2 \gtrsim L2$," should read -- $L1/2 \geq L2$, --;
Line 54, "$L1/4 \lesssim L3 \lesssim L1/2$" should read -- $L1/4 \leq L3 \leq L1/2$ --; and
Line 55, "lifting" should read -- lifting of --.

Column 7,
Line 56, "allows" should read -- allow --.

Column 11,
Line 46, "regardless" should read -- regardless of --.

Column 14,
Line 51, "state and," should read -- state, and --.

Column 17,
Line 24, "remove" should read -- removes --; and
Line 40, "$F1 \gtrsim (X1/X2) \times P1 + P2$" should read -- $F1 \geq (X1/X2) \times P1 + P2$ --.

Column 18,
Line 15, "has" should read -- have --.

Column 21,
Line 34, "regardless" should read -- regardless of --.

Column 22,
Line 39, "High" should read -- high --.

UNITED STATES PATENT AND TRADEMARK OFFICE

CERTIFICATE OF CORRECTION

PATENT NO. : 6,213,464 B1
DATED : April 10, 2001
INVENTOR(S) : Hiroyuki Inoue et al.

It is certified that error appears in the above-identified patent and that said Letters Patent is hereby corrected as shown below:

Column 24,
Line 47, “broke-lined” should read -- broken-lined --; and
Line 56, “operation,the” should read -- operation, the --.

Column 25,
Line 30, “Pc+P5≲Pmax,” should read -- Pc+P5≤Pmax, --;
Line 51, “Pc+P5≲Pmax.” should read -- Pc+P5≤Pmax. --; and
Line 54, “PS” should read -- P5 --.

Column 27,
Line 23, “predetermine” should read -- predetermined --.

Column 29,
Line 54, “opposed” should read -- opposed to --.

Signed and Sealed this

Twenty-second Day of November, 2005

JON W. DUDAS
*Director of the United States Patent and Trademark Office*